US005408301A

United States Patent [19]

Tokishige et al.

[11] Patent Number: 5,408,301

[45] Date of Patent: Apr. 18, 1995

[54] ELECTROPHOTOGRAPHIC APPARATUS HAVING TWO FIXING SECTIONS AND CONTROL MEANS FOR CONTROLLING TEMPERATURE ADJUSTMENTS SELECTIVELY TO THE FIXING SECTIONS

[75] Inventors: Masato Tokishige, Nara; Kiyoshi Inamoto, Sakai; Atsushi Kurimoto, Nara; Nobuyuki Ueda; Tokiyuki Okano, both of Yamatokoriyama; Kazunori Soda, Nara; Kazunori Iwasa; Tomiyuki Ishikawa, both of Yamatokoriyama; Hidetoshi Kaneko, Ayama; Toshiki Ohgita, Shiki; Hideo Matsuda, Nara; Takashi Kubo, Soraku; Syuichi Yoshinaka, Osaka; Yasuhiro Ono, Yamatokoriyama; Yoshiaki Masuda, Nara, all of Japan

[73] Assignee: Sharp Labushiki Kaisha, Osaka, Japan

[21] Appl. No.: 40,662

[22] Filed: Mar. 31, 1993

[30] Foreign Application Priority Data

| | | | |
|---|---|---|---|
| Apr. 2, 1992 | [JP] | Japan | 4-081135 |
| Apr. 10, 1992 | [JP] | Japan | 4-091012 |
| Apr. 15, 1992 | [JP] | Japan | 4-095450 |
| Apr. 23, 1992 | [JP] | Japan | 4-104671 |
| Jun. 9, 1992 | [JP] | Japan | 4-149552 |
| Jun. 17, 1992 | [JP] | Japan | 4-157956 |
| Aug. 20, 1992 | [JP] | Japan | 4-221296 |
| Feb. 19, 1993 | [JP] | Japan | 5-030802 |

[51] Int. Cl.[6] ..... G03G 15/20

[52] U.S. Cl. ..... 355/285; 219/216; 219/388; 355/206; 355/209; 355/326

[58] Field of Search ..... 355/285, 289, 290; 219/216, 388; 432/60

[56] References Cited

U.S. PATENT DOCUMENTS

| | | | |
|---|---|---|---|
| 3,965,331 | 6/1976 | Moser et al. | 219/216 |
| 4,526,459 | 7/1985 | Bresnick | 432/60 X |
| 4,920,250 | 4/1990 | Urban | 219/216 |
| 4,928,148 | 5/1990 | Higashi | 355/290 |

FOREIGN PATENT DOCUMENTS

| | | |
|---|---|---|
| 51-98036 | 8/1976 | Japan . |
| 2-191979 | 7/1990 | Japan . |

*Primary Examiner*—R. L. Moses

*Attorney, Agent, or Firm*—David G. Conlin; George W. Neuner

[57] ABSTRACT

An electrophotographic apparatus is provided with a fixing device having the first through third fixing rollers for forming the first fixing section by contacting the first and second fixing rollers as well as forming the second fixing section by contacting the second and third fixing rollers, the first fixing section being temperature-adjusted in relation to a first copying mode, the second fixing section being temperature-adjusted in relation to a second copying mode. Either the first or second fixing section is temperature-adjusted according to the order of priority in such a manner that after the completion of the temperature adjustments, temperature adjustments with respect to the other fixing section is successively carried out.

28 Claims, 51 Drawing Sheets

ELECTROPHOTOGRAPHIC APPARATUS HAVING TWO FIXING SECTIONS AND CONTROL MEANS FOR CONTROLLING TEMPERATURE ADJUSTMENTS SELECTIVELY TO THE FIXING SECTIONS

FIELD OF THE INVENTION

The present invention relates to an electrophotographic apparatus that is provided with a fixing device having three fixing rollers, that is, the first through third fixing rollers, wherein two fixing sections are respectively formed at contacting sections between the first and second fixing rollers and again between the second and third fixing rollers.

BACKGROUND OF THE INVENTION

As shown in FIG. 51, such copying machines, that is, electrophotographic apparatuses, which have a pair of upper and lower heat rollers 914*a* and 914*b* installed in the fixing device 914, are commonly known in the art. The copying machine of this type is capable of executing both the mono-color copying operation and the full-color copying operation. In the copying machine, a scanning is made of an original document (not shown), which has been placed on the document platen 903, by the light source lamp 902 of the optical system 901, and the photoreceptor 905 is exposed by the reflected light from the original document that is directed thereonto through a filter 904. A latent image thus formed on the photoreceptor 905 is developed by color toner stored in developing devices 906 through 908, or by black toner stored in a developing device 909. Then, the toner image is transferred onto a sheet of paper that is supplied from one of the paper cassettes 911 through 913 by the use of an intermediate transferring belt 910, and this sheet of paper is sent to the fixing device 914. In the fixing device 914, the upper and lower heat rollers 914*a* and 914*b* are pressed against each other to form a fixing section, where the toner of the toner image melts down and the toner image is thus fixed onto the sheet of paper.

In the copying operations, there are two copying modes: a mono-color copying mode for making mono-color copies that do not need any gloss on their picture; and a full-color copying mode for making full-color copies that need gloss on their picture image. Here, depending on the respective copying modes, different fixing conditions are required in relation to materials of the heat rollers, fixing temperatures, etc.; however, the conventional copying machines, which are provided with the fixing device 914 having only the two heat rollers 914*a* and 914*b*, have failed to fully satisfy all these requirements. This results in a problem of limited materials of copy paper to be used, and it has been difficult to obtain superior copied images.

In order to solve such problems, it has been suggested to install different fixing devices respectively used for the full-color copying mode and the mono-color copying mode. This arrangement makes it possible to provide optimum copying operations for both the full-color copying mode and the mono-color copying mode, thereby reducing the cost of copying in the mono-color copying mode. However, such an arrangement having two individual fixing devices causes the structure to become more complicated as well as causing the apparatus to become bulky. This makes it difficult to adopt the arrangement.

Meanwhile, Japanese Laid-Open Patent Applications No. 98036/1976 (Tokukaishou 51-98036, U.S. Pat. No. 3,965,331) and No. 191979/1990 (Tokukaihei 2-191979, U.S. Pat. No. 4,928,148) disclose a fixing device wherein: three heat rollers, the upper, middle and lower ones, are provided in a contacted state; the first fixing section is formed between the upper and middle heat rollers while the second fixing section is formed between the middle and lower heat rollers; and a conveyer belt for transporting sheets of copy paper to the first and second fixing sections is arranged to move up and down in response to either of the fixing sections to be used.

In accordance with this arrangement, different fixing conditions are obtained by selecting materials of the upper, middle and lower heat rollers appropriately and providing different set temperatures to the first and second fixing sections; thus, the fixing operations are conducted using the different fixing conditions that are respectively suitable for the full-color copying mode and the mono-color copying mode without being limited by materials of copy paper to be used. Further, in comparison with the case of installing individual fixing devices used for the full-color copying mode and the mono-color copying mode, this arrangement achieves such features as: easy designs on mechanisms such as a transporting mechanism for copy paper; simplified structure; reduction of the cost; and compactness of the apparatus.

In the fixing device installed in the above-mentioned conventional copying machine, both of the first and second fixing sections are heated and temperature-insulated during the warm-up of the copying machine and during the stand-by state thereof. Here, as disclosed in Japanese Laid-Open Patent Publication No. 191979/1990 (Tokukaihei 2-191979), since the rated power consumption (power to be supplied to the fixing device) of the copying machine is limited, it is designed in its specification to restrict the total electrical quantity, which is required for heating up and temperature-insulating the first and second fixing sections, etc., within the rated power consumption.

However, in this case, it takes a long time from activation of the power switch until the first and second fixing sections are heated up to respective set temperatures, and electric power to be required for the temperature insulation is restricted. Therefore, the copying machine of this type has a problem wherein during the stand-by state between one copying operation and the next, the temperature insulation tends to be insufficient. Further, it has another problem wherein since the upper, middle and lower heat rollers are constantly kept in the contacted state, the efficiency of temperature adjustments to be applied to the heat rollers is reduced, for example, in the case where there are great differences in the set temperatures of the heat rollers that are kept in the tightly contacted state.

SUMMARY OF THE INVENTION

It is the primary objective of the present invention to provide an electrophotographic apparatus which ensures a stable temperature-insulation of fixing sections during the stand-by state of the apparatus, and shortens a waiting time that is required until the apparatus becomes ready for a desired copying operation after activation of the apparatus.

In order to achieve the above objective, the copying machine of the present invention is provided with: a fixing means which has three fixing rollers, the first through third ones, and forms a first fixing section by contacting the first and second fixing rollers as well as forming a second fixing section by contacting the second and third fixing rollers, the first fixing section being temperature-adjusted in relation to a first copying mode, the second fixing section being temperature-adjusted in relation to a second copying mode; a temperature adjusting means for applying temperature adjustments to the first and second fixing sections; and an adjustment order controlling means for controlling the temperature adjusting means in such a manner that temperature adjustments are applied to either the first or second fixing section according to an order of priority, and that after the completion of the temperature adjustments, temperature adjustments with respect to the other fixing section is successively carried out.

With this arrangement, temperature adjustments are preferentially carried out on either of the first and second fixing sections according to the predetermined order of priority, and after the completion of the temperature adjustments, temperature adjustments with respect to the other fixing section is successively carried out. Therefore, in comparison with an arrangement wherein temperature adjustments are carried out on both of the fixing sections under a condition of limited power to be supplied, temperature adjustments of the fixing sections can be conducted using greater electric power. Thus, it is possible to shorten time required for warming up the apparatus as well as stabilize the heat insulation during the stand-by state of the apparatus.

Further, the copying machine of the present invention is provided with: first through third heating means for heating the first through third fixing rollers by applying electric power; and a fourth control means which controls the electric power in such a manner that electric power is applied to the first and second or the second and third heating means for a pair of fixing rollers constituting either one of the first and second fixing sections, and after the temperatures of the pair of the fixing rollers have exceeded respective preset temperatures, electric power is preferentially applied to the first or the third heating means for the rest of the fixing rollers, while maintaining the pair of the fixing rollers at the preset temperature by controlling electric power to be applied to the first and second or the second and third heating means for the pair of the fixing rollers constituting the relevant fixing section, within the total electric energy that can be simultaneously supplied to all the heating means.

With this arrangement, electric power is applied to the first and second or the second and third heating means for a pair of fixing rollers constituting either one of the first and second fixing sections, and after the temperatures of the pair of the fixing rollers have exceeded respective preset temperatures, electric power is preferentially applied to the first or the third heating means for the rest of the fixing rollers, while maintaining the pair of the fixing rollers at the preset temperature by controlling electric power to be applied to the first and second or the second and third heating means for the fixing rollers constituting the relevant fixing section, within the total electric energy that can be simultaneously supplied to all the heating means. Therefore, even if one of the fixing sections is continuously used, temperature adjustments are appropriately conducted on fixing rollers constituting the other fixing section which has not been used. Accordingly, even in the case of using the other fixing section after switching the fixing sections to be used, waiting time required for the warm-up of the fixing rollers that have not been used is shortened; this results in shortening of the waiting time required in switching the fixing sections to be used.

Further, the copying machine of the present invention is provided with: a selection means for selecting either of the first and second fixing sections; and a first precedence-setting means for setting the order of priority in the adjustment order controlling means in such a manner that, during warm-up time of the copying machine, temperature adjustments are preferentially applied to the fixing section that has been selected through the selection means.

Thus, since temperature adjustments are preferentially applied to the selected fixing section, it is possible to shorten a waiting time that is required until the apparatus becomes ready for a desired copying operation after activation of the apparatus.

Further, the copying machine of the present invention is provided with: a selection means for selecting either of the first and second fixing sections; a storage means for storing the fixing section that has been selected by the selection means; and a second precedence-setting means for setting the order of priority in the adjustment order controlling means in such a manner that, during warm-up time of the copying machine, temperature adjustments are preferentially applied to the fixing section that has been stored in the storage means.

With this arrangement, upon activating the copying machine, the second precedence-setting means sets the order of priority in the adjustment order controlling means in such a manner that, during warm-up time of the copying machine, temperature adjustments are preferentially applied to the fixing section that has been stored in the storage means; this makes it possible to improve the operability of the copying machine as well as to shorten a waiting time that is required until the apparatus becomes ready for a desired copying operation after activation of the apparatus.

Moreover, the present invention is characterized in that the storage means stores either of the fixing sections that had been used before the apparatus was shut down.

Thus, the storage means stores either of the fixing sections that had been used before the machine was shut down due to any failure such as a paper jam, and the second precedence-setting means sets the order of priority in the adjustment order controlling means according to this storage; this makes it possible to improve the operability of the copying machine as well as to shorten a waiting time that is required until the apparatus becomes ready for a desired copying operation after activation of the apparatus.

Moreover, the present invention is characterized in that the selection means selects either of the first and second fixing sections in accordance with various types of image-quality modes.

Thus, either of the first and second fixing sections is selected in accordance with a specified one of image-quality modes, and temperature adjustments are preferentially carried out on the selected fixing section; this makes it possible to improve the operability of the copying machine as well as to shorten a waiting time that is required until the apparatus becomes ready for a desired copying operation after activation of the apparatus.

Further, the copying machine of the present invention is provided with a toner detection means for detecting the presence or absence of toner to be used for the respective first copying mode and second copying mode, and the selection means selects either of the first and second fixing sections in accordance with the presence or absence of toner that has been detected by the toner detection means.

Thus, either of the first and second fixing sections is selected in accordance with the presence or absence of toner that has been detected by the toner detection means, and temperature adjustments are preferentially carried out on the selected fixing section; this makes it possible to prevent a wasteful operation wherein temperature adjustments are preferentially carried out on a fixing section that is not applicable due to the absence of toner.

Moreover, the present invention is characterized in having a display means for indicating which of the first and second fixing sections is being subjected to temperature adjustments.

Further, the present invention is characterized in having a fixing-roller controlling means by which upon applying temperature adjustments to the other fixing section, the pair of fixing rollers forming one of the fixing sections that has been subjected to the temperature adjustments, are rotated while maintaining the contact between the pair of the fixing rollers.

Thus, upon applying temperature adjustments to the other fixing section, the fixing-roller controlling means rotates the pair of fixing rollers forming one of the fixing sections that has been subjected to the temperature adjustments while maintaining the contact between the pair of the fixing rollers; therefore, the fixing section having already been temperature-adjusted is maintained in a temperature-insulated state. This makes it possible to prevent an abrupt temperature drop with respect to the preferential one of the fixing sections, which takes place while applying temperature adjustments to the other fixing device, thereby shortening a waiting time that is required until the apparatus becomes ready for a desired copying operation after activation of the apparatus.

Moreover, the present invention is characterized in having: a fixing-section forming means for allowing on demand the contact and separation between either pair of the fixing rollers, which form the first and second fixing sections respectively; and a fifth control means for controlling the fixing-section forming means in such a manner that upon applying temperature adjustments to the first through third fixing rollers, either the first or third fixing roller, whose set temperature has a smaller difference from the set temperature of the second fixing roller, is pressed against the second fixing roller.

With this arrangement, upon conducting the temperature adjustments, only the fixing roller whose set temperature has the smaller difference is pressed against the second heat roller in accordance with the set temperatures of the fixing rollers; therefore, in comparison with the case where the fixing roller whose set temperature has a greater difference is pressed thereonto, it is preventable to have the heat roller having a lower set temperature overheated and to have the heat roller having a higher set temperature insufficiently heated between the contacted fixing rollers. Thus, the efficiency of the temperature adjustments can be improved.

Further, the present invention is characterized in having a first control means, which controls the temperature adjusting means in such a manner that after completion of an image forming operation by the use of either of the first and second fixing sections, the temperature adjusting means continues to conduct temperature adjustments on the same fixing section during the stand-by state until the next image forming operation is called for.

With this arrangement, after completion of an image forming operation, during the stand-by state before having a demand for the next image forming operation, temperature adjustments are continuously conducted with respect to the fixing section that has been used immediately before; therefore, temperature insulation is stabilized during the stand-by state of the apparatus, and temperature adjustments are preferentially conducted on the fixing section that has been frequently used in response to each image forming operation. Consequently, a waiting time required for starting a succeeding desired image forming operation can be shortened. Moreover, since the operator does not need to specify a fixing section to be used during the stand-by state, the operability of the apparatus is improved.

Further, the present invention is characterized in having a second control means, which controls the temperature-adjusting means in such a manner that, after completion of a copying operation using either of the first and second fixing sections, during the stand-by state before having a demand for the next image forming operation, the temperature-adjusting means preferentially conducts temperature adjustments with respect to one of the fixing sections that has been used more times than the other fixing section in the number of image forming operations that have been executed up to the preceding operation.

With this arrangement, after completion of an image forming operation, during the stand-by state before having a demand for the next image forming operation, temperature adjustments are preferentially conducted with respect to one of the fixing sections that has been used more times than the other fixing section in the number of image forming operations that have been executed up to the preceding operation; therefore, temperature insulation is stabilized during the stand-by state of the apparatus, and temperature adjustments are preferentially conducted on the fixing section that has been frequently used in response to each image forming operation. Consequently, a waiting time required for starting a succeeding desired image forming operation can be shortened. Moreover, since the operator does not need to specify a fixing section to be used during the stand-by state, the operability of the apparatus is improved.

Further, the present invention is characterized by having a third control means for providing temperature adjustments in the following manner: Fixing rollers constituting either of the first and second fixing sections are heated, and when the temperatures of the fixing rollers have exceeded respective predetermined temperatures, the heating operation of the fixing rollers are stopped. During a period of time when the temperatures of the fixing rollers are kept above the predetermined temperatures, the temperature adjustments are applied to the rest of the fixing rollers.

With this arrangement, even in the case of using the other fixing section after switching the fixing sections to be used, a waiting time required for the warm-up of the fixing rollers that have not been used is shortened; this results in shortening of the waiting time required in switching the fixing sections to be used.

For a fuller understanding of the nature and advantages of the invention, reference should be made to the ensuing detailed description taken in conjunction with the accompanying drawings.

BRIEF DESCRIPTION OF THE DRAWING

FIG. 1 is a flow chart which indicates operations for providing temperature adjustments to heat rollers installed in a fixing device of a copying machine.

FIG. 2 is a vertical sectional view showing the entire structure of the copying machine.

FIG. 3 is an enlarged sectional view showing a structure in the proximity of the fixing section of the copying machine.

FIG. 4 is a block diagram showing the structure of an essential part of a control system that is provided in the copying machine.

FIG. 5 is a flow chart which indicates operations for providing temperature adjustments to heat rollers installed in a fixing device of a copying machine.

FIG. 6 is a flow chart which indicates operations for providing temperature adjustments to heat rollers installed in a fixing device of a copying machine.

FIG. 7 is a flow chart which specifically indicates operations for providing temperature adjustments to heat rollers in the processes from (1) to (2) shown in the flow chart of FIG. 6.

FIG. 8 is a flow chart which indicates operations for providing temperature adjustments to heat rollers in the fixing device after a main power source is turned on.

FIG. 9 is a flow chart which indicates the operations in the case where an upper fixing section is preferentially subjected to temperature adjustments.

FIG. 10 is a flow chart which indicates the operations in the case where a lower fixing section is preferentially subjected to temperature adjustments.

FIG. 11 is an enlarged sectional view showing a structure in the proximity of the fixing device of the copying machine.

FIG. 12 is a flow chart which indicates the operations in the case where after the upper fixing section have been subjected to temperature adjustments, the upper fixing section is kept in a temperature-insulated state while applying temperature adjustments to the lower fixing section.

FIG. 13 is a flow chart which indicates the operations in the case where after the lower fixing section have been subjected to temperature adjustments, the lower fixing section is kept in a temperature-insulated state while applying temperature adjustments to the upper fixing section.

FIG. 14 is a block diagram showing the structure of an essential part of a control system that is provided in the copying machine.

FIG. 15 is a flow chart which indicates operations for providing temperature adjustments to specified heat rollers after a main power source is turned on.

FIG. 16 is a flow chart which indicates the operations in the case where an upper fixing section is preferentially subjected to temperature adjustments.

FIG. 17 is a flow chart which indicates the operations in the case where a lower fixing section is preferentially subjected to temperature adjustments.

FIG. 18 is a block diagram showing the structure of an essential part of a control system that is provided in the copying machine.

FIG. 19 is part of a flow chart which indicates operations for providing temperature adjustments to heat rollers in the fixing device after having removed a jammed sheet of paper from the copying machine.

FIG. 20 is part of a flow chart which indicates operations for providing temperature adjustments to heat rollers in the fixing device after having removed a jammed sheet of paper from the copying machine.

FIG. 21 is part of a flow chart which indicates operations for providing temperature adjustments to heat rollers in the fixing device after having removed a jammed sheet of paper from the copying machine.

FIG. 22 is a block diagram showing the structure of an essential part of a control system that is provided in the copying machine.

FIG. 23 is a block diagram showing the structure of an essential part of an operation panel that is provided in the copying machine.

FIG. 24 is part of a flow chart which indicates operations for providing temperature adjustments to heat rollers in the fixing device, after turning on the power source of the copying machine or after having removed a jammed sheet of paper from the copying machine.

FIG. 25 is part of a flow chart which indicates operations for providing temperature adjustments to heat rollers in the fixing device, after turning on the power source of the copying machine or after having removed a jammed sheet of paper from the copying machine.

FIG. 26 is a vertical sectional view showing the entire structure of the copying machine.

FIG. 27 is an enlarged sectional view showing the copying machine main body.

FIG. 28 is an enlarged sectional view showing a structure in the proximity of the fixing device of the copying machine.

FIG. 29 is a schematic front view showing a state of a heat-roller-shifting mechanism during a mono-color copying operation, which is installed in the fixing device of the copying machine.

FIG. 30 is a schematic front view showing a state of a heat-roller-shifting mechanism during a full-color copying operation, which is installed in the fixing device of the copying machine.

FIG. 31 is a block diagram showing the structure of a temperature controlling device that is provided in the copying machine.

FIG. 32 is a flow chart of a controlling operation that is executed by the temperature controlling device during a full-color copying operation.

FIG. 33 is an explanatory drawing which shows changes in the surface temperatures of the upper through lower heat rollers during a full-color copying operation and the operational timing of the upper through lower heat rollers that is controlled by the temperature controlling device in response to those changes.

FIG. 34 is a flow chart showing a controlling operation that is executed by the temperature controlling device during a mono-color copying operation.

FIG. 35 is a flow chart showing a controlling operation that is executed by the temperature controlling device during the stand-by state.

FIG. 36 is an explanatory drawing which shows changes in the surface temperatures of the upper through lower heat rollers during the stand-by state and the operational timing of the upper through lower heat rollers that is controlled by the temperature controlling device in response to those changes.

FIG. 37 is an explanatory drawing showing an essential part of a fixing device installed in the copying machine.

FIG. 38 is a flow chart showing a controlling operation that is executed until completion of the warm-up of middle and lower heat rollers that are used for a mono-color copying mode.

FIG. 39 is a flow chart showing a controlling operation that is executed after completion of the warm-up of the middle and lower heat rollers.

FIG. 40 is a vertical sectional view showing the entire structure of a copying machine.

FIG. 41 is an enlarged sectional view showing a structure in the proximity of the fixing device of the copying machine.

FIG. 42 is a schematic front view showing states of a suction unit and the fixing device during a full-color copying operation.

FIG. 43 is a schematic front view showing states of a suction unit and the fixing device during a mono-color copying operation.

FIG. 44 is a block diagram showing the structure of an essential part of a control system that is provided in the copying machine.

FIG. 45 is a flow chart showing operations by which the control system provides temperature adjustments to heat rollers in the fixing device.

FIG. 46 is a block diagram showing the structure of an essential part of a control system that is provided in the copying machine.

FIG. 47 is a flow chart showing operations by which the control system provides temperature adjustments to heat rollers in the fixing device.

FIG. 48 is a vertical sectional view showing the entire structure of a copying-machine.

FIG. 49 is a block diagram showing the structure of an essential part of a control system that is provided in the copying machine.

FIG. 50 is a flow chart showing operations by which the control system provides temperature adjustments to heat rollers in the fixing device.

DETAILED DESCRIPTION OF THE EMBODIMENTS

[EMBODIMENT 1]

Referring to FIGS. 1 through 5, the following description will discuss one embodiment of the present invention.

Figure 2:
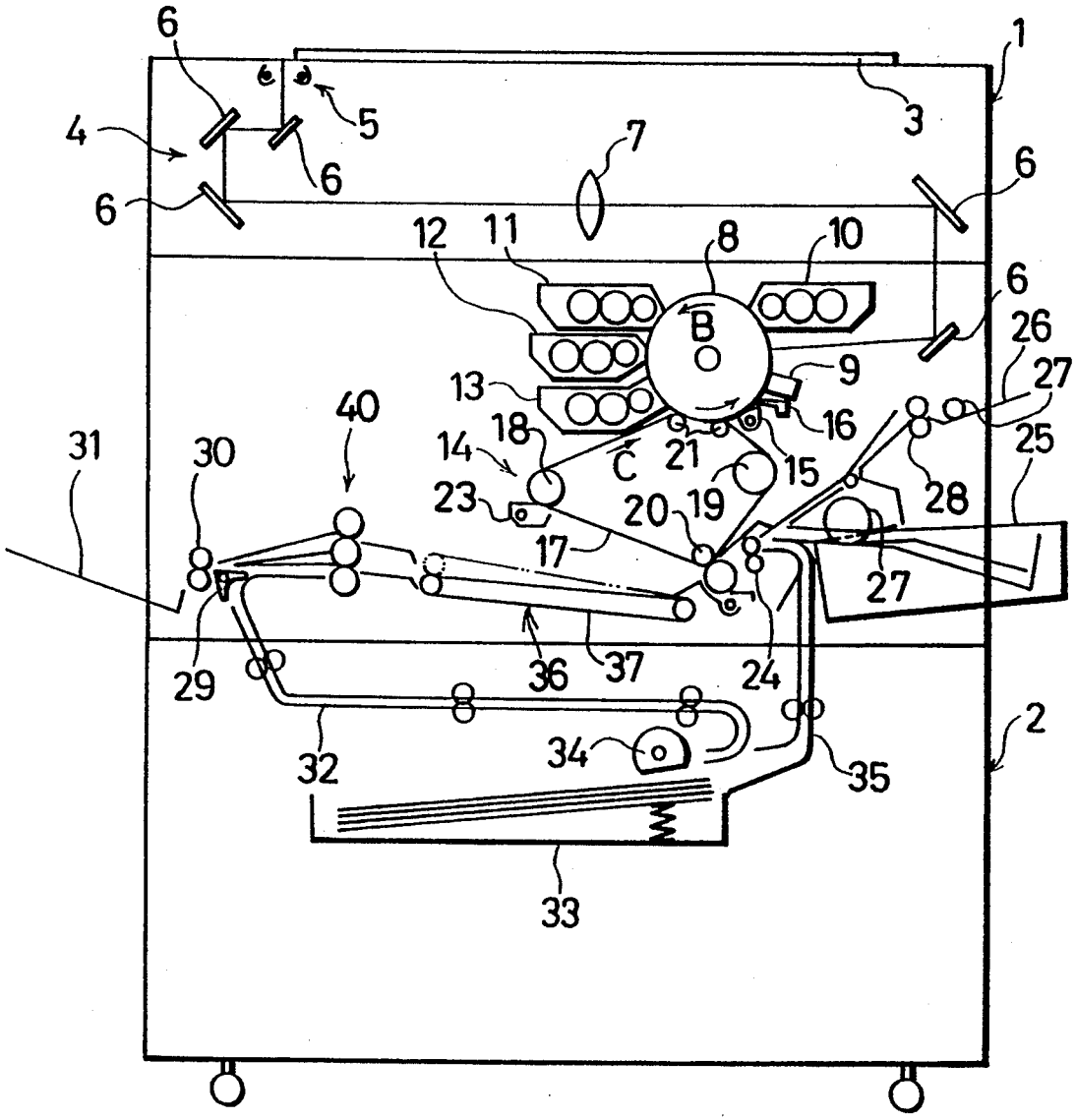

As illustrated in FIG. 2, a full color copying machine (hereinafter referred to simply as copying machine), which is exemplified as an electrophotographic apparatus in accordance with the present embodiment, is provided with a copying machine main body 1 and a reversal re-transporting unit 2 that is installed below the copying machine main body 1.

The copying machine main body 1 has a document platen 3, made of hard transparent glass, installed on the upper surface thereof, and below the document platen 3 is disposed an exposure-use optical system 4. The exposure-use optical system 4 is constituted of: a lamp unit 5 for projecting light and scanning an original document (not shown) 2 that is placed on the document platen 3; a plurality of reflection mirrors 6 for directing the light reflected from the original document onto a photoreceptor 8; and a lens unit 7 that is disposed in the light path of the reflected light.

On the periphery of the photoreceptor 8, is installed a main charger 9 for charging the surface of the photoreceptor 8 to a predetermined voltage. Further, from the main charger 9 to the rotation direction of the photoreceptor 8, are disposed an eraser device for erasing a space between images (not shown), a black developer tank 10, a yellow developer tank 11, a magenta developer tank 12, a cyan developer tank 13, an intermediate transfer device 14, a cleaning device 15 and a static eliminating device 16 in this order.

On the paper feeding side with respect to the intermediate transfer device 14, are installed a resist roller 24 for supplying sheets of copying paper to the intermediate transfer device 14 with predetermined time intervals, a feeding cassette 25, and a feeding tray 26. A feeding roller 27, a transporting roller 28 and other members are installed in the proximity of the feeding cassette 25 and the feeding tray 26.

From the intermediate transfer device 14 toward the paper discharging side, are installed a suction unit 36 for transporting sheets of copy paper, a fixing device 40, a switching gate 29, a discharge roller 30, and a discharge tray 31. The switching gate 29 is designed to switch the transport directions of sheets of copying paper, discharged from the fixing device 40, between the direction toward the discharge roller 30 and the direction toward a transport path 32 located below.

The transport path 32, which extends to an intermediate tray 33 located inside the reversal re-transporting unit 2, transports a sheet of copy paper that has been processed in the fixing device 40, and discharges the sheet of copy paper onto the intermediate tray 33 with its image-bearing surface facing up. Sheets of copy paper, which have been transported through the transport path 32, are piled up on the intermediate tray 33, and these sheets of copy paper are then sent to a transport path 35 by a feeding roller 34. The transport path 35 reverses a sheet of copy paper that has been sent from the intermediate tray 33, and transports it to a resist roller 24.

Figure 3:
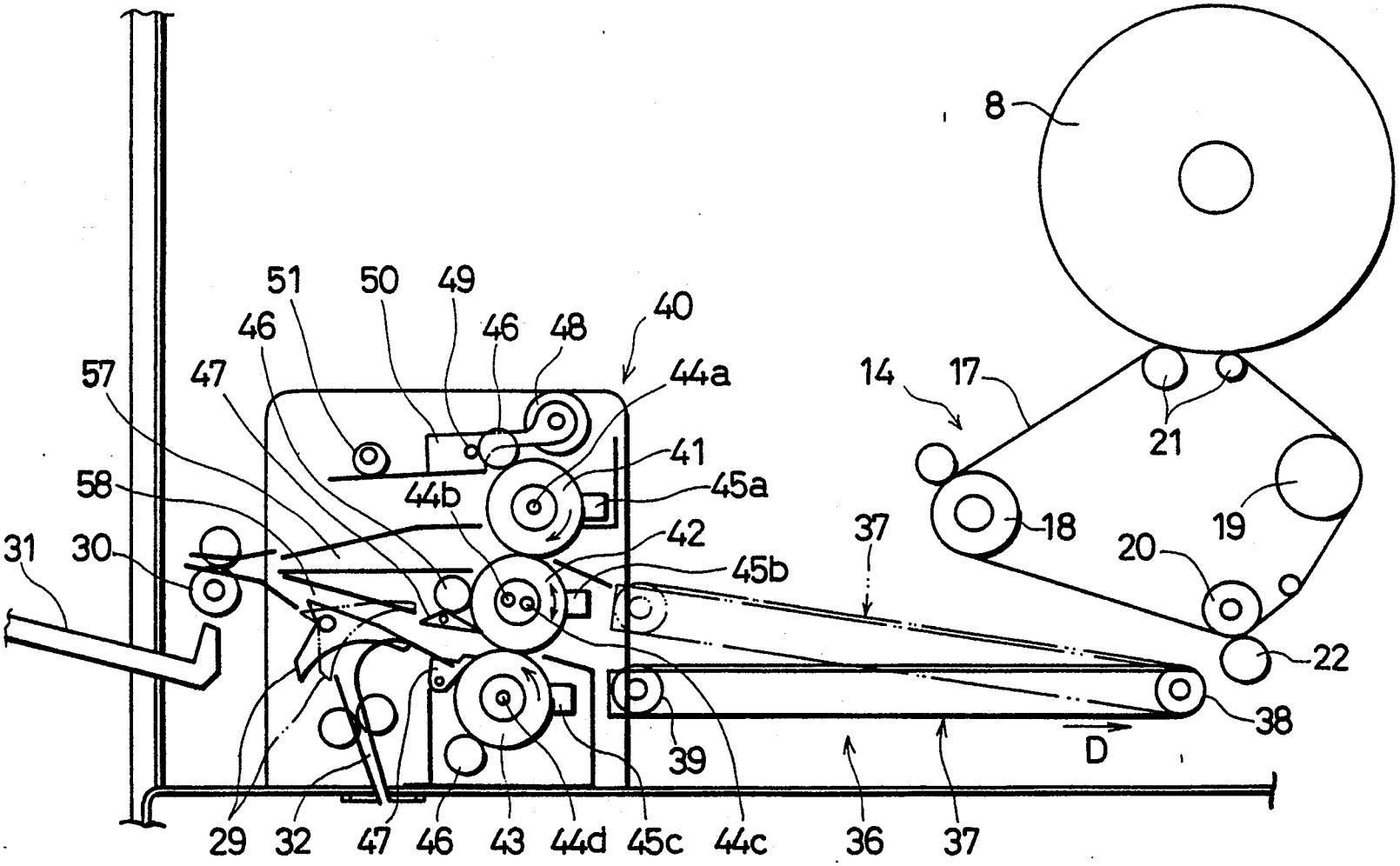

As illustrated in FIG. 3, the intermediate transfer device 14 is constituted of: a transferring belt 17; rollers 18, 19 and 20 for supporting the transferring belt 17; the first transferring roller 21 for pressing the transferring belt 17 onto the photoreceptor 8 so as to transfer a toner image formed on the surface of the photoreceptor 8 onto the transferring belt 17; and the second transferring roller 22, which is pressed against the roller 20 with the transferring belt 17 sandwiched in between, during the transferring operation of the toner image onto a sheet of copy paper, such that the toner image on the surface of the transferring belt 17 is transferred onto the sheet of copy paper.

The suction unit 36 has a structure wherein a conveyer belt 37 is supported by a driving shaft 38 located on the paper feeding side and a driven shaft 39 located on the paper discharging side. The conveyer belt 37 is rotatively moved in direction D in FIG. 3 by the driving shaft 38, which is rotated by a driving force transmitted from a belt-driving motor 54 to be described later.

The suction unit 36, which transports a sheet of copy paper to the fixing device 40 by means of the conveyer belt (not shown) that is rotatively moved, is arranged to pivot toward an upper station and toward a lower station on its end portion on the paper feeding side as the center of the pivotal movement. The upper station is provided for transporting a sheet of copy paper to an upper fixing section (a first fixing section) in the fixing device 40, while the lower station is provided for transporting a sheet of copy paper to a lower fixing section (a second fixing section) in the fixing device 40. Here, the pivotal movements toward the upper and lower stations are carried out by a shifting mechanism, not shown, such as a cam mechanism or a solenoid (both, not shown) that is located on the undersurface side of the suction unit 36.

The fixing device 40 has an upper heat roller 41 (first fixing roller), a middle heat roller 42 (second fixing roller), and a lower heat roller 43 (third fixing roller), which are disposed in parallel with one another in the vertical position. The middle heat roller 42, on which the upper heat roller 41 is pressed, is arranged to be also depressed by the lower heat roller 43 from under. In the present embodiment, a fixing process associated with a full-color copying mode (first copying mode) is executed in the upper fixing section that corresponds to the contact portion between the upper heat roller 41 and the middle heat roller 42, while a fixing process associated with a mono-color copying mode (second copying mode) is executed in the lower fixing section that corresponds to the contact portion between the middle heat roller 42 and the lower heat roller 43. Accordingly, the surfaces of those rollers are respectively formed by using appropriate rubber materials; that is, silicone rubber for the upper heat roller 41, teflon rubber for the middle heat roller 42 and teflon rubber or other material for the lower heat roller 43. Here, in order to provide superior surface-releasing property with respect to a three-layered toner image used for a full-color image, the surface of the upper heat roller 41 is made especially smooth.

Each of the heat rollers 41 to 43 has a hollow structure. An upper heater lamp **44*a* and a lower heater lamp 44*d*, both used for heating, are respectively installed inside the upper heat roller 41 and the lower heat roller 43, and two heater lamps, the first middle heater lamp 44*b* and the second middle heater lamp 44*c*, both used for heating, are installed inside the middle heat roller 42**.

The above-mentioned upper, the first middle, the second middle and the lower heater lamps **44*a* through 44*d* have respective power consumptions of, for example, 650 W, 350 W, 300 W and 350 W. For example, electric power of 1000 W is supplied to the fixing device 40 as an available total electric energy. Thus, the total 1000 W, which consists of 650 W of the upper heater lamp 44*a* and 350 W of the first middle heater lamp 44*b*, is used for heating with respect to the upper fixing section, while the total 1000 W, which consists of 350 W of the first middle heater lamp 44*b*, 300 W of the second middle heater lamp 44*c* and 350 W of the lower heater lamp 44*d***, is used for heating with respect to the lower fixing section.

On the periphery of those heat rollers 41 through 43, are installed the following devices: an upper, a middle, and a lower thermistors **45*a*, 45*b* and 45*c* for detecting respective surface temperatures of the heat rollers 41 through 43; thermostats (not shown) for preventing overheating, incorporated into the respective circuits of those heater lamps 44*a* through 44*d*; and cleaning rollers 46 for cleaning toner and other material that adhere to the surfaces of the respective heat rollers 41 through 43. These devices such as the upper through lower heater lamps 44*a* through 44*d*, the upper through lower thermistors 45*a* through 45*c*, the thermostats, and a control device 52, which will be described later, are designed to function as a temperature adjusting means for heating the heat rollers 41 through 43** to predetermined temperatures and maintaining the temperatures.

Further, an oil blade, not shown, is installed on the periphery of the middle heat roller 42 so as to remove excess silicone oil from the surface of the roller. Moreover, separation claws 47 are respectively installed on the periphery of the middle and lower heat rollers 42 and 43 so as to separate a sheet of copy paper from the surfaces of the rollers. An oil-coat roller 48, to which silicone oil is impregnated, is disposed on the periphery of the heat roller 41. The oil-coat roller 48 is used for coating the surface of the upper heat roller 41 with silicone oil. With this arrangement, it is possible to prevent the adhesion of color toners to the roller surface, that is, the offset of color toners, thereby maintaining superior separating property of color toner images as well as imparting gloss to full-color, copied images.

When the upper fixing section is used, the oil-coat roller 48, which is fixed to one end of a roller holder 50 that rotates on a support shaft 49, is pressed against the upper heat roller 41 by a mechanism consisting of an eccentric cam 51 installed on the other end of the roller holder 50 and a tension spring, not shown. Further, the eccentric cam 51 is driven by a driving mechanism 55 for an oil-coat roller cam, which will be described later.

Concerning the rotation of the upper, middle and lower heat rollers 41 through 43, the middle heat roller 42 is a driving roller, while the upper and lower heat rollers 41 and 43 are driven rollers. Thus, the middle heat roller 42 is driven by a heat-roller driving motor 53, which is described later, and is normally or reversely rotated depending on which fixing section is used, the upper fixing section or the lower fixing section.

Further, an upper transport path 57 and a lower transport path 58 are respectively installed on the paper discharging side of the upper fixing section and the lower fixing section in the fixing device 40; thus, a sheet of copy paper, which has been subjected to a fixing process of the toner image in the upper fixing section or in the lower fixing section, is sent to the discharge roller 30 through the upper transport path 57 or the lower transport path 58. Here, in the case of a two-sided copying operation, a sheet of copy paper is switched in its course by the switching gate 29, and sent from the lower transport path 58 to the transport path 32 that is followed by the reversal re-transporting unit 2.

Figure 4:
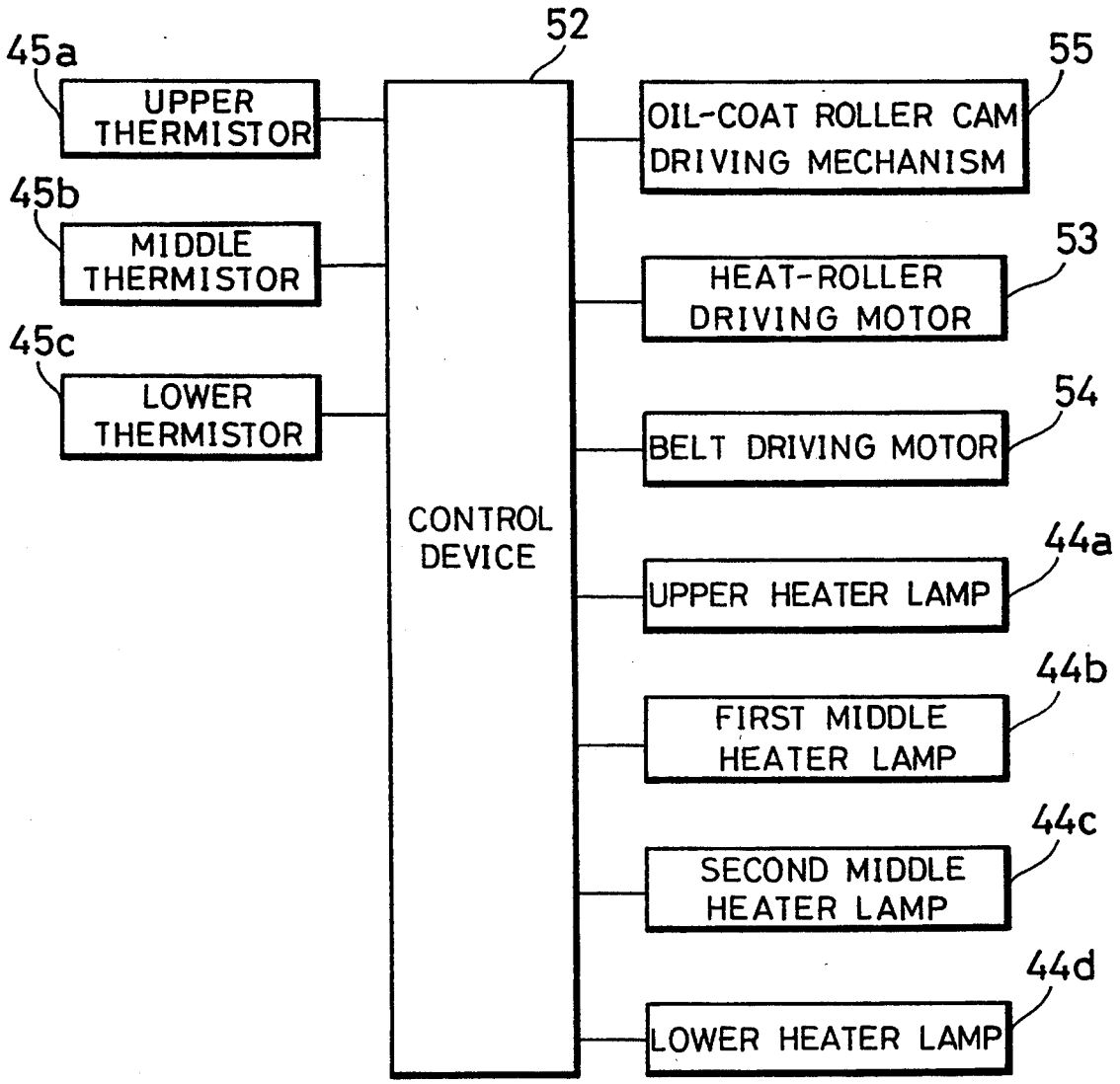

As illustrated in FIG. 4, the copying machine of the present embodiment is provided with a control device 52 constituted of, for example, a microcomputer, for controlling the suction unit 36 and the fixing device 40. The control device 52 functions as an adjustment order controlling means, which switches the objects of adjustment according to the predetermined order of priority, in such a manner that after the completion of temperature adjustment with respect to either the upper fixing section or the lower fixing section, temperature adjustment with respect to the other fixing section are successively carried out.

More specifically, the control device 52 controls the operations of such devices as the heat-roller driving motor 53, the belt-driving motor 54, the driving mechanism 55 for the oil-coat roller cam, and the heater lamps 44*a* through 44*d* according to inputs from the thermistors 45*a* through 45*c* as well as from sensors, various input keys, etc., not shown; thus, temperature adjustments on the heat roller 41 through 43 are carried out by turning on and off the heater lamps 44*a* through 44*d* in response to signals that are sent from the thermistors 45*a* through 45*c* that detect the surface temperatures of the heat rollers 41 through 43.

In this case, the order of priority, which specifies which is preferentially temperature-adjusted, the upper fixing section or the lower fixing section, may be preliminarily stored in the control device 52 in a fixed manner, or may be desirably set by the operator or depending on conditions of the device. Here, in the case of the fixed order of priority, the order of priority may be desirably determined so that the lower fixing section for use in the mono-color copying mode is preferentially temperature-adjusted since the mono-color copying mode is used more frequently.

Figure 1:
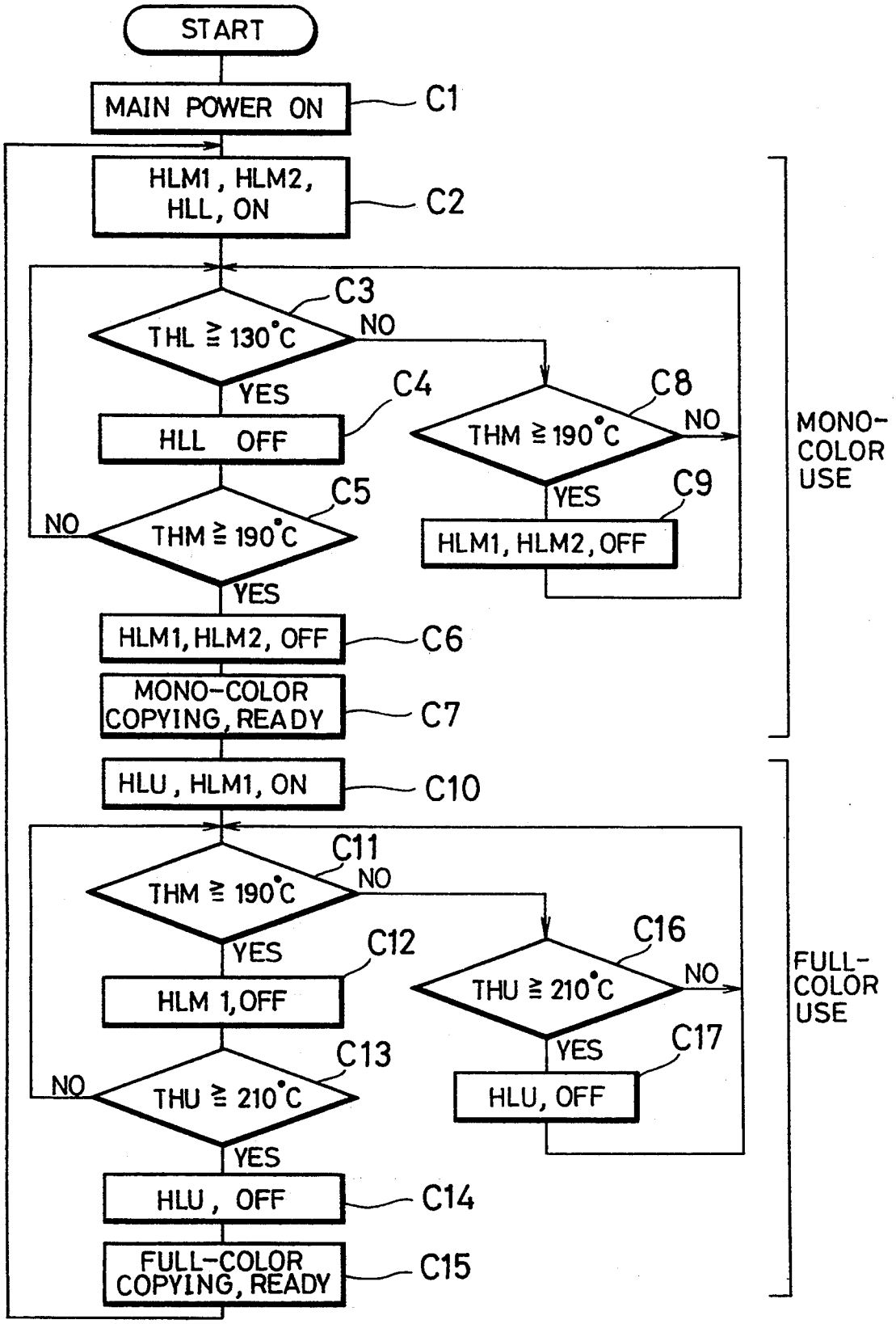
FIGS. 1 through 4 show the first embodiment of the present invention.

In the above arrangement, an explanation will be given of the temperature control of the fixing device 40 during warm-up time, which follows the activation of the main power source of the copying machine, with reference to a flow chart in FIG. 1.

In the case where the order of priority in copying modes with respect to temperature control is preliminarily stored in the control device 52, when the main power source of the copying machine is turned on, either upper fixing section or lower fixing section, which is associated with the copying mode having the higher priority in the order, is selected. On the other hand, in the case where the order of priority is desirably set by the operator or depending on conditions of the device, either upper fixing section or lower fixing section is selected according to data for specifying the order of priority, which is obtained by the use of a selection means such as a copy selection key, not shown (C1).

As a result of the selection, for example, if the mono-color copying operation is selected, temperature adjustments involving the heating process, etc. of the lower fixing section for mono-color copying will be carried out; therefore, the first and second middle heater lamps 44*b*(HLM1) and 44*c*(HLM2) of the middle heat roller 42 and the lower heater lamp 44*d*(HLL) of the lower heat roller 43 are turned on (C2). Next, judgement is made as to whether or not the lower thermistor 45*c*(THL) has a temperature of not less than 130° C. (C3). If the lower thermistor 45*c* has a temperature not less than 130° C. at C3, the lower heater lamp 44*d*(HLL) is turned off (C4). After the process C4, judgement is made as to whether or not the middle thermistor 45*b*(THM) has a temperature of not less than 190° C. (C5). If the middle thermistor 45*b*(THM) has a temperature of not less than 190° C., the first middle heater lamp 44*b*(HLM1) and the second middle heater lamp 44*c*(HLM2) are turned off (C6), thereby indicating that the machine is ready for a mono-color copying operation (C7). If the middle thermistor 45*b* (THM) has a temperature of less than 190° C. at C5, the sequence returns to C3.

If the lower thermistor 45*c*(THL) has a temperature of less than 130° C. at C3, judgement is made as to whether or not the middle thermistor 45*b*(THM) is not less than 190° C. (C8). If the middle thermistor 45*b*(THM) is not less than 190° C., the first and second middle thermistors 44*b*(HLM1) and 44*c*(HLM2) are turned off (C9), and the sequence returns to C3.

Next, the sequence is switched in such a manner that temperature adjustments involving the heating process, etc. of the upper fixing section for full-color copying will be carried out.

Thus, the upper heater lamp 44*a*(HLU) of the upper heat roller 41 and the first middle heater lamp 44*b*(HLM1) of the middle heat roller 42 are turned on (C10). Next, judgement is made as to whether or not the middle thermistor 45*b*(THM) has a temperature of not less than 190° C. (C11). If the middle thermistor 45*b*(THM) has a temperature of not less than 190° C. at C11, the first middle heater lamp 44*b*(HLM1) is turned off (C12). If the middle thermistor 45*b*(THM) has a temperature of less than 190° C. at C11, judgement is made as to whether the upper thermistor 45*a*(THU) has a temperature of not less than 210° C (C16). If the upper thermistor 45*a*(THU) has a temperature of not less than 210° C., the upper heater lamp 44*a*(HLU) is turned off (C14), and the sequence returns to C11.

After the process C12, judgement is made as to whether or not the upper thermistor 45*a*(THU) has a temperature of not less than 210° C. (C13). If the upper thermistor 45*a*(THU) has a temperature of not less than 210° C., the upper heater lamp 44*a*(HLU) is turned off (C14), thereby indicating that the machine is ready for a full-color copying operation (C15). Thereafter, the sequence is re-executed from C2, and the temperature adjustments of the lower fixing section for mono-color copying will be carried out by the control device 52.

As described above, the copying machine in accordance with the present embodiment is provided with the following two functions: the fist function—which is furnished by a temperature adjusting means—for applying temperature adjustments to the upper and lower fixing sections; the second function—which is furnished by an adjustment order controlling means—for controlling the temperature adjusting means in such a manner that temperature adjustments are applied to either the first or second fixing section according to an order of priority, and that after the completion of the temperature adjustments, temperature adjustments with respect to the other fixing section is successively carried out. In other words, the control device 52, which functions as the adjustment order controlling means, switches the objects of adjustment according to the predetermined order of priority, in such a manner that after the completion of temperature adjustment with respect to either upper fixing section or lower fixing section, temperature adjustments with respect to the other fixing section is successively carried out. With this arrangement, even if heating to be applied to the upper and lower fixing sections is restricted due to limited power consumption, temperature adjustments of the fixing sections can be conducted using greater electric power in comparison with the case where temperature adjustments are conducted with respect to both of the fixing sections at the same time. Thus, it is possible to shorten the warm-up time as well as to stabilize the heat insulation during the stand-by state of the copying machine.

Additionally, in the copying machine of the present embodiment, three heat rollers 41, 42 and 43 are respectively provided with heaters; yet, the present invention is not limited to this structure. For example, only the upper and middle heat rollers 41 and 42 may be provided with heaters, and a heater for the heat roller 43 may be omitted.

[EMBODIMENT 2]

Figure 5:
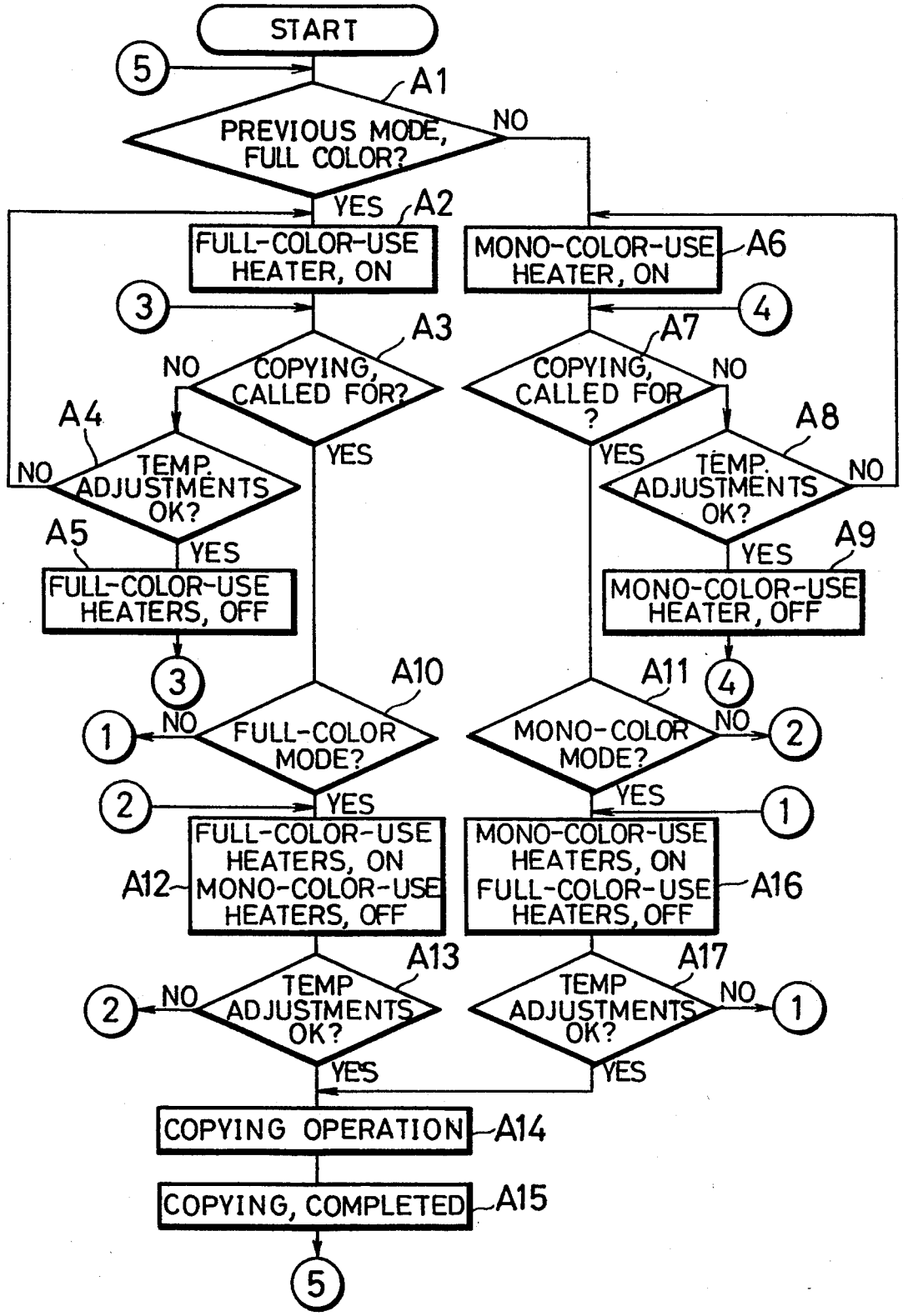
FIG. 5 shows the second embodiment of the present invention.

Referring to FIG. 5, an explanation will be given of a copying machine in accordance with another embodiment of the present invention. Here, for convenience of explanation, those members that have the same functions and that are described in embodiment 1 (with reference to FIGS. 2 through 4) are indicated by the same reference numerals and the description thereof is omitted. Further, the explanation of the present embodiment is given with reference to FIGS. 2 through 4 of embodiment 1.

A full color copying machine in accordance with the present embodiment, is provided with a control device 52 that has the same structure as that of embodiment 1 shown in FIG. 4. When an image forming operation is executed by using either of the fixing sections, i.e., the one that is selected through such devices as a copy selection key, etc., not shown, the control device 52 provides temperature adjustments only to this selected fixing section. Further, the control device 52 functions as the first control means for continuing the temperature adjustments with respect to the selected fixing section during the stand-by state between an image forming operation completed and the next image forming operation to be called for. The other arrangements of the present embodiment are the same as those of embodiment 1; therefore, the explanation thereof is omitted.

Referring to FIG. 5, an explanation will be given of the operation of the copying machine having the above-mentioned arrangement in a full-color copying mode.

As illustrated in FIG. 4, after completion of warm-up of the copying machine, when a full-color copy selection key and a copy start button, both not shown, are depressed, the control device 52 turns on the upper heater lamp 44*a* in the heat roller 41 and the first middle heater lamp 44*b* in the middle heat roller 42, both of which are associated with the upper fixing section of the fixing device 40. Then, the control device 52 keeps the "on-state" of the upper and middle heater lamps 44*a* and 44*b* until the surface temperatures of the upper and middle heat roller 41 and 42 reach respective set temperatures, according to detection signals released from the thermistors 45*a* and 45*b*.

Moreover, the heat-roller driving motor 53 drives the middle heat roller 42 to rotate it counterclockwise, thereby rotating the upper heat roller 41 clockwise. Then, the eccentric cam 51 is driven by the driving mechanism 55 for the oil-coat roller cam, thereby pressing the oil-coat roller 48 onto the upper heat roller 41. Further, as illustrated in FIG. 3, the suction unit 36 is driven by the shifting mechanism, and maintained at the upper station, while the driving force of the belt-driving motor 54 is transmitted to the driving shaft 38, thereby allowing the conveyer belt 37 to move rotatively. Here, the pressing action of the oil-coat roller 48 onto the upper heat roller 41 may be conducted at any proper point of time before a sheet of copy paper is transported to the upper fixing section.

Thereafter, as illustrated in FIG. 2, the surface of the photoreceptor 8, which is rotating in direction B, is uniformly charged by the main charger 9, and the first scanning is executed on an original document placed on the document platen 3 by the exposure-use optical system 4. Through a color separation filter of blue (not shown) and a slit (not shown), the reflected light from the original document is projected onto an exposure point of the surface of the photoreceptor 8, which is located between the main charger 9 and the eraser device for erasing a space between images (not shown), and the photoreceptor 8 is thus exposed and has a latent image formed thereon. Next, an electric potential associated with a non-image area on the photoreceptor 8 is erased by the eraser device, and the latent image is then developed in the yellow developer tank 11, thereby forming a yellow toner image.

Successively, the yellow toner image on the surface of the photoreceptor 8 is transferred onto the transferring belt 17, which rotatively moves in direction C, by the first transferring roller 21 whereto a high, minus voltage has been applied. Here, residual toner on the surface of the photoreceptor 8 is removed by the cleaning device 15, while residual electric potential on the surface of the photoreceptor 8 is erased by the static eliminating device 16.

After the completion of the above-mentioned series of processes, the photoreceptor 8 is again charged by the main charger 9, and the second scanning is executed on the original document by the exposure-use optical system 4. In this case, a color separation filter of green is employed, and a latent image formed on the photoreceptor 8 is developed by magenta toner in the magenta developer tank 12. The magenta toner image thus formed on the surface of the photoreceptor 8 is transferred and superimposed onto the pre-formed yellow toner image on the transferring belt 17 by the first transferring roller 21. Thereafter, in the same manner as described above, the third scanning is executed by the exposure-use optical system 4 by using a color separation filter of red, and a cyan toner image is formed on the photoreceptor 8 through a developing process using cyan toner in the cyan developer tank 13. This cyan toner image is transferred onto the magenta toner image on the transferring belt 17.

Next, the second transferring roller 22, which has been located apart from the transferring belt 17 during the foregoing processes, is pressed against the transferring belt 17, and a three-layered toner image on the transferring belt 17 is transferred onto a sheet of copy paper that is supplied from the feeding cassette 25 or the feeding tray 26 via the resist roller 24. This process is carried out by applying to the second transferring roller 22 a minus voltage that is higher than the electric potential of the surface of the transferring belt 17.

The sheet of copy paper bearing the toner image is transported to the fixing device 40 by the conveyer belt 37 of the suction unit 36 shown in FIG. 3. At this time, since the conveyer belt 37 is maintained at the upper station, the sheet of copy paper is transported to the upper fixing section that is formed at the contact section between the upper heat roller 41 and the middle heat roller 42. At the upper fixing section, the three-layered color toner image on the sheet of copy paper is heated by the upper and the first middle heater lamps 44*a* and 44*b*, which have been heated to predetermined temperatures, and melts down, thereby being fixed on the sheet of copy paper. In this case, silicone oil is supplied to the upper heat roller 41 from the oil-coat roller 48; therefore, it is possible to prevent the offset of the toner image onto the heat roller 41 and to impart gloss to the full-color toner image on the sheet of copy paper. The sheet of copy paper, which has been released from the upper fixing section, is discharged out of the fixing device 40 through the upper transport path 57, and ejected onto the discharge tray 31 by the discharge roller 30.

Next, an explanation will be given of the operation of this copying machine in the mono-color copying mode.

In a state where the above-mentioned full-color copying operation is available, when the copy start button is turned on after turning on the mono-color copy selection key (not shown), the control device 52, shown in FIG. 4, provides control such that the first and second middle heater lamps 44*b* and 44*c* of the middle heat roller 42 and the lower heater lamp 44*d* of the lower heat roller 43 are turned on in the fixing device 40. Thus, the upper and middle heat roller 41 and 42 are controlled to reach respective set temperatures, according to detection signals released from the middle and lower thermistors 45*b* and 45*c*, which respectively detect surface temperatures of the middle and lower heat rollers 42 and 43.

Moreover, the heat-roller driving motor 53 drives the middle heat roller 42 to rotate it clockwise, thereby rotating the lower heat roller 43 counterclockwise. Thus, the oil-coat roller 48 is separated from the upper heat roller 41. Further, the suction unit 36 is driven by the shifting mechanism, and maintained at the lower station, while the driving force of the belt-driving motor 54 is transmitted to the driving shaft 38, thereby allowing the conveyer belt 37 to move rotatively.

After the completion of temperature adjustments associated with the middle and lower heat rollers 42 and 43 as described above, the surface of the photoreceptor 8, shown in FIG. 2, is uniformly charged by the main charger 9, and a scanning is executed on an original document placed on the document platen 3 by the exposure-use optical system 4. Without using the color separation filter and the slit, the reflected light from the original document is directed onto the surface of the photoreceptor 8 by the exposure-use optical system 4, and the photoreceptor 8 is thus exposed and has a latent image formed thereon. Then, the latent image is developed in the black developer tank 10. The black toner image thus formed is transferred onto the transferring belt 17 in the same manner as the full-color copying operation, and then transferred onto a sheet of copy paper that has been supplied through the resist roller 24.

As illustrated in FIG. 3, the sheet of copy paper bearing the toner image is transported by the conveyer belt 37 of the suction unit 36, which is located at the lower station, to the lower fixing section that is formed at the contact section between the middle heat roller 42 and the lower heat roller 43. The toner image as well as the sheet of copy paper is heated by the middle and lower heat roller 42 and 43 that have been heated to predetermined temperatures by the heater lamps 44*b*, 44*c* and 44*d*, and the toner image is thus fixed onto the sheet of copy paper.

Here, in the case of a one-sided copying operation, the switching gate 29 is actuated so that the sheet of copy paper is carried toward the discharge roller 30; therefore, the sheet of copy paper, which has been discharged from the fixing device 40 through the lower transport path 58, is ejected onto the discharge tray 31 by the discharge roller 30.

On the contrary, in the case of a two-sided copying operation, the switching gate 29 is actuated so that the sheet of copy paper is carried toward the transport path 32; therefore, the sheet of copy paper, which has been discharged from the lower fixing section, is ejected onto the intermediate tray 33 through the transport path 32. Thereafter, the sheet of copy paper placed on the intermediate tray 33 is sent to the transport path 35 by the feeding roller 34, and reversed while travelling along the transport path 35 to reach the resist roller 24.

Successively, the surface of the photoreceptor 8, shown in FIG. 2, is again charged by the main charger 9, and a scanning is executed on the original document, which is now placed with the back side up, by the exposure-use optical system 4. Thereafter, with the same processes as those carried out on the front side of the sheet of copy paper, a toner image is transferred and fixed onto the back side of the sheet of copy paper in the lower fixing section. The sheet of copy paper is then directed to the discharge roller 30 by the switching gate 29, and ejected onto the discharge tray 31 by the discharge roller 30 by the discharge roller 30.

After a copying operation in the full-color mode or in the mono-color mode has been carried out as described above, the copying machine enters the stand-by state until the next copying operation is demanded; thus, according to a control method shown in a flow chart in FIG. 5, temperature adjustments are conducted with respect to the heat rollers that constitute the fixing section associated with the copying mode used in the preceding operation.

First, the control device 52 judges whether the preceding operation was carried out in the full-color copying mode or in the mono-color copying mode at A1: If the judgement is the "full-color copying mode", the color-use heater lamps, that is, the upper heater lamp 44*a* in the upper heat roller 41 and the first middle heater lamp 44*b* in the middle heat roller 42, are turned on (A2). Next, judgement is made as to whether or not the next copying operation is demanded at A3: If the next copying operation is not demanded, judgement is made as to whether or not the temperature adjustments on the color-use heaters have been completed (OK) based on detection signals released from the upper and middle thermistors 45*a* and 45*b* (A4). If the judgement shows the temperature adjustments are "OK", the color-use heaters are turned off (A5). If the judgement shows the temperature adjustments are not "OK", the process A2 is again executed, and the color-use heaters are continuously kept on.

On the contrary, if the judgement shows "mono-color copying mode" at A1, the mono-color-use heater lamps, that is, the first and second middle heater lamps 44b and 44c in the middle heat roller 42 and the lower heater lamp 44d in the lower heat roller 43, are turned on (A6). Then, judgement is made as to whether or not temperature adjustments are properly operated based on the detection signals from the middle and lower thermistors 45b and 45c until it is judged at A7 that the next copying operation is demanded. Here, if the temperature adjustments are "OK" (A8), the mono-color-use heater lamps are turned off (A9). If the temperature adjustments are not "OK", the process A6 is again executed and the mono-color-use heater lamps are turned on.

If it is judged at A3 that the next copying operation is demanded, a process A10 is executed, thereby judging whether or not the demanded copying mode is "full-color copying mode" (A10). Further, if it is judged at A7 that the next copying operation is demanded, a process All is executed, thereby judging whether or not the demanded copying mode is "mono-color copying mode" (All). Here, in the case where the demanded copying mode is "full-color copying mode", that is, the judgement is "YES" at A10 or as "NO" at All, the color-use heaters are turned on, and kept on until the temperature adjustments become "OK" at A13, while the mono-color-use heaters are kept off (A12). Here, if the temperature adjustments are "OK" (A13), a predetermined copying operation in the full-color copying mode is carried out (A14), and when the copying operation is completed (A15), the copying machine enters the stand-by state and the sequence returns to A1.

In the case where the demanded copying mode is "mono-color copying mode", that is, the judgement is "NO" at A10 or as "YES" at A11, the mono-color-use heaters are turned on, and kept on until the temperature adjustments become "OK" at A17, while the full-color-use heaters are kept off (A16). Here, if the temperature adjustments are "OK" (A17), a predetermined copying operation in the mono-color copying mode is carried out (A14), and when the copying operation is completed (A15), the sequence returns to A1, as in the full-color copying mode.

As described above, the copying machine in accordance with the present embodiment is provided with the following two functions: the fist function—which is furnished by a temperature adjusting means—for applying temperature adjustments to the upper and lower fixing sections; and the second function—which is furnished by the first control means—for controlling the temperature adjusting means in such a manner that after completion of an image forming operation by the use of either the first or second fixing section, the temperature adjusting means continues to conduct temperature adjustments on the same fixing section during the stand-by state until the next image forming operation is called for. In other words, in the copying machine of the present embodiment, after completion of a copying operation in a predetermined mode, the temperature adjustments that have been applied to the fixing section used in the preceding copying operation are continued until the next copying mode is specified during the stand-by state of the copying machine, without switching the fixing sections to be temperature-adjusted.

With this arrangement, a fixing section that is frequently used can be specified, and the specified fixing section is preferentially subjected to the temperature adjustments. Therefore, in comparison with the arrangement wherein the order of priority is fixed as to which fixing section is subjected to temperature adjustments during the stand-by state, a period of time required for the temperature adjustments before the start of a copying operation can be shortened. This shortening of time on the temperature adjustments makes it possible to readily start copying operations in the mode that is frequently used, thereby improving the response of the copying machine.

Additionally, in the present embodiment, the temperature adjustments are conducted with respect to only either of the fixing sections during the stand-by state; yet, the present invention is not limited to this arrangement. As will be described in the following embodiment 3, after completion of the temperature adjustments on the one of the fixing sections, temperature adjustments may be applied to the other fixing section if there is no further demand for using the one of the fixing sections.

[EMBODIMENT 3]

Figure 6:
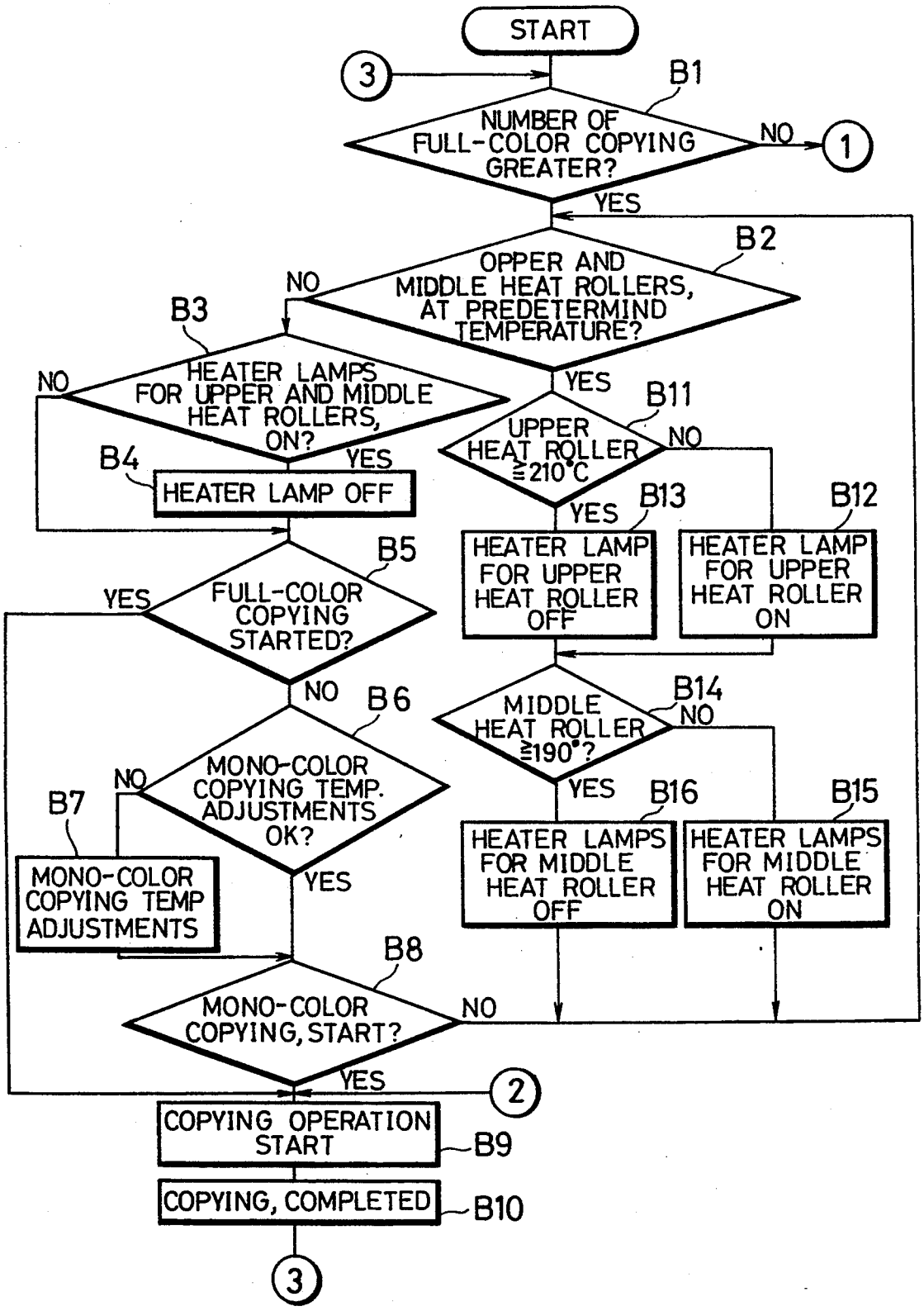
FIGS. 6 and 7 show the third embodiment of the present invention.
Figure 7:
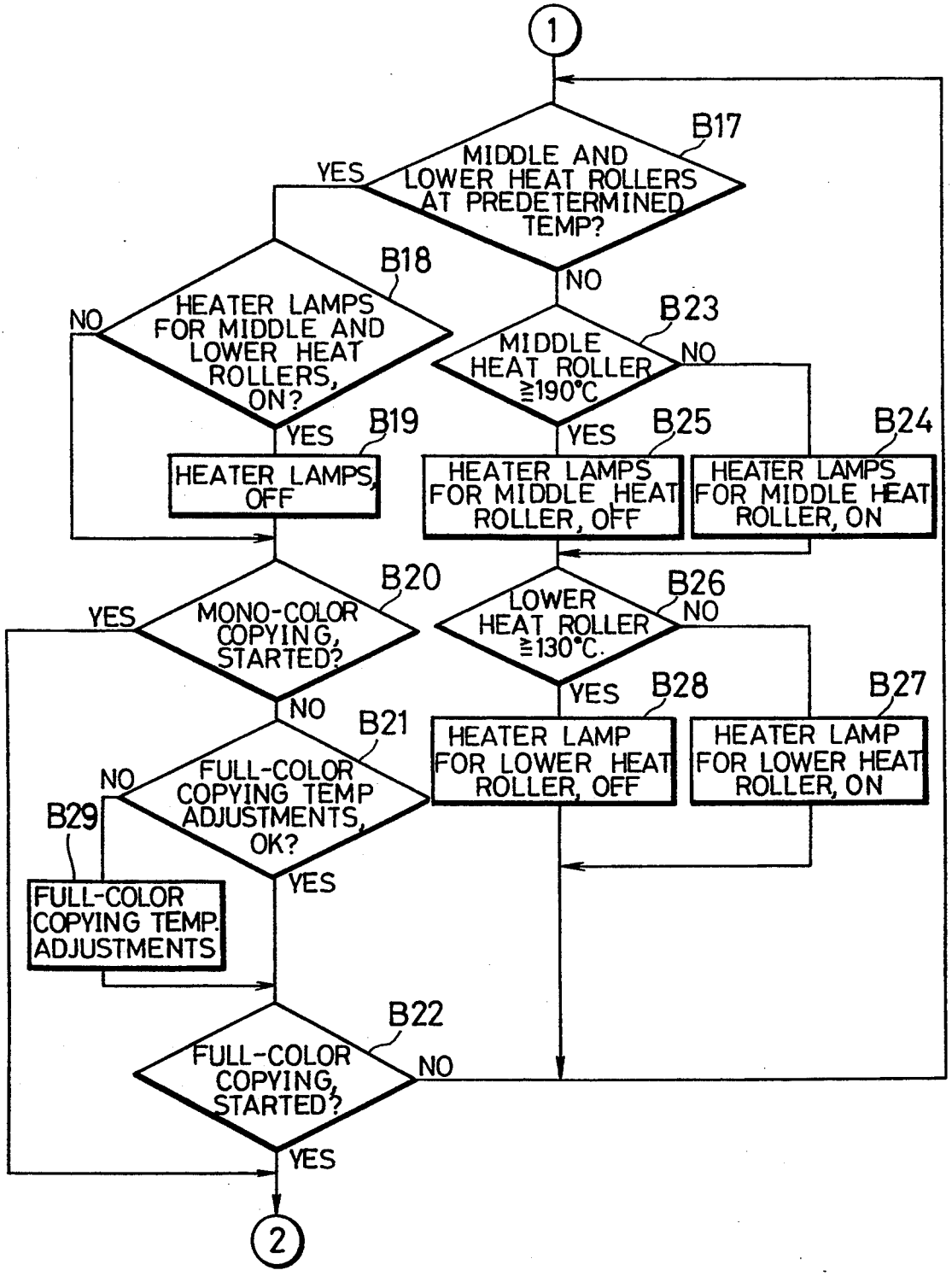

Referring to FIG. 6 and 7, the following description will discuss another embodiment of the present invention. Here, for convenience of explanation, those members that have the same functions and that have been described in embodiment 1 (with reference to FIGS. 2 through 4) are indicated by the same reference numerals and the description thereof is omitted. Further, the explanation of the present embodiment is given with reference to FIGS. 2 through 4 of embodiment 1.

A copying machine in accordance with the present embodiment is provided with a control device 52. When an image forming operation is executed by using either of the fixing sections, i.e., the one that is selected through such devices as a copy selection key, etc., not shown, the control device 52 provides temperature adjustments only to this selected fixing section. The control device 52 cumulatively calculates the number of copying operations, which are classified by the mono-color copying mode and the full-color copying mode, and stores the results of the calculation. Further, the control device 52 functions as the second control means, which features the following operation: During the stand-by state after completion of a copying operation in the full-color copying mode or in the mono-color copying mode, the control device 52 provides temperature adjustments with respect to heat rollers associated with either fixing section that has been used more times than the other fixing section by taking account of the number of copying operations that have been executed up to the preceding operation. The control on the temperature adjustments is explained in flow charts of FIGS. 6 and 7. The other arrangements of the present embodiment are the same as those of embodiment 1; therefore, the explanation thereof is omitted.

After completion of the warm-up of the copying machine, a copying operation is started by depressing a copy selection key and a copy start button, not shown. As illustrated in FIG. 6, when the copying operation is completed, the control device 52 judges whether the number of copying operations using the full-color copying mode is greater than that of copying operations using the mono-color copying mode in the total number of copying operations that have been executed up to the preceding operation (B1). Here, if it is judged that the number of copying operations using the full-color copying mode is greater, temperature adjustments are conducted with respect to the upper fixing section for use in the full-color copying mode, while if it is judged that the number of copying operations using the mono-color copying mode is greater, temperature adjustments are conducted with respect to the lower fixing section for use in the mono-color copying mode.

If the number of copying operations using the full-color copying mode is greater, judgement is made as to whether or not the temperatures of the upper heat roller 41 and the middle heat roller 42 have reached predetermined temperatures (B2). At this time, if the upper and middle thermistors 45*a* and 45*b* respectively detect that the upper and middle heat rollers 41 and 42 have reached the predetermined temperatures, it is judged that the copying machine is ready for the next copying operation without requiring the heating process of the upper fixing section. Then, in order to prevent further temperature rises of the heat rollers associated with the upper fixing section, judgement is made as to whether or not the upper and the first middle heater lamps 44*a* and 44*b* of the respective upper and middle heat rollers 41 and 42 are "ON" (B3).

If the upper and the first middle heater lamps 44*a* and 44*b* are "ON", the upper and the first middle heater lamps 44*a* and 44*b* are turned "OFF" (B4) so as to prevent a further temperature rise of the fixing section beyond a predetermined temperature. Further, if the upper and the first middle heater lamps 44*a* and 44*b* are not "ON" at B3, it is judged that the fixing section is at the predetermined temperature, and ready for the next copying operation in the full-color copying mode; therefore, judgement is then made as to whether or not the next copying operation in the full-color copying mode is started (B5). If the full-color copying operation is started, the predetermined copying operation is executed using the full-color copying mode (B9), and after the completion of the copying operation (B10), the sequence returns to B1 again.

Moreover, if the next copying operation in the full-color copying mode is not started at B5, it is judged that the next copying operation will be carried out using the mono-color copying mode; thus, judgement is made as to whether or not temperature adjustments are "OK" with respect to the lower fixing section (B6). Here, if it is judged that the temperature adjustments are not "OK", the temperature adjustments are conducted on the mono-color copying mode (B7). If the temperature adjustments are "OK", it is judged that the lower fixing section associated with the mono-color copying mode is at a predetermined temperature; therefore, judgement is then made as to whether or not the next copying operation in the mono-color copying mode is started (B8). At this time, if the next copying operation in the mono-color copying mode is not started, the sequence returns to B2 again so as to judge whether or not the temperature adjustments are conducted with respect to the fixing section associated with the full-color copying mode. If the next copying operation in the mono-color copying mode is started at B8, the predetermined copying operation is executed using the mono-color copying mode (B9), and after the completion of the copying operation (B10), the sequence returns to B1 again.

On the other hand, if it is Judged at B2 that the upper and middle heat rollers 41 and 42 have not reached the predetermined temperatures, temperature adjustments are conducted until those heat rollers have reached the predetermined temperatures respectively. More specifically, first, the upper thermistor 45*a* judges whether or not the upper heat roller 41 has a temperature of not less than 210° C. (B11). Here, if it is judged that the temperature is less than 210° C. according to a detection signal from the upper thermistor 45*a*, the upper heater lamp 44*a* is turned on (B12). If it is judged that the temperature is not less than 210° C. according to a detection signal from the upper thermistor 45*a*, the upper heater lamp 44*a* is turned off (B13).

Next, judgement is made as to whether the middle heat roller 42 has a temperature of not less than 190° C. (B14). Here, if it is judged that the temperature of the middle heat roller 42 is less than 190° C. according to a detection signal from the middle thermistor 45*b*, the first middle heater lamp 44*b* is turned on (B15). If it is judged that the temperature of the middle heat roller 42 is not less than 190° C. according to a detection signal from the middle thermistor 45*b*, the first middle heater lamp 44*b* is turned off (B16). Then, the sequence returns to B2 again so as to judge whether or not the upper and the middle heat rollers 41 and 42 have reached the predetermined temperatures.

Next, if it is judged at B1 that the number of copying operations using the mono-color copying mode is greater, temperature adjustments are conducted with respect to the lower fixing section as illustrated in FIG. 7. Here, judgement is made as to whether or not the temperatures of the middle heat roller 42 and the lower heat roller 43 have reached predetermined temperatures (B17). At this time, if the middle and lower thermistors 45*b* and 45*c* respectively detect that the middle and lower heat rollers 42 and 43 have reached the predetermined temperatures, it is judged that the copying machine is ready for the next copying operation without requiring the heating process of the fixing section. Then, in order to prevent further temperature rises of the heat rollers associated with the lower fixing section, judgement is made as to whether or not the first and second middle heater lamps 44*b* and 44*c* as well as the lower heater lamp 44*d* of the respective middle and lower heat rollers 42 and 43 are "ON" (B18). Here, if the first and second middle heater lamps 44*b* and 44*c* as well as the lower heater lamp 44*d* are "ON", the first and second middle heater lamps 44*b* and 44*c* as well as the lower heater lamp 44*d* are turned "OFF" (B19) so as to prevent a further temperature rise of the fixing section beyond a predetermined temperature.

Further, if the first and second middle heater lamps 44*b* and 44*c* as well as the lower heater lamp 44*d* are not "ON" at B18, it is judged that the fixing section is at the predetermined temperature; therefore, judgement is then made as to whether or not the next copying operation in the mono-color copying mode is started (B20). If the mono-color copying operation is started, the predetermined copying operation is executed using the mono-color copying mode (B9), and after the completion of the copying operation (B10), the sequence returns to B1 again.

Moreover, if the next copying operation in the mono-color copying mode is not started at B20, it is judged that the next copying operation will be carried out using the full-color copying mode; thus, judgement is made as to whether or not temperature adjustments are "OK" with respect to the upper fixing section (B21). Here, if it is judged that the temperature adjustments are not "OK", the temperature adjustments are conducted on the fixing section associated with the mono-color copying mode (B29). If the temperature adjustments are "OK", it is judged that the upper fixing section associated with the full-color copying mode is at a predetermined temperature; therefore, judgement is then made as to whether or not the next copying operation in the full-color copying mode is started (B22). At this time, if the next copying operation in the full-color copying mode is not started, the sequence returns to B17 again so as to judge whether or not the temperature adjustments are conducted with respect to the lower fixing section. If the next copying operation in the full-color copying mode is started at B22, the predetermined copying operation is executed using the full-color copying mode (B9), and after the completion of the copying operation (B10), the sequence returns to B1 again.

On the other hand, if the middle and lower heat rollers 42 and 43 have not reached the predetermined temperatures at B17, temperature adjustments are conducted until those heat rollers have reached the predetermined temperatures respectively. More specifically, first, the middle thermistor **45*b* judges whether or not the middle heat roller 42 has a temperature of not less than 190° C. (B23). Here, if it is judged that the temperature is less than 190° C. according to a detection signal from the middle thermistor 45*b*, the first and second middle heater lamps 44*b* and 44*c* are turned "ON" (B24). If it is judged that the temperature of the middle heat roller 42 is not less than 190° C. according to the detection signal from the middle thermistor 45*b*, the first and second middle heater lamps 44*b* and 44*c*** are turned "OFF" (B25).

Next, judgement is made as to whether the lower heat roller 43 has a temperature of not less than 130° C. (B26). Here, if it is judged that the temperature of the lower heat roller 43 is less than 130° C. according to a detection signal from the lower thermistor **45*c*, the lower heater lamp 44*d* is turned on (B27). If it is judged that the temperature of the lower heat roller 43 is not less than 130° C. according to the detection signal from the lower thermistor 45*c*, the lower heater lamp 44*d* is turned off (B28). Then, the sequence returns to B2 again so as to judge whether or not the middle and lower heat rollers 42 and 43** have reached the predetermined temperatures.

As described above, the copying machine of the present embodiment is provided with two functions: a function for applying temperature adjustments to the upper fixing section and to the lower fixing section (temperature-adjusting means); and the other function for controlling the temperature-adjusting means in such a manner that, after completion of a copying operation using either of the upper and lower fixing sections, during the stand-by state before having a demand for the next copying operation, the temperature-adjusting means preferentially provides temperature adjustments with respect to one of the fixing sections that has been used more times than the other fixing section in the number of copying operations that have been executed up to the preceding operation (second control means). More specifically, the copying machine of the present embodiment is arranged such that: after completion of a copying operation using one of the copying modes, the number of copying operations that have been executed is counted; comparison is made between the number of copying operations that have been executed using the mono-color copying mode and the number of those using the full-color copying mode; the copying mode having used more times than the other is determined as one to be used for the next copying operation; and temperature adjustments are applied to the fixing section associated with the copying mode.

With this arrangement, temperature adjustments are preferentially conducted with respect to either of the fixing sections associated with the copying mode that has been used more frequently; therefore, in comparison with the arrangement wherein setting is preliminarily made as to which fixing section is subjected to the next temperature adjustments, during the stand-by state of the next copying operation, a period of time required for the temperature adjustments before the start of a copying operation can be shortened. This shortening of time on the temperature adjustments makes it possible to improve the response of the copying machine and readily start copying operations, thereby improving the efficiency of copying operations. Further, since the fixing section readily reaches a predetermined temperature, misoperation of copying caused by improper fixation of toner or other reasons can be prevented.

Additionally, in the present embodiment, after completion of the temperature adjustments on one of the fixing sections, temperature adjustments are applied to the other fixing section if there is no further demand for using the one of the fixing sections; yet, the present invention is not limited to this arrangement. As described in embodiment 2, the temperature adjustments may be conducted with respect to only either of the fixing sections during stand-by state.

[EMBODIMENT 4]

Figure 8:
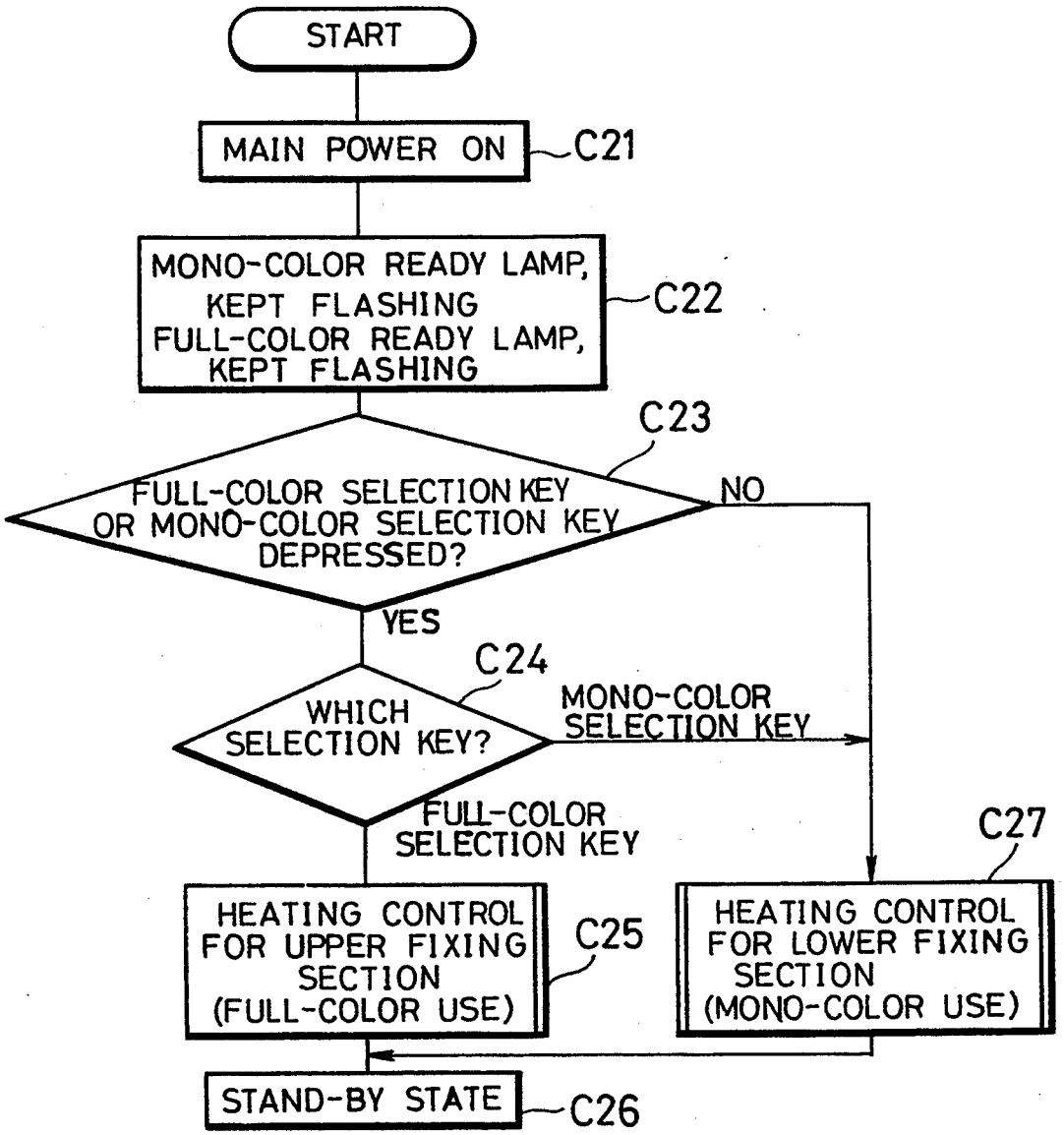
FIGS. 8 through 10 show the fourth embodiment of the present invention.
Figure 10:
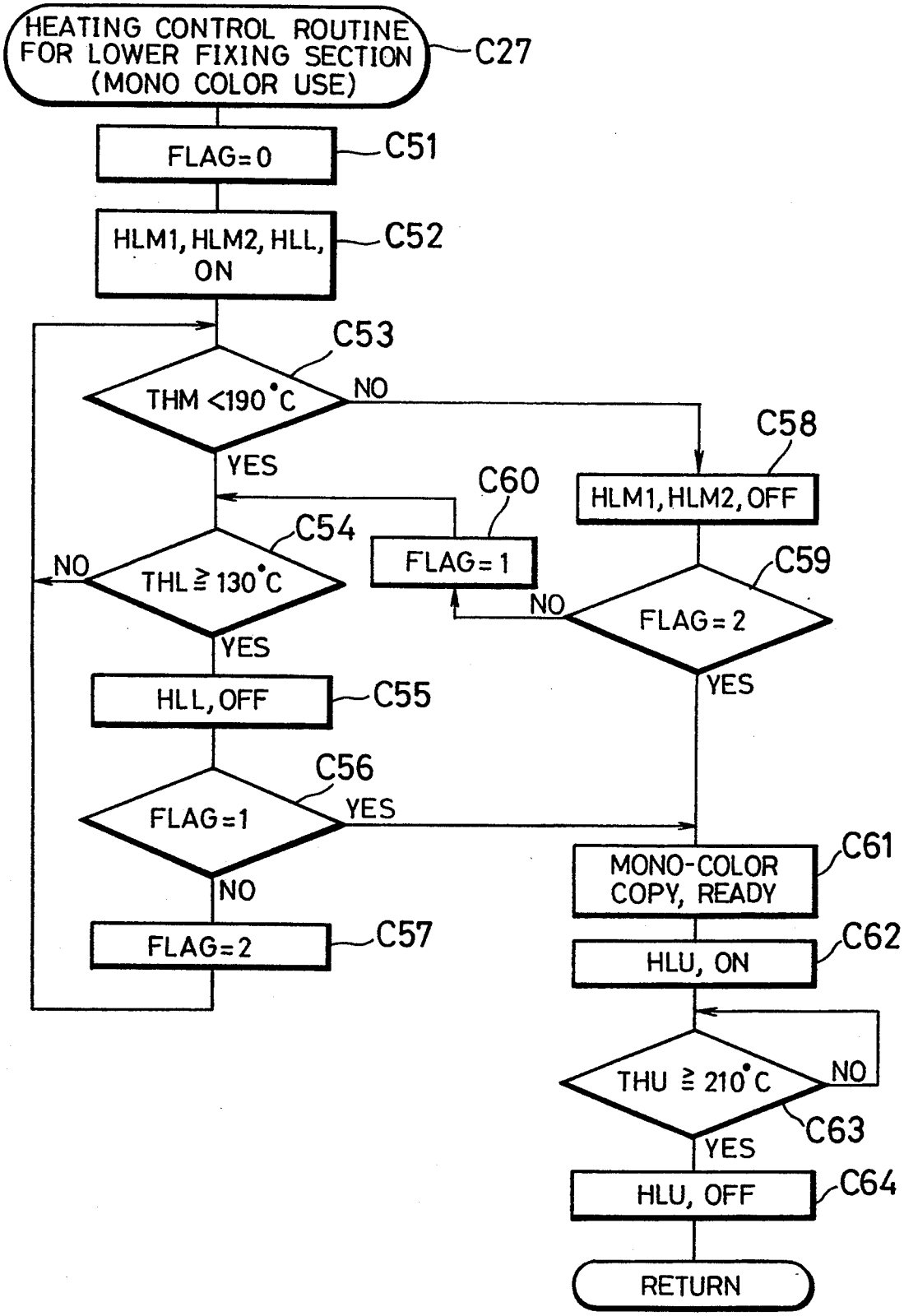

Referring to FIG. 8 and 10, the following description will discuss another embodiment of the present invention. Here, for convenience of explanation, those members that have the same functions and that have been described in embodiment 1 (with reference to FIGS. 2 through 4) are indicated by the same reference numerals and the description thereof is omitted. Further, the explanation of the present embodiment is given with reference to FIGS. 2 through 4 of embodiment 1.

A copying machine in accordance with the present embodiment is provided with a control device 52. The control device 52 has a function as the fist precedence-setting means for setting the order of priority with respect to temperature adjustments of fixing sections. The function is explained as follows: During warm-up time of the copying machine, which follows the activation of the main power source of the copying machine, when a copying operation is executed by using either of the fixing sections, i.e., the one that has been selected through a full-color-copy selection key (selection means) or a mono-color-copy selection key (selection means), temperature adjustments are preferentially applied to this selected fixing section.

Figure 9:
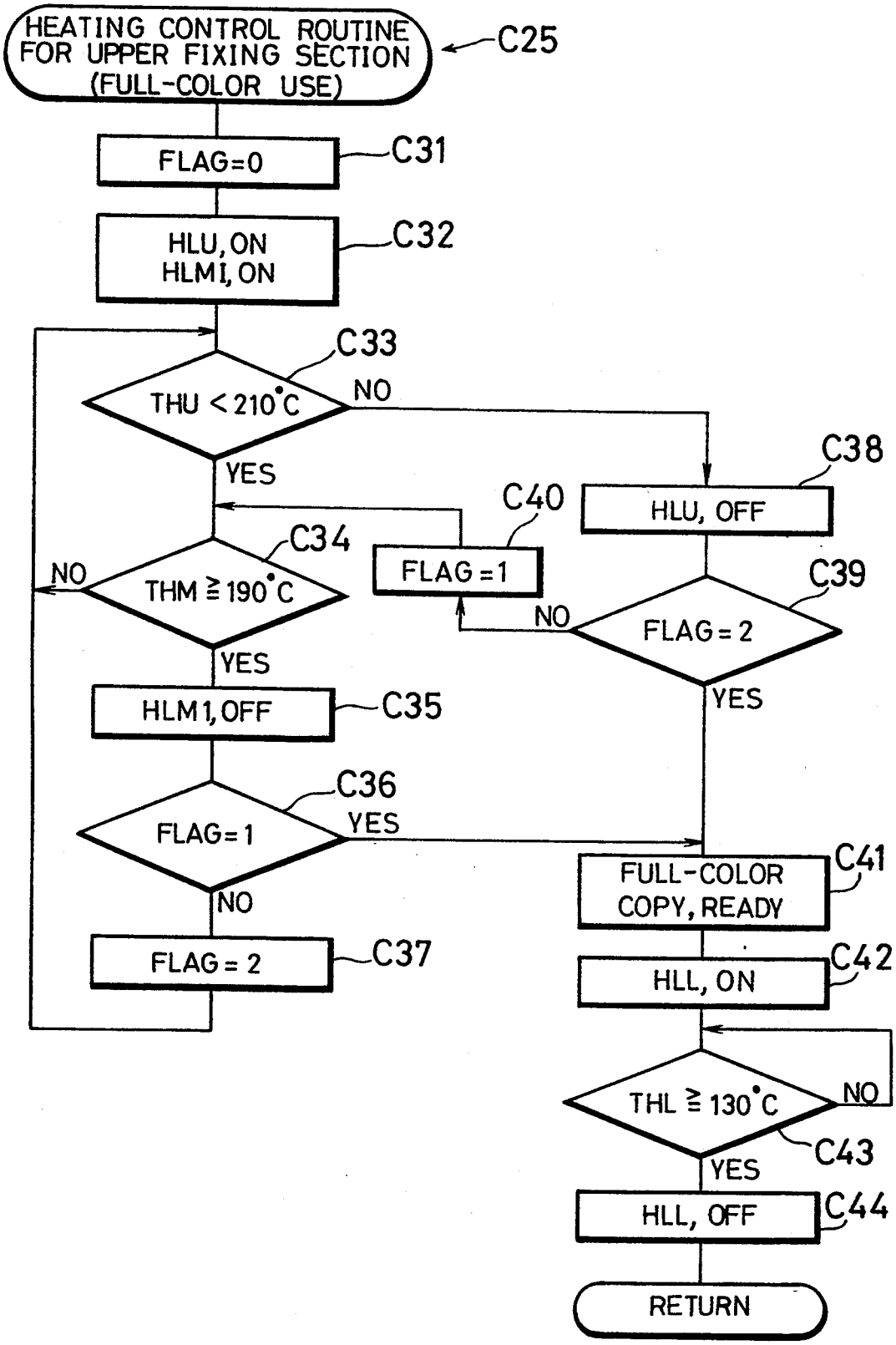

Referring to flow charts of FIGS. 8 through 10, the following description will discuss a temperature control which is applied to the fixing section immediately after the main power source of the copying machine is turned on.

As illustrated in FIG. 8, first the main power source of the copying machine is turned on (C21), and a mono-color-use ready lamp (not shown) and a full-color-use ready lamp (not shown) both start flashing (C22). Next, judgement is made as to which is depressed, the mono-color-copy selection key or the full-color-copy selection key (C23), and if either of the selection keys is depressed, judgement is made as to which selection key is depressed (C24). If the full-color-copy selection key is depressed at C24, a routine for controlling the heating operation of the upper fixing section, which will be described later, is executed (C25), and after the completion of the process C25, the copying machine enters the stand-by state (C26). Here, if neither of the selection keys is depressed at C23, or if the mono-color-copy selection key is depressed at C24, a routine for controlling the heating operation of the lower fixing section, which will be described later, is executed (C27), and after the completion of the process C27, the copying machine enters the stand-by state (C26).

Here, an explanation will be given of the routine for controlling the heating operation in the case where the upper fixing section is heated prior to the lower fixing section.

As illustrated in FIG. 9, first, after setting "flag=0" (C31), the upper heater lamp 44*a*(HLU) of the upper heat roller 41 and the first middle heater lamp 44*b*(HLM1) of the middle heat roller 42 are turned on (C32). Next, judgement is made as to whether or not the upper thermistor 45*a*(THU) has a temperature of less than 210° C. (C33). If the upper thermistor 45*a* (THU) has a temperature of less than 210° C. judgement is made as to whether or not the middle thermistor 45*b*(THM) has a temperature of not less than 190° C. (C34). If the middle thermistor 45*b*(THM) has a temperature of not less than 190° C. the first middle heater lamp 44*b* is turned off (C35). On the contrary, if the middle thermistor 45*b*(THM) has a temperature of less than 190° C. at C34, the sequence returns to C33. After executing C35, judgement is made as to whether or not "flag=1" (C36), and if "flag=1" is not satisfied, it is replaced with "flag=2" (C37), thereby returning to C33. Here, if "flag=1" is satisfied at C36, the full-color-use ready lamp (not shown) is turned on, thereby indicating that the machine is ready for a full-color copying operation (C41).

If the temperature of the upper thermistor 45*a* is not less than 210° C. at C33, the upper heater lamp 44*a* is turned off (C38), and judgement is made as to whether or not "flag=2" (C39). If "flag=2" is satisfied at C39, it indicates that the machine is ready for a full-color copying operation (C41). Here, if "flag=2" is not satisfied at C39, it is replaced with "flag=1" (C40), and the sequence returns to C34.

Following the process C41, a heating operation is executed with respect to the lower fixing section for mono-color copying. That is, the lower heater lamp 44*d*(HLL) of the lower heat roller 43 is turned on (C42). Next, judgement is made as to whether or not the lower thermistor 45*c*(THL) has a temperature of not less than 130° C. (C43). If the temperature of the lower thermistor 45*c*(THL) is not less than 130° C., the lower heater lamp 44*d* is turned off (C44), thereby returning to the main routine. Additionally, it is possible to carry out full-color copying operations while heating the lower fixing section.

Here, an explanation will be given of the routine for controlling the heating operation in the case where the lower fixing section is heated prior to the upper fixing section.

As illustrated in FIG. 10, first, after setting: "flag=0" (C51), the first middle heater lamp 44*b*(HLM1) and the second middle heater lamp 44*c*(HLM2) of the middle heat roller 42 as well as the lower heater lamp 44*d*(HLL) of the lower heat roller 43 are turned on (C52). Next, judgement is made as to whether or not the middle thermistor 45*b*(THM) has a temperature of less than 190° C. (C53). If the temperature of the middle thermistor 45*b*(THM) is less than 190° C., judgement is made as to whether or not the lower thermistor 45*c*(THL) has a temperature of not less than 130° C. (C54). If the temperature of the lower thermistor 45*c*(THL) is not less than 130° C. at C54, the lower heater lamp 44*d* is turned off (C55). On the contrary, if the temperature of the lower thermistor 45*c*(THL) is less than 130° C. at C54, the sequence returns to C53. After executing C55, judgement is made as to whether or not "flag=1" (C56), and if "flag=1" is not satisfied, it is replaced with "flag=2" (C57), thereby returning to C53. Here, if "flag=1" is satisfied at C56, the mono-color-use ready lamp (not shown) is turned on, thereby indicating that the machine is ready for a mono-color copying operation (C61).

If the temperature of the middle thermistor 45*b*(THM) is not less than 190° C. at C53, the first middle heater lamp 44*b*(HLM1) and the second middle heater lamp 44*c*(HLM2) are turned off (C58), and judgement is made as to whether or not "flag=2" (C59). If "flag=2" is satisfied at C59, it indicates that the machine is ready for a mono-color copying operation (C61). Here, if "flag=2" is not satisfied at C59, it is replaced with "flag=1" (C60), and the sequence returns to C54.

After the process C61, a heating operation is executed with respect to the lower fixing section for full-color copying. That is, the upper heater lamp 44*a*(HLU) of the upper heat roller 41 is turned on (C62). Next, judgement is made as to whether or not the upper thermistor 45*a*(THU) has a temperature of not less than 210° C. (C63). If the temperature of the upper thermistor 45*a*(THU) is not less than 210° C., the upper heater lamp 44*a* is turned off (C64), thereby returning to the main routine. Additionally, it is possible to carry out mono-color copying operations while heating the upper fixing section.

As described above, the copying machine in accordance with the present embodiment is provided with the following four functions: the fist function—which is furnished by the temperature adjusting means—for applying temperature adjustments to the upper and lower fixing sections; the second function—which is furnished by the adjustment order controlling means—for controlling the temperature adjusting means in such a manner that temperature adjustments are applied to either the first or second fixing section according to an order of priority, and that after the completion of the temperature adjustments, temperature adjustments with respect to the other fixing section is successively carried out; the third function—which is furnished by the selection means—for selecting either of the upper and lower fixing sections; and the fourth function—which is furnished by the first precedence-setting means—for setting the order of priority in the adjustment order controlling means in such a manner that, during warm-up time of the copying machine, temperature adjustments are preferentially applied to the fixing section that has been selected through the selection means. That is, the copying machine in accordance with the present embodiment is provided with the control device 52 which has a function as the fist precedence-setting means in such a manner that during warm-up time of the copying machine, which follows the activation of the main power source of the copying machine main body 1, temperature adjustments are preferentially applied to the selected fixing section.

With this arrangement, in comparison with the case where temperature adjustments are conducted with respect to both of the fixing sections at the same time, temperature adjustments of the fixing sections can be made using greater electric power. Further, since temperature adjustments are preferentially applied to the selected fixing section, it is possible to shorten the waiting time, that is, the warm-up time after activating the copying machine.

[EMBODIMENT 5]

Figure 11:
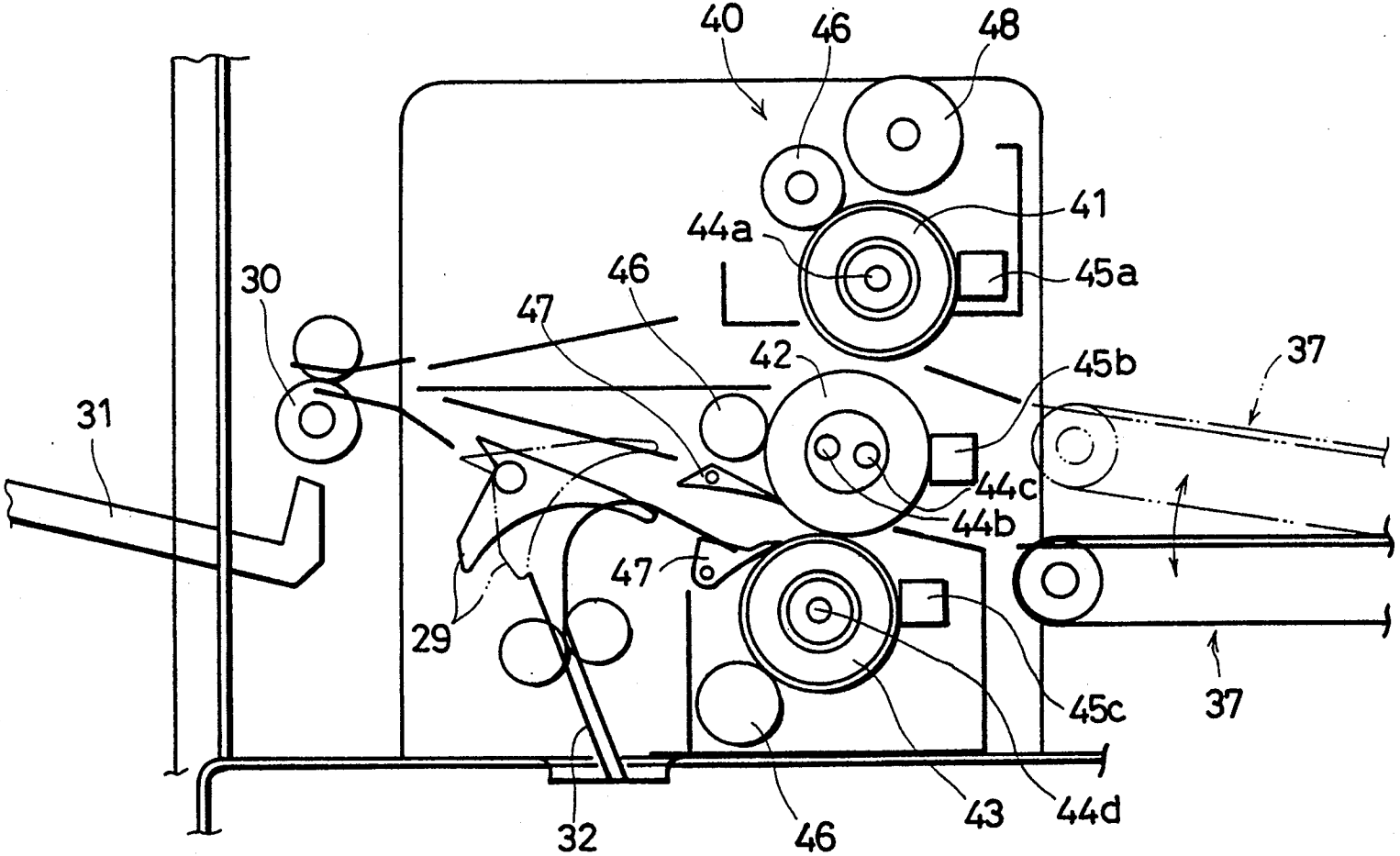
FIGS. 11 through 13 show the fifth embodiment of the present invention.
Figure 12:
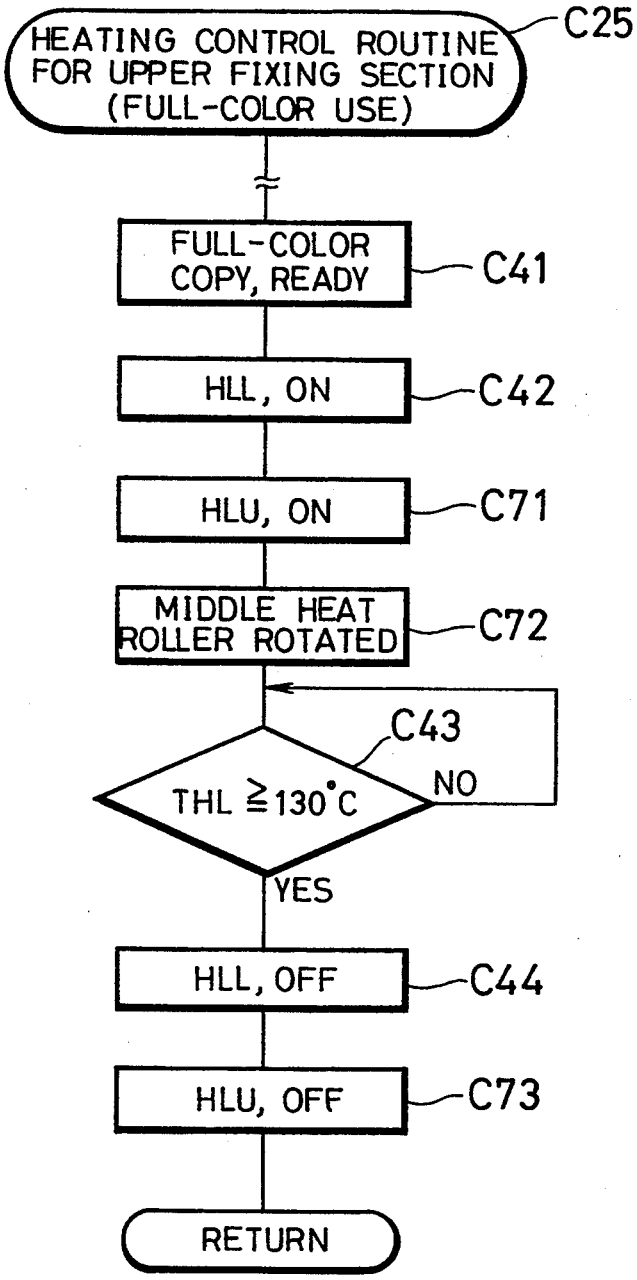
Figure 13:
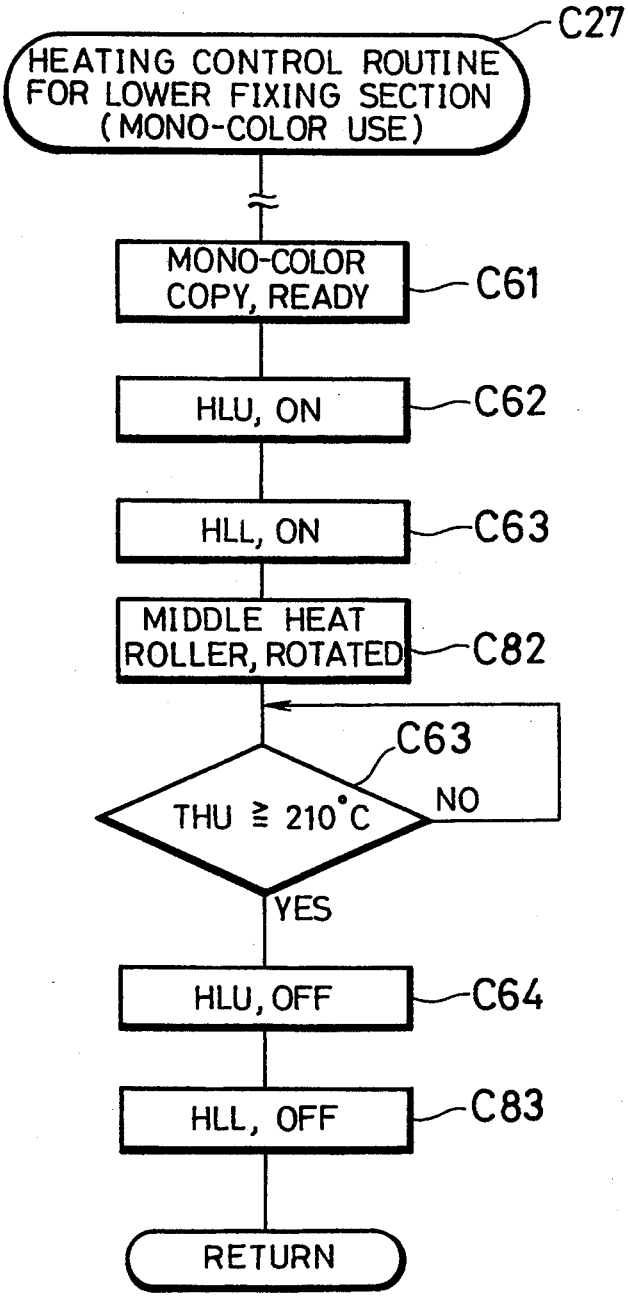

Referring to FIG. 11 through 13, the following description will discuss another embodiment of the present invention. Here, for convenience of explanation, those members that have the same functions and that have been described in embodiment 1 (with reference to FIGS. 2 through 4) are indicated by the same reference numerals and the description thereof is omitted. Further, the explanation of the present embodiment is given with reference to FIGS. 2 through 4 of embodiment 1.

As illustrated in FIG. 11, a fixing device 40, which is installed in a copying machine in accordance with the present embodiment, is provided with a mechanism (fixing-section forming means) by which the contact between the upper and middle heat rollers 41 and 42 or the contact between the middle and lower heat rollers 42 and 43 is made and released on demand. Here, the respective pairs of rollers form the upper and lower fixing sections. More specifically, this mechanism as the fixing-section forming means is capable of making the middle heat roller 42 and the lower heat roller 43 contact each other while making the upper heat roller 41 and the middle heat roller 42 separate from each other when the lower fixing section is heated. On the other hand, when the upper fixing section is heated, the mechanism makes the middle heat roller 42 and the lower heat roller 43 separate from each other while making the upper heat roller 41 and the middle heat roller 42 contact each other.

The above-mentioned mechanism (fixing-section forming means) will be described in embodiment 9 and embodiment 11 in detail.

Moreover, a control device 52 also functions as a fixing-roller controlling means which controls the fixing-section forming means so that upon applying temperature adjustments to the other fixing section successively after completion of temperature adjustments applied to either of the upper and lower fixing sections, the upper and middle heat rollers 41 and 42 or the middle and lower heat rollers 42 and 43, either pair of which are associated with the fixing section that has been subjected to the temperature adjustments, are rotated while maintaining the contact between the pair of the rollers. The other arrangements of the present embodiment are the same as those of embodiment 1; therefore, the explanation thereof is omitted.

In the above arrangement, the controlling operation of the fixing-roller controlling means will be discussed hereinbelow with reference to flow charts in FIGS. 12 and 13. For example, when the full-color copying mode is selected by depressing a copy selection key and a copy start button (not shown), the middle heat roller 42 and the lower heat roller 43 are separated, while the upper heat roller 41 and the middle heat roller 42 are made to contact each other and rotated. Then, the routine for controlling the heating operation of the upper fixing section (for use in the full-color mode) is executed as described in FIG. 9 in embodiment 4. Successively, as illustrated in FIG. 12, when the copying machine becomes ready for a full-color copying operation, the lower heater lamp **44*d*(HLL) of the lower heat roller 43** is turned on (C42).

Thereafter, the upper heater lamp **44*a*(HLU) of the upper heat roller 41 is again turned on (C71) while the separation of the middle heat roller 42 and the lower heat roller 43 as well as the contact of the upper heat roller 41 and the middle heat roller 42 is being maintained. Here, as the middle heat roller 42 is driven and rotated, the upper heat roller 41, which is pressed against the middle heat roller 42, is rotated together with the middle heat roller 42 (C72). Thus, the upper fixing section comes into a thermal-insulated state. Next, judgement is made as to whether the lower thermistor 45*c* has a temperature of not less than 130° C. (C43). If the temperature of the lower thermistor 45*c* is not less than 130° C., the lower heater lamp 44*d*(HLL) is turned off (C44), and then the upper heater lamp 44*a***(HLU) is turned off (C73), thereby returning to the main routine and allowing the copy machine to enter the stand-by state.

On the contrary, if the mono-color copying mode is selected, the upper heat roller 41 and the middle heat roller 42 are separated, while the middle heat roller 42 and the lower heat roller 43 are made to contact each other and rotated. Then, the routine for controlling the heating operation of the lower fixing section (for use in the mono-color mode) is executed as described in FIG. 10 in embodiment 4. Successively, as illustrated in FIG. 13, when the copying machine becomes ready for a mono-color copying operation, the upper heater lamp **44*a*(HLU) of the upper heat roller 41** is turned on (C62).

Thereafter, the lower heater lamp **44*d*(HLL) of the lower heat roller 43 is again turned on (C81) while the separation of the upper heat roller 41 and the middle heat roller 42 as well as the contact of the middle heat roller 42 and the lower heat roller 43 is being maintained. Here, as the middle heat roller 42 is driven and rotated, the lower heat roller 43, which is pressed against the middle heat roller 42, is rotated together with the middle heat roller 42 (C82). Thus, the lower fixing section comes into a thermal-insulated state. Next, judgement is made as to whether the upper thermistor 45*a* has a temperature of not less than 210° C. (C63). If the temperature of the upper thermistor 45*a* is not less than 210° C., the upper heater lamp 44*a*(HLU) is turned off (C64), and then the lower heater lamp 44*d***(HLL) is turned off (C83), thereby returning to the main routine and allowing the copy machine to enter the stand-by state.

As described above, the copying machine in accordance with the present embodiment is provided with the following four functions: the fist function—which is furnished by the temperature adjusting means—for applying temperature adjustments to the upper and lower fixing sections; the second function—which is furnished by the adjustment order controlling means—for controlling the temperature adjusting means in such a manner that temperature adjustments are applied to either the first or second fixing section according to an order of priority, and that after the completion of the temperature adjustments, temperature adjustments with respect to the other fixing section is successively carried out; the third function —which is furnished by the fixing-section forming means for allowing on demand the contact and the separation between either pair of the two pairs of fixing rollers, which form the upper and lower fixing sections respectively; and the fourth function—which is furnished by the fixing-roller controlling means—by which upon applying temperature adjustments to the other fixing section successively after completion of temperature adjustments applied to either of fixing sections, the pair of fixing rollers that are associated with the fixing section that has been subjected to the temperature adjustments, are rotated while maintaining the contact between the pair of the fixing rollers. Therefore, in the copying machine of the present embodiment, the contact and the separation between the upper and middle heat rollers 41 and 42 as well as between the middle and lower heat rollers 42 and 43, which form the upper and lower fixing sections, are allowed on demand. Further, upon applying temperature adjustments to the other fixing section successively after completion of temperature adjustments applied to either of the upper and lower fixing sections, either pair of heat rollers that are associated with the fixing section that has been subjected to the temperature adjustments, are rotated while maintaining the contact between the pair of the rollers.

With this arrangement, it is possible to prevent an abrupt temperature drop with respect to one of the fixing sections that takes place while applying temperature adjustments to the other fixing device. It is also possible to apply temperature adjustments to one of the fixing sections while using the other fixing section. Thus, the waiting time required before the copying machine is ready for a desired copying operation can be shortened.

Moreover, in the copying machine of the present embodiment, while either of the fixing sections is heated, one of the heat rollers to form the other fixing section is separated. That is, for example, while the lower fixing section is heated, the middle heat roller 42 is separated from the upper heat roller 41. Thus, heat is not conducted to the upper or the lower heat roller 41 or 43 forming the other fixing section through the middle heat roller 42, which is associated with the formation of both of the fixing sections; this makes it possible to effectively heat one of the fixing sections.

[EMBODIMENT 6]

Referring to FIG. 14 through 17, the following description will discuss another embodiment of the present invention. Here, for convenience of explanation, those members that have the same functions and that have been described in embodiment 1 (with reference to FIGS. 2 through 4) are indicated by the same reference numerals and the description thereof is omitted. Further, the explanation of the present embodiment is given with reference to FIGS. 2 through 4 of embodiment 1.

As with embodiment 1 that is illustrated in FIG. 2, the copying machine of the present invention is provided with upper through lower heater lamps 44*a* through 44*d*, upper through lower thermistors 45*a* through 45*c*, thermostats and a control device 52, wherein the upper, middle, and lower heat rollers 41 through 43 are adjusted to have respective temperatures, for example, 210° C., 190° C. and 130° C.

Figure 14:
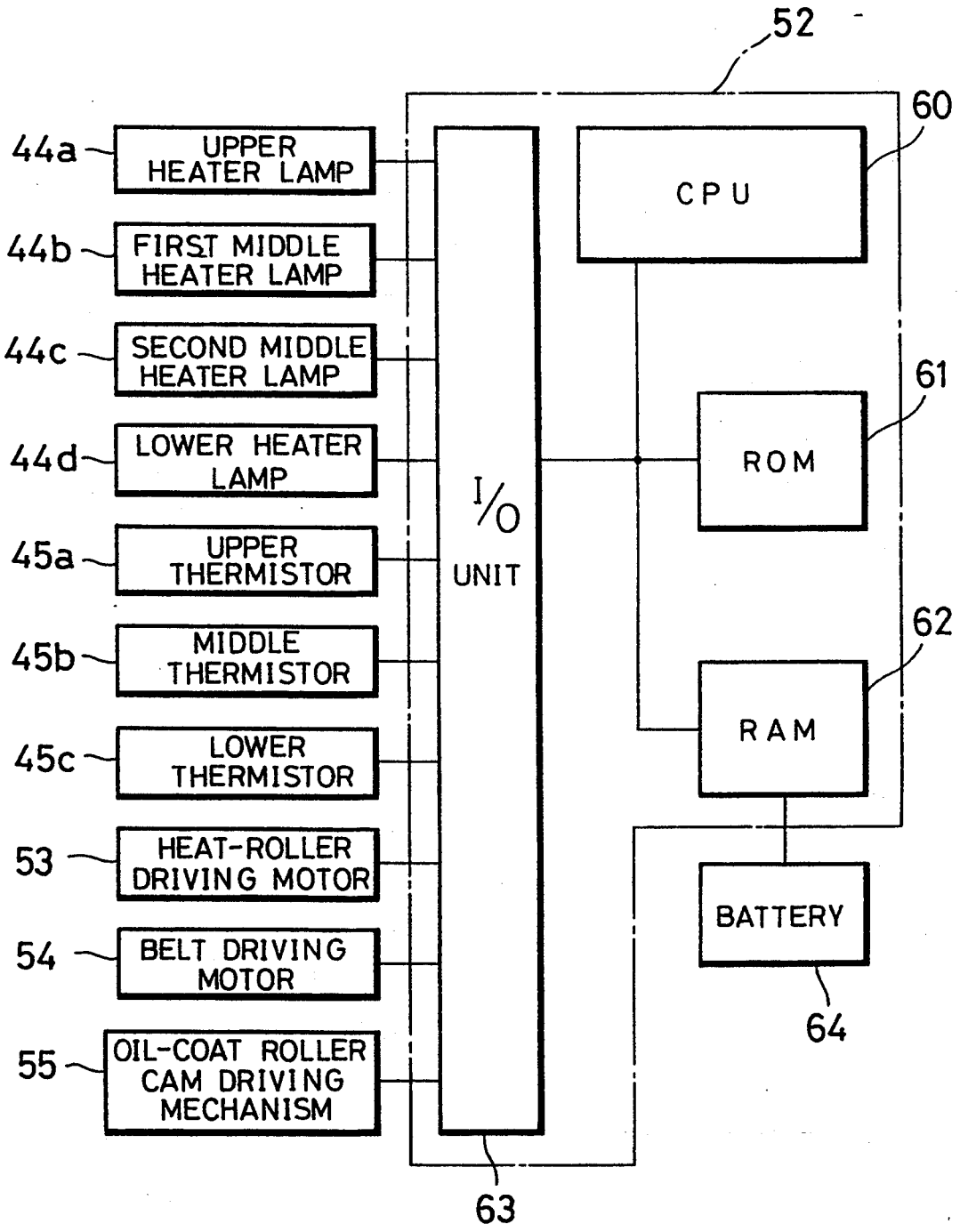
FIGS. 14 through 17 show the sixth embodiment of the present invention.

As illustrated in FIG. 14, the control device 52 is provided with a CPU(Central Processing Unit) 60, ROM(Read Only Memory) 61, RAM(Random Access Memory)62, and I/O unit(Input/Output Unit) 63 in order to control the suction unit 36 and the fixing device 40.

The ROM 61 is an read-only memory for storing programs and data used for controlling the copying machine. The RAM 62 is a random read/write memory for temporarily storing input data and operation results of the CPU 60. Further, a battery 64 is connected to the RAM 62, and the battery 64 thus prevents the RAM 62 from losing its storage even if the main power source of the copying machine main body 1 is turned off. With this arrangement, the RAM 62 functions as a storage means for storing data that determines which fixing section is preferentially subjected to temperature adjustments when the copying machine is first activated.

The control device 52, which is provided with the ROM 61, the RAM 62 and the CPU 60, has functions for controlling the operations of the heat-roller driving motor 53, the belt driving motor 54, the oil-coat roller cam driving mechanism 55, the heater lamps 44*a* through 44*d* and other devices, in response to inputs sent from the upper, middle and lower thermistors 45*a* through 45*c*, the sensors and the various input keys, not shown, etc. which are connected to the I/O unit 63.

Moreover, the control device 52 functions as a temperature-adjusting means for applying temperature adjustments to the upper, middle and lower heat rollers 41 through 43 by turning on and off the upper through lower heater lamps 44*a* through 44*d* in response to signals sent from the upper, middle and lower thermistors 45*a* through 45*c* that detect the surface temperature of the heat rollers 41 through 43. Further, the control device 52 functions as the second precedence-setting means which sets the order of priority with respect to temperature adjustments of fixing sections in such a manner that during warm-up time of the copying machine, which follows the activation of the main power source of the copying machine, temperature adjustments are first applied to the fixing section having priority according to the storage of the RAM 62. The other arrangements of the present embodiment are the same as those of embodiment 1; therefore, the explanation thereof is omitted.

In the above arrangement, an explanation will be given of the temperature control of the fixing device 40 during warm-up time of the copying machine, which follows the activation of the main power source of the copying machine, with reference to flow charts shown in FIGS. 15 through 17.

First, when either the full-color copy selection key (selection means) or the mono-color copy selection key (selection means) is depressed, setting data for determining which copying mode is executed is inputted, and the setting data is stored in the RAM 62 in the control device 52. Then, the copying machine executes a copying operation in accordance with the copying mode corresponding to the setting data stored in the RAM 62. When the copying machine is shut down by turning off the main power source of the copying machine, the RAM 62 maintains the storage of the setting data by means of back-up voltage from the battery 64.

Figure 15:
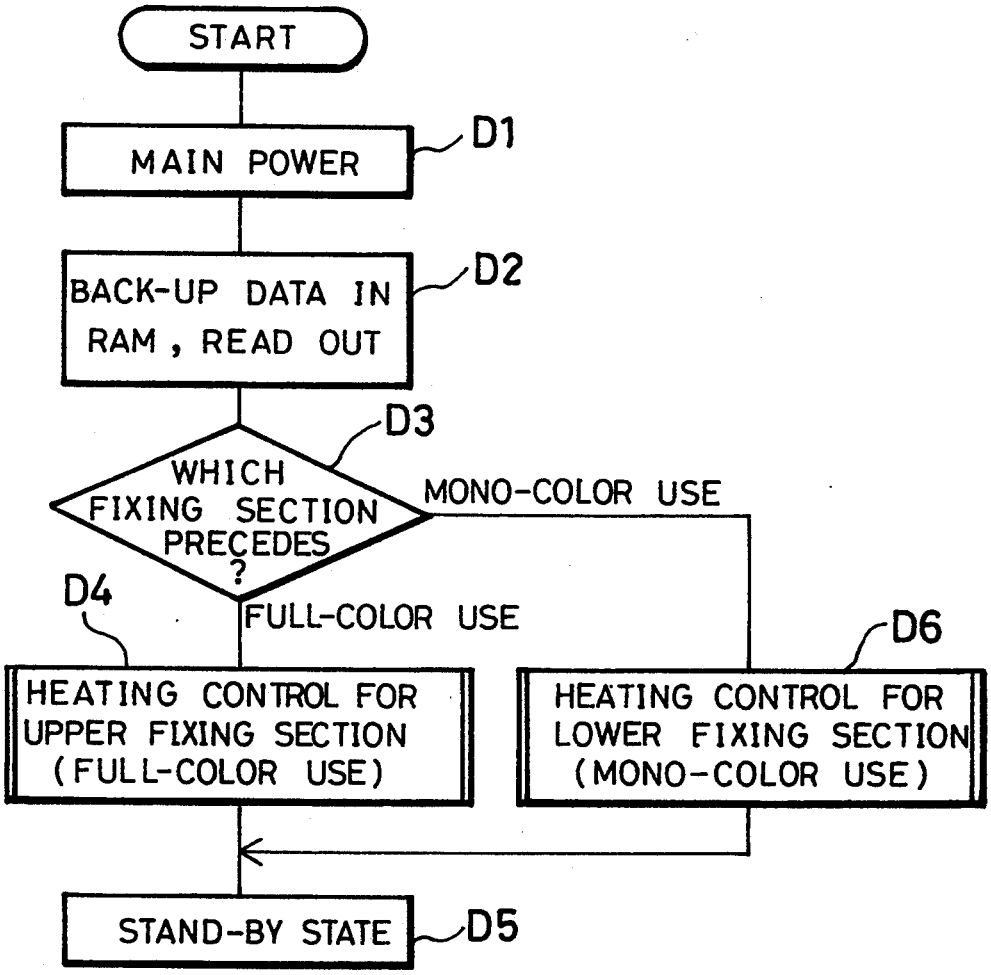

After having shut down the copying machine, when the main power source of the copying machine is again turned on as shown in FIG. 15 (D1), the back-up data (setting date) of the RAM 62 is read by the CPU 60 of FIG. 14 (D2), and judgement is made as to which fixing section will be preferentially subjected to temperature adjustments in accordance with the storage of the RAM 62 (D3). If the temperature adjustments are preferentially applied to the upper fixing section for use in the full-color copying mode at D3, a routine for controlling the heating operation of the upper fixing section, which will be described later, is executed (D4), and after the completion of the process D4, the copying machine enters the stand-by state (D5). On the other hand, if the temperature adjustments are preferentially applied to the lower fixing section for use in the mono-color copying mode at D3, a routine for controlling the heating operation of the lower fixing section, which will be described later, is executed (D6), and after the completion of the process D6, the copying machine enters the stand-by state (D5).

Here, an explanation will be given of the routine for controlling the heating operation in the case where the upper fixing section is heated prior to the lower fixing section.

Figure 16:
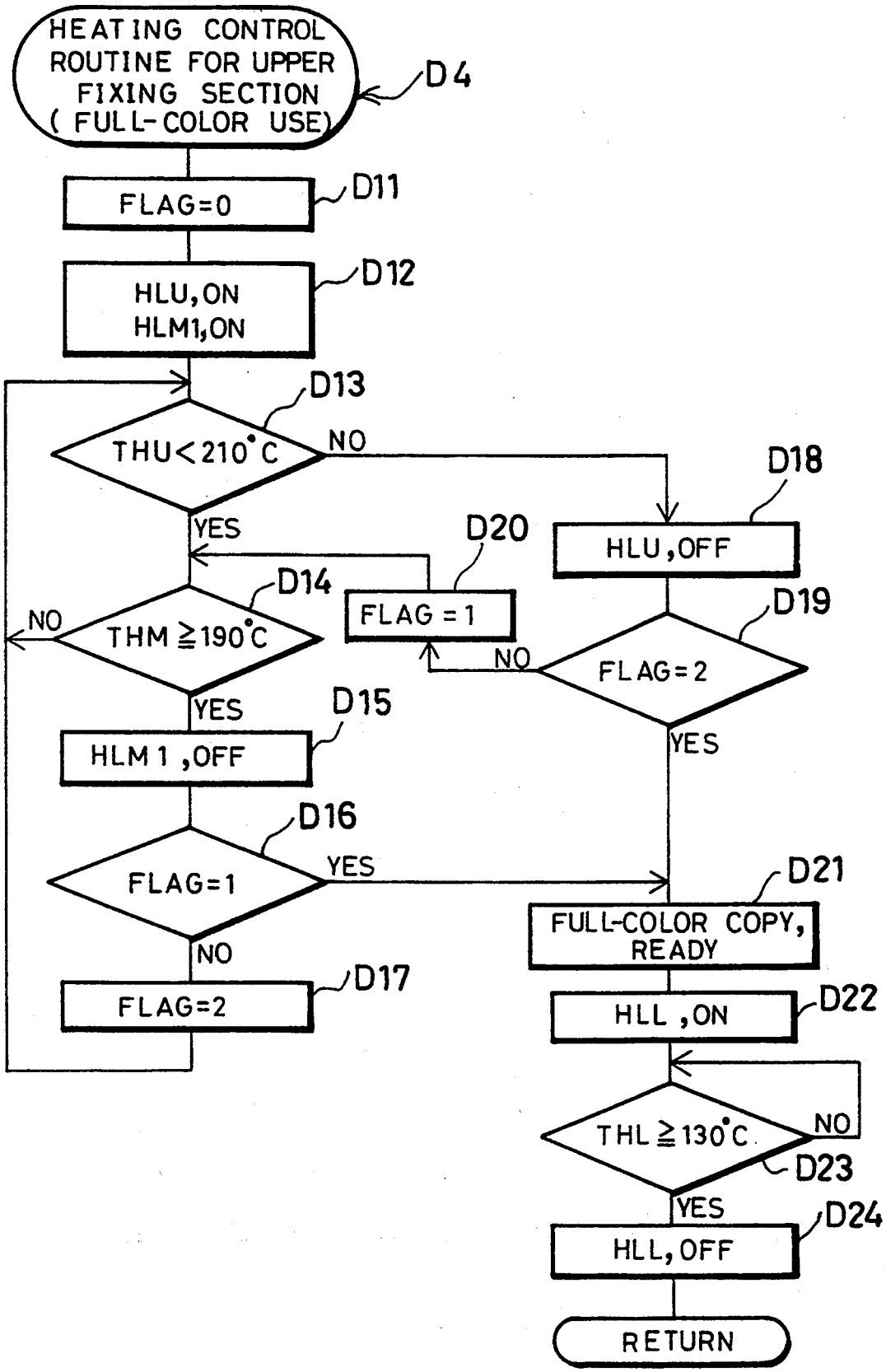

As illustrated in FIG. 16, first, after setting: "flag=0" (D11), the upper heater lamp 44*a*(HLU) of the upper heat roller 41 and the first middle heater lamp 44*b*(HLM1) of the middle heat roller 42 are turned on (D12). Next, judgement is made as to whether or not the upper thermistor 45*a*(THU) has a temperature of less than 210° C. (D13). If the temperature of the upper thermistor 45*a* (THU) is less than 210° C., judgement is made as to whether or not the middle thermistor 45*b*(THM) has a temperature of not less than 190° C. (D14). If the temperature of the middle thermistor 45*b* is not less than 190° C., the first middle heater lamp 44*b*(HLM1) is turned off (D15). On the contrary, if the temperature of the middle thermistor 45*b*(THM) is less than 190° C. at D14, the sequence returns to D13. After executing D15, judgement is made as to whether or not "flag=1" (D16), and if "flag=1" is not satisfied, it is replaced with "flag=2" (D17), thereby returning to D13. Here, if "flag=1" is satisfied at D16, the full-color-use ready lamp (not shown) is turned on, thereby indicating that the machine is ready for a full-color copying operation (D21).

If the temperature of the upper thermistor 45*a* is not less than 210° C. at D13, the upper heater lamp 44*a*(HLU) is turned off (D18), and judgement is made as to whether or not "flag=2" (D19). If "flag=2" is satisfied at D19, it indicates that the machine is ready for a full-color copying operation (D21). Here, if "flag=2" is not satisfied at D19, it is replaced with "flag=1" (D20), and the sequence returns to D14.

Following the process D21, a heating operation is executed with respect to the lower fixing section for mono-color copying. That is, the lower heater lamp 44*d*(HLL) of the lower heat roller 43 is turned on (D22). Next, judgement is made as to whether or not the lower thermistor 45*c*(THL) has a temperature of not less than 130° C. (D23). If the temperature of the lower thermistor 45*c*(THL) is not less than 130° C., the lower heater lamp 44*d*(HLL) is turned off (D24), thereby returning to the main routine. Additionally, it is possible to carry out full-color copying operations while heating the lower fixing section.

Here, an explanation will be given of the routine for controlling the heating operation in the case where the lower fixing section is heated prior to the upper fixing section.

Figure 17:
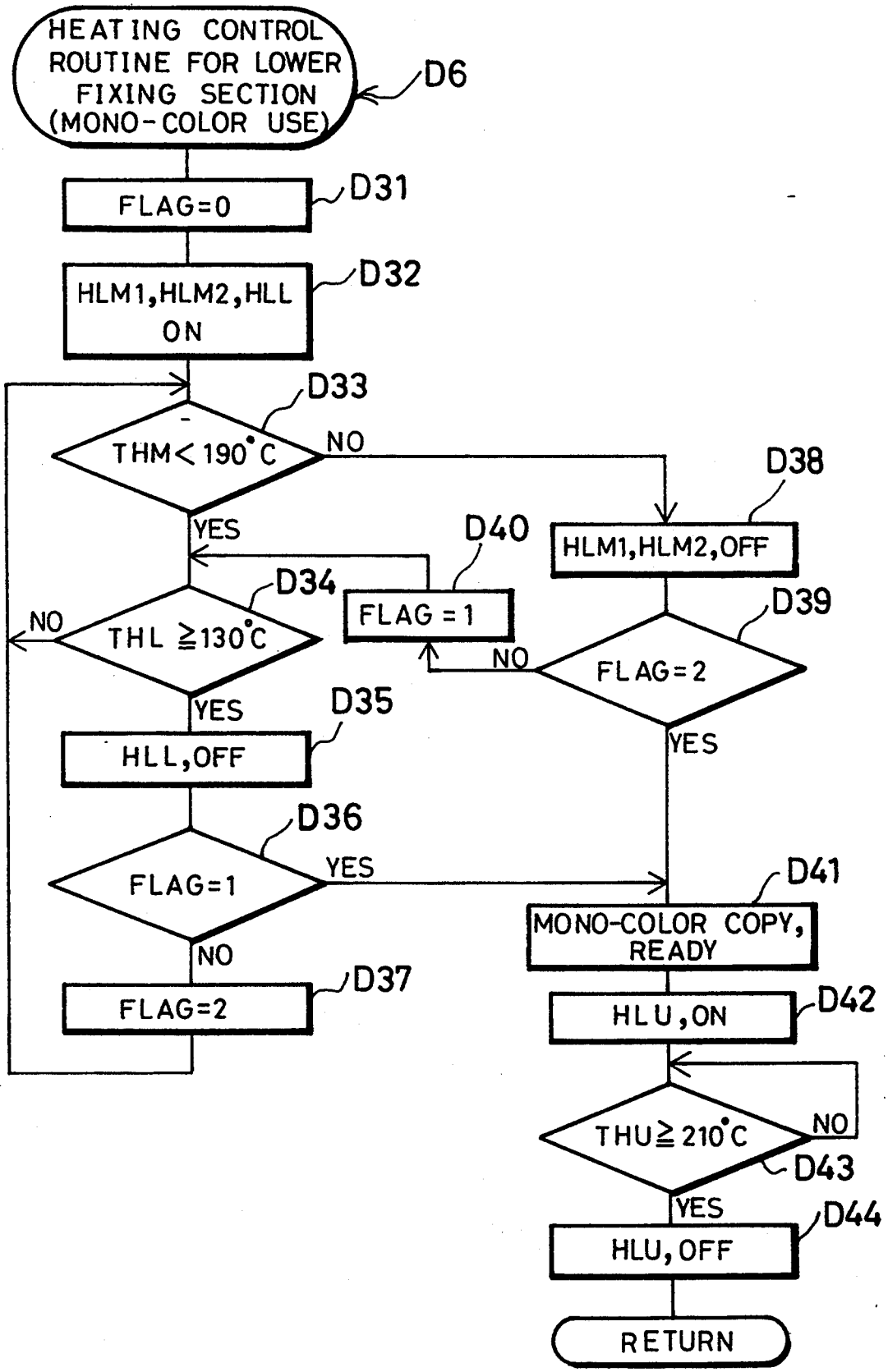

As illustrated in FIG. 17, first, after setting "flag=0" (D31), the first middle heater lamp 44*b*(HLM1) and the second middle heater lamp 44*c*(HLM2) of the middle heat roller 42 as well as the lower heater lamp 44*d*(HLL) of the lower heat roller 43 are turned on (D32). Next, judgement is made as to whether or not the middle thermistor 45*b*(THM) has a temperature of less than 190° C. (D33). If the temperature of the middle thermistor 45*b*(THM) is less than 190° C., judgement is made as to whether or not the lower thermistor 45*c*(THL) has a temperature of not less than 130° C. (D34). If the temperature of the lower thermistor 45*c*(THL) is not less than 130° C. at D34, the lower heater lamp 44*d* is turned off (D35). On the contrary, if the temperature of the lower thermistor 45*c*(THL) is less than 130° C. at D34, the sequence returns to D33. After executing D35, judgement is made as to whether or not "flag=1" (D36), and if "flag=1" is not satisfied, it is replaced with "flag=2" (D37), thereby returning to D33. Here, if "flag=1" is satisfied at D36, the mono-color-use ready lamp (not shown) is turned on, thereby indicating that the machine is ready for a mono-color copying operation (D41).

If the temperature of the middle thermistor 45*b*(THM) is not less than 190° C. at D33, the first middle heater lamp 44*b*(HLM1) and the second middle heater lamp 44*c*(HLM2) are turned off (D38), and judgement is made as to whether or not "flag=2" (D39). If "flag=2" is satisfied at D39, it indicates that the machine is ready for a mono-color copying operation (D41). Here, if "flag=2" is not satisfied at D39, it is replaced with "flag=1" (D40), and the sequence returns to D34.

After the process D41, a heating operation is executed with respect to the lower fixing section for full-color copying. That is, the upper heater lamp 44*a*(HLU) of the upper heat roller 41 is turned on (D42). Next, judgement is made as to whether or not the upper thermistor 45*a*(THU) has a temperature of not less than 210° C. (D43). If the temperature of the upper thermistor 45*a*(THU) is not less than 210° C., the upper heater lamp 44*a*(HLU) is turned off (D44), thereby returning to the main routine. Additionally, it is possible to carry out mono-color copying operations while heating the upper fixing section.

As described above, the copying machine in accordance with the present embodiment is provided with the following five functions: the fist function—which is furnished by the temperature adjusting means—for applying temperature adjustments to the upper and lower fixing sections; the second function—which is furnished by the adjustment order controlling means—for controlling the temperature adjusting means in such a manner that temperature adjustments are applied to either the first or second fixing section according to an order of priority, and that after the completion of the temperature adjustments, temperature adjustments with respect to the other fixing section is successively carried out; the third function—which is furnished by the selection means—for selecting either of the upper and lower fixing sections; the fourth function—which is furnished by the storage means—for storing the fixing section that has been selected by the selection means; and the fifth function—which is furnished by the second precedence-setting means—for setting the order of priority in the adjustment order controlling means in such a manner that, during warm-up time of the copying machine, temperature adjustments are preferentially applied to the fixing section that has been stored in the storage means. Therefore, in the copying machine of the present embodiment, setting data entered through the selection means such as a selection key is stored and maintained in the RAM 62, and during warm-up time of the copying machine, which follows the activation of the main power source of the copying machine, temperature adjustments are preferentially applied to the fixing section that has been stored in the RAM 62.

With this arrangement, upon activating the copying machine, the order of priority with respect to temperature adjustments of fixing sections can be desirably specified; this makes it possible to improve the operability of the copying machine as well as to shorten the waiting time, that is, the warm-up time after activating the copying machine.

[EMBODIMENT 7]

Referring to FIG. 18 through 21, the following description will discuss another embodiment of the present invention. Here, for convenience of explanation, those members that have the same functions and that have been described in embodiment 1 (with reference to FIGS. 2 through 4) are indicated by the same reference numerals and the description thereof is omitted. Further, the explanation of the present embodiment is given with reference to FIGS. 2 through 4 of embodiment 1.

Figure 18:
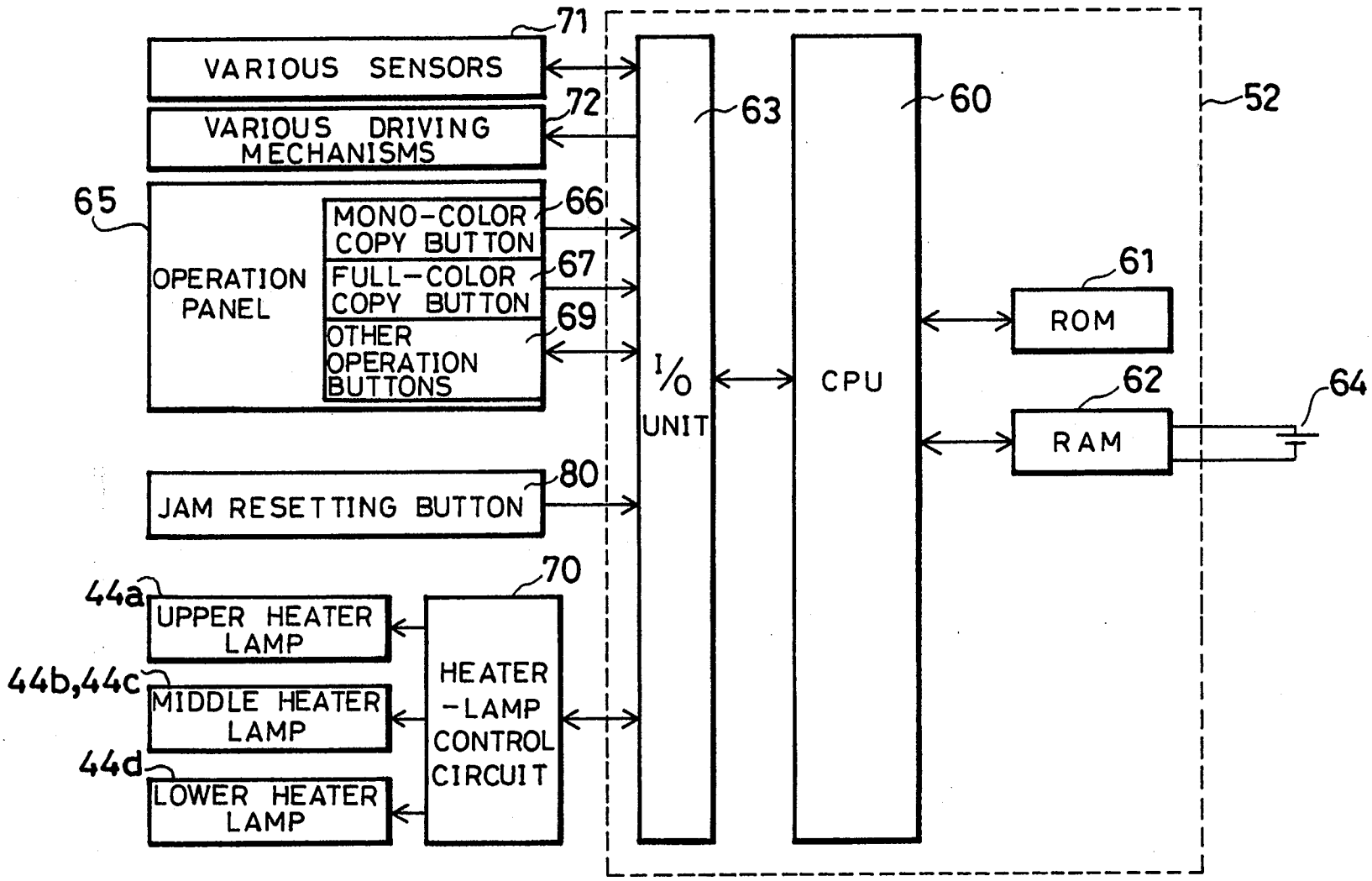
FIGS. 18 through 21 show the seventh embodiment of the present invention.

As illustrated in FIG. 18, the copying machine of the present invention is provided with a control device 52 for controlling the fixing device 40. The control device 52 is constituted of a CPU 60, a ROM 61, a RAM 62 and an I/O unit 63. The ROM 61, which is an read-only memory for storing programs and data used for controlling the copying machine, stores routines such as a temperature-adjusting routine for allowing the copying machine to enter the stand-by state ready for a copying operation. The RAM 62 is a random read/write memory for temporarily storing the currently used copying mode, input data, operation results of the CPU 60, etc. Further, a back-up power source 64 is connected to the RAM 62; therefore, even if the main power source of the copying machine main body 1 is turned off to shut down the machine due to the event of a failure such as a paper jam, the RAM 62, which functions as a storage means, will not lose the storage concerning the copy mode, etc. that have been stored before the shut down.

To the I/O unit 63 are connected an operation panel 65, a heater-lamp control circuit 70 (temperature-adjusting means), various sensors 71, various driving mechanisms 72 and a jam resetting button 80. The console panel 65 is provided with a mono-color copy button 66, which is turned on in selecting the mono-color copying mode, a full-color copy button 67, which is turned on in selecting the full-color copying mode, and various other operation buttons 69 through which the number of copies, the magnification, etc. are entered. Here, the mono-color copy button 66 and the full-color copy button 67 are designed in such a manner that once either of the buttons is depressed, the selection of the copy mode is made; and when the same button is again depressed, the relevant copying operation is carried out.

The heater-lamp control circuit 70 applies temperature adjustments to the upper, middle and lower heat rollers 41 through 43 by turning on and off the upper through lower heater lamps 44*a* through 44*d* in response to signals sent from the CPU 60. Additionally, in the present embodiment, the various sensors 71 refer to all the sensors including the upper through lower thermistors 45*a*, 45*b* and 45*c* and a sensor (not shown) for detecting a paper jam which may occur in a transport path or other places inside the copying machine, which are employed for controlling the copying machine. Further, the various driving mechanisms 72 refer to all the driving mechanisms including a heat-roller driving mechanism (not shown) and a heat-roller driving motor (not shown), which are used for copying operations.

The jam resetting button 80 is arranged in such a manner that in the event of a paper jam inside the copying machine, it is manually turned on or automatically turns on, for example, when the front door (not shown) is closed after the user of the copying machine has removed the jammed sheet of paper. When the jam resetting button 80 is turned on, the control device 52 recognizes the completion of the paper-removing work for the jammed sheet of paper. Further, a paper-jam indicator lamp (not shown) for informing the user of the occurrence of a paper jam is connected to the I/O unit 63.

The control device 52 controls the operations of the heater-lamp control circuit 70, the various driving mechanisms 72, etc. in response to inputs from the operation panel 65, the various sensors 71, the jam resetting button 80, etc., which are connected to the I/O unit 63 as described earlier. The control device 52 also functions as the second precedence-setting means which sets the order of priority with respect to temperature adjustments of fixing sections in such a manner that during warm-up time of the copying machine after the jam resetting button 80 has been turned on, temperature adjustments are preferentially applied to the fixing section associated with the copying mode stored in the RAM 62. The other arrangements of the present embodiment are the same as those of embodiment 1; therefore, the explanation thereof is omitted.

Figure 19:
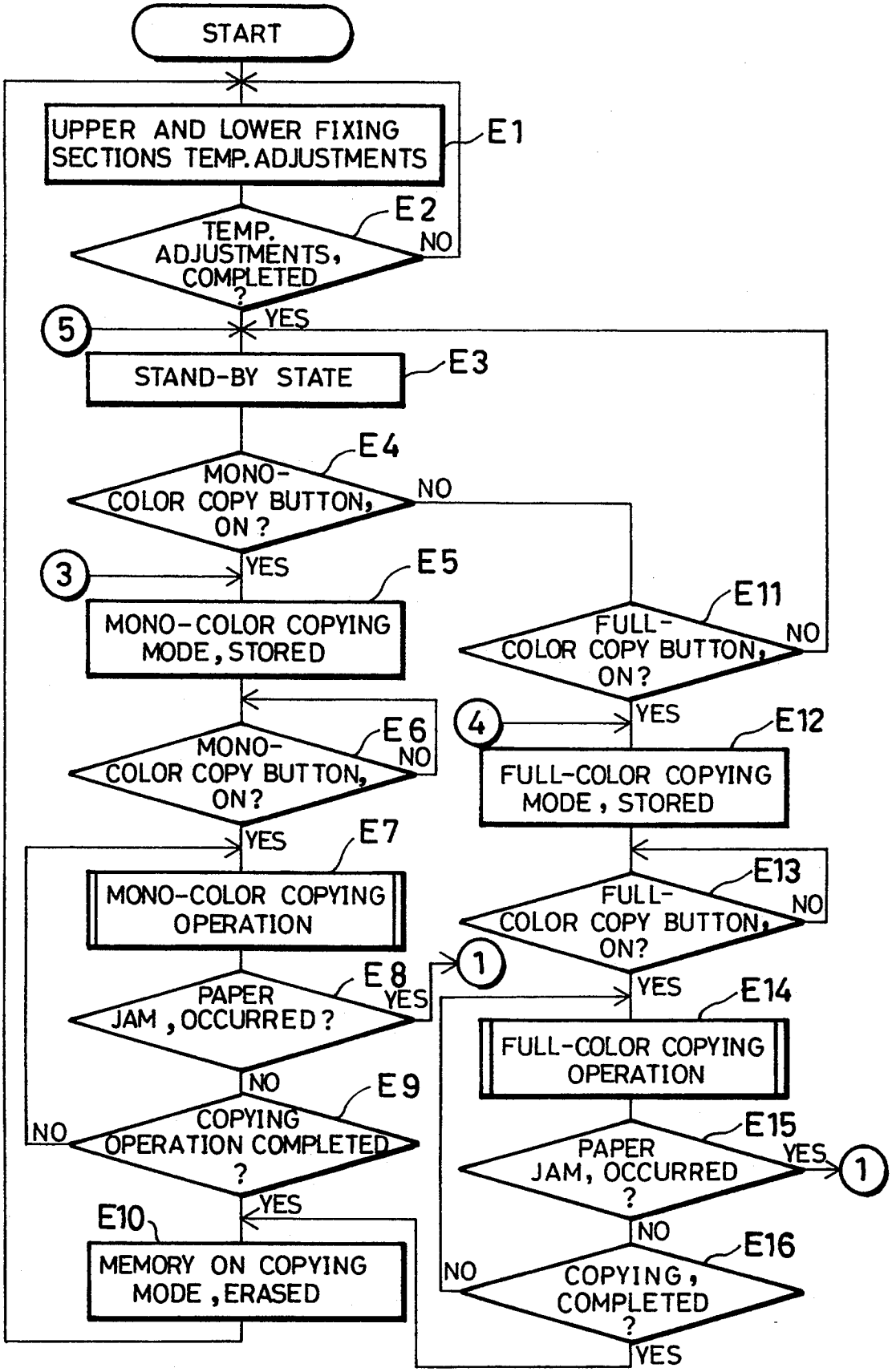

In the above arrangement, an explanation will be given of the copying operation of the copying machine with reference to flow charts in FIGS. 19 through 21. Here, the following operation of the copying machine according to the flow charts will discuss a case wherein the copying machine is shut down due to the event of a paper jam; yet, this operation is applied to other cases of the machine shut-down due to reasons other than paper jam.

First, the main power source of the copying machine is turned on, and the heater-lamp control circuit 70 and other devices apply temperature adjustments to the upper through lower heat rollers 41 through 43, which form the upper and lower fixing sections, so as to bring them to respective set temperatures (E1). After the completion of the temperature adjustments (E2), the copying machine enters the stand-by state (E3).

When the mono-color copy button 66 on the operation panel 65 is depressed (E4), the RAM 62 stores the mono-color copying mode (E5), and when the mono-color copy button 66 is again depressed (E6), a mono-color copying operation is carried out (E7). Additionally, as to the mono-color copying operation, it will be described later.

If there is no occurrence of a paper jam inside the copying machine during the mono-color copying operation at E7 (E8), judgement is made as to whether or not the copying operation has been completed (E9). If it has been completed, the storage of the mono-color copying mode is erased from the RAM 62 (E10), and the sequence returns to E1. After applying temperature adjustments to the heat rollers 41 through 43, the copying machine enters the stand-by state. On the other hand, if the copying operation has not been completed at E9, the sequence returns to E7, thereby continuing the mono-color copying operation.

If, instead of the mono-color copy button 66, the full-color copy button 67 is depressed at E4 (E11), the RAM 62 stores the full-color copying mode (E12), and when the full-color copy button 67 is again depressed (E13), a full-color copying operation is carried out (E14). Here, if the full-color copy button 67 is not depressed at E11, the copying machine returns to the stand-by state at E3. Additionally, as to the full-color copying operation, it will be described later.

If there is no occurrence of a paper jam inside the copying machine during the full-color copying operation at E14 (E15), judgement is made as to whether or not the copying operation has been completed (E16). If it has been completed, the storage of the full-color copying mode is erased from the RAM 62 (E10), and the sequence returns to E1. After applying temperature adjustments to the heat rollers 41 through 43, the copying machine enters the stand-by state. On the other hand, if the copying operation has not been completed at E16, the sequence returns to E14, thereby continuing the full-color copying operation.

Figure 20:
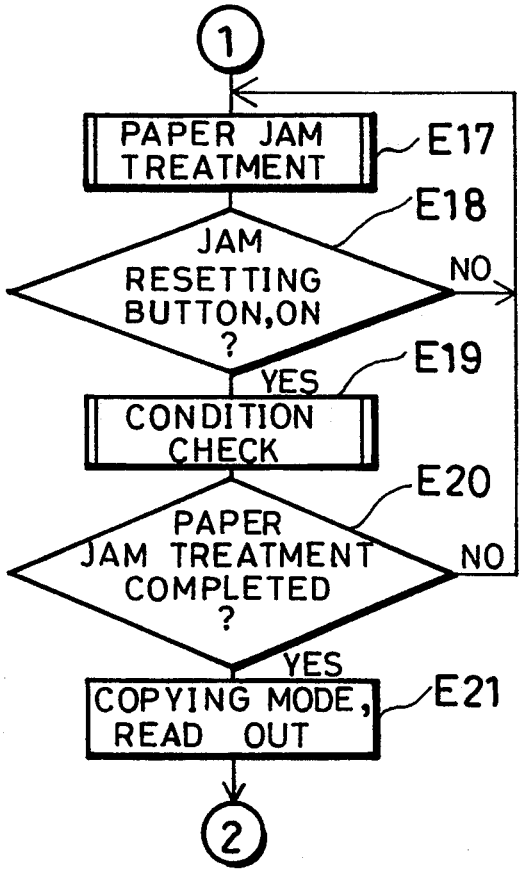
Figure 21:
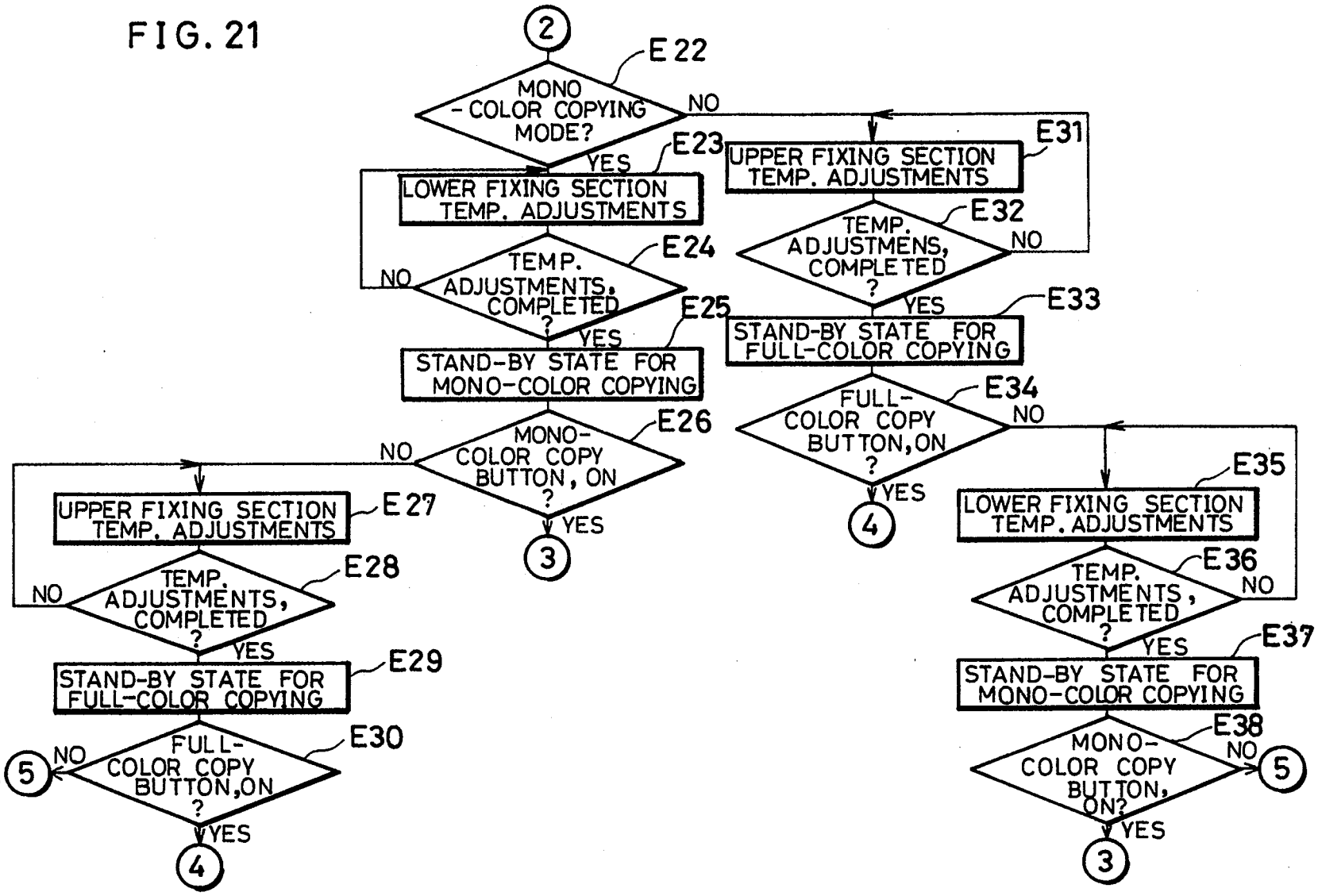

If there occurs a paper jam inside the copying machine during the mono-color copying operation at E7 or during the full-color copying operation at E14, the copying machine informs the user of the occurrence of the paper jam by means of, for example, the paper-jam indicator lamp (not shown) as shown in FIG. 20, thereby calling for an appropriate treatment such as jammed-paper removing work (E17). Thereafter, when the user closes the front door (not shown) of the copying machine after having removed the jammed sheet of paper, the jam resetting button 80 automatically turns on, or is manually turned on (E18), and the CPU 60 checks to see if the copying machine is in an operative condition (E19), that is, if the jammed-paper removing work has been finished (E20) by means of the sensor for detecting a paper jam (not shown) and various other sensors 71. If the jammed-paper removing work has not been finished, the sequence returns to E17 so as to call for jammed-paper removing work again. If the jammed-paper removing work has been finished, the copying mode stored in the RAM 62 is read out (E21).

Here, judgement is made as to whether or not the copying mode stored in the RAM 62 is the mono-color copying mode (E22). If it is the mono-color copying mode, temperature adjustments are applied to the middle and lower heat rollers 42 and 43 forming the lower fixing section by the heater-lamp control circuit 70 and other devices (E23). After the completion of the temperature adjustments (E24), operations including the pivotal movement of the suction unit 36 to the lower station are conducted, and the copying machine enters the stand-by state for a mono-color copying operation (E25).

When the mono-color copy button 66 on the operation panel 65 is depressed (E26), the sequence returns to E5, thereby successively carrying out a mono-color copying operation. On the other hand, if the mono-color copy button 66 is not depressed at E26, the CPU 60 successively applies temperature adjustments to the upper and middle heat rollers 41 and 42 forming the upper fixing section (E27). After the completion of the temperature adjustments (E28), operations including the pivotal movement of the suction unit 36 to the upper station are conducted, and the copying machine enters the stand-by state for a full-color copying operation (E29).

Thereafter, when the full-color copy button 67 on the operation panel 65 is depressed (E30), the sequence returns to E12, thereby successively carrying out a full-color copying operation. On the other hand, if the full-color copy button 67 is not depressed at E30, the copying machine enters the stand-by state at E3.

If the copying mode stored in the RAM 62 is not the mono-color copying mode at E22, that is, if it is the full-color copying mode, temperature adjustments are applied to the upper and middle heat rollers 41 and 42 forming the upper fixing section by the heater-lamp control circuit 70 and other devices (E31). After the completion of the temperature adjustments (E32), operations including the pivotal movement of the suction unit 36 to the upper station are conducted, and the copying machine enters the stand-by state for a full-color copying operation (E33).

When the full-color copy button 67 on the operation panel 65 is depressed (E34), the sequence returns to E12, thereby successively carrying out a full-color copying operation. On the other hand, if the full-color copy button 67 is not depressed at E34, the CPU 60 successively applies temperature adjustments to the middle and lower heat rollers 42 and 43 forming the lower fixing section (E35). After the completion of the temperature adjustments (E36), operations including the pivotal movement of the suction unit 36 to the lower station are conducted, and the copying machine enters the stand-by state for a mono-color copying operation (E37).

Thereafter, when the mono-color copy button 66 on the on the operation panel 65 is depressed (E38), the sequence returns to E5, thereby successively carrying out a mono-color copying operation. On the other hand, if the mono-color copy button 66 is not depressed at E38, the copying machine enters the stand-by state at E3.

As described above, the copying machine in accordance with the present embodiment is provided with the following five functions: the fist function—which is furnished by the temperature adjusting means—for applying temperature adjustments to the upper and lower fixing sections; the second function—which is furnished by the adjustment order controlling means—for controlling the temperature adjusting means in such a manner that temperature adjustments are applied to either the first or second fixing section according to an order of priority, and that after the completion of the temperature adjustments, temperature adjustments with respect to the other fixing section is successively carried out; the third function —which is furnished by the storage means—for storing the fixing section that had been used before the shut-down of the copying machine; and the fourth function—which is furnished by the second precedence-setting means—for setting the order of priority in the adjustment order controlling means in such a manner that, during warm-up time of the copying machine, temperature adjustments are preferentially applied to the fixing section that has been stored in the storage means. Therefore, in the copying machine of the present embodiment, the temperature adjusting means including the heater-lamp control circuit 70 is controlled in such a manner that during warm-up time of the copying machine after a recovering treatment to a failure, such as a paper jam, which caused a shut-down of the copying machine, temperature adjustments are preferentially applied to the upper or lower fixing section that had been used immediately before the machine shut-down.

With this arrangement, even in the case where heating to be applied to the three heat rollers 41 through 43 is restricted due to limited power consumption, temperature adjustments are preferentially applied to the upper or lower fixing section that has been used immediately before the machine shut-down upon re-warming up the copying machine. Thus, it is possible to improve the operability of the copying machine as well as to shorten the waiting time after re-activating the machine.

Additionally, in the copying machine of the present embodiment, the mono-color copy button 66 or the full-color copy button 67 is depressed again upon starting a copying operation; yet, the present invention is not limited to this arrangement. For example, a copy start button may be installed on the operation panel 65, and after selecting either of the copying modes through the mono-color copy button 66 or the full-color copy button 67, the copy start button may be depressed to start a copying operation.

[EMBODIMENT 8 ]

Referring to FIGS. 22 through 25, the following description will discuss another embodiment of the present invention. Here, for convenience of explanation, those members that have the same functions and that have been described in embodiment 1 (with reference to FIGS. 2 through 4) are indicated by the same reference numerals and the description thereof is omitted. Further, the explanation of the present embodiment is given with reference to FIGS. 2 through 4 of embodiment 1.

Figure 22:
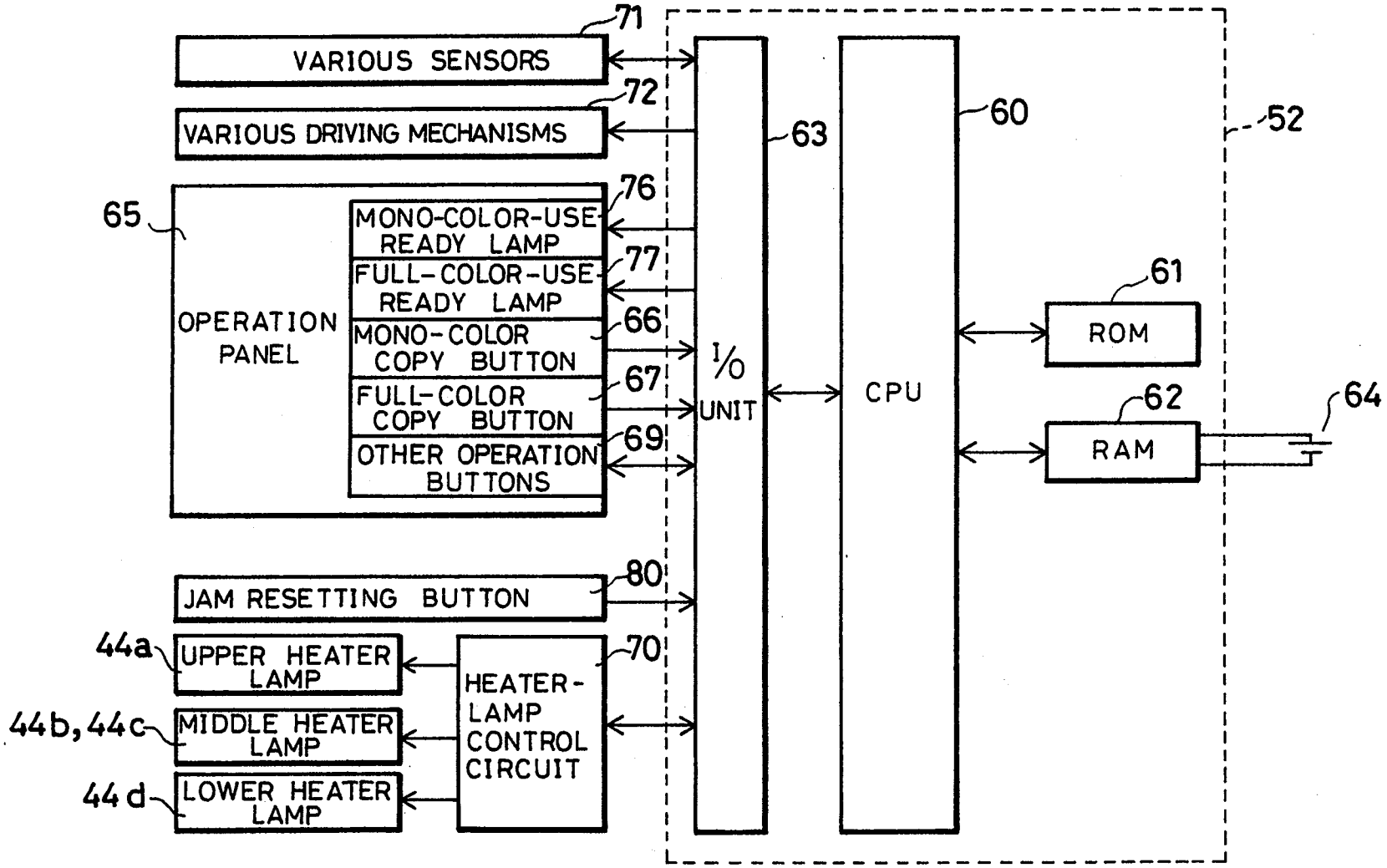
FIGS. 22 through 25 show the eighth embodiment of the present invention.

As illustrated in FIG. 22, a copying machine in accordance with the present embodiment is provided with an operation panel 65. The operation panel 65 (display means) has a mono-color-use ready lamp 76 (hereinafter, referred to as mono-color lamp) and a full-color-use ready lamp 77 (hereinafter, referred to as full-color lamp).

Figure 23:
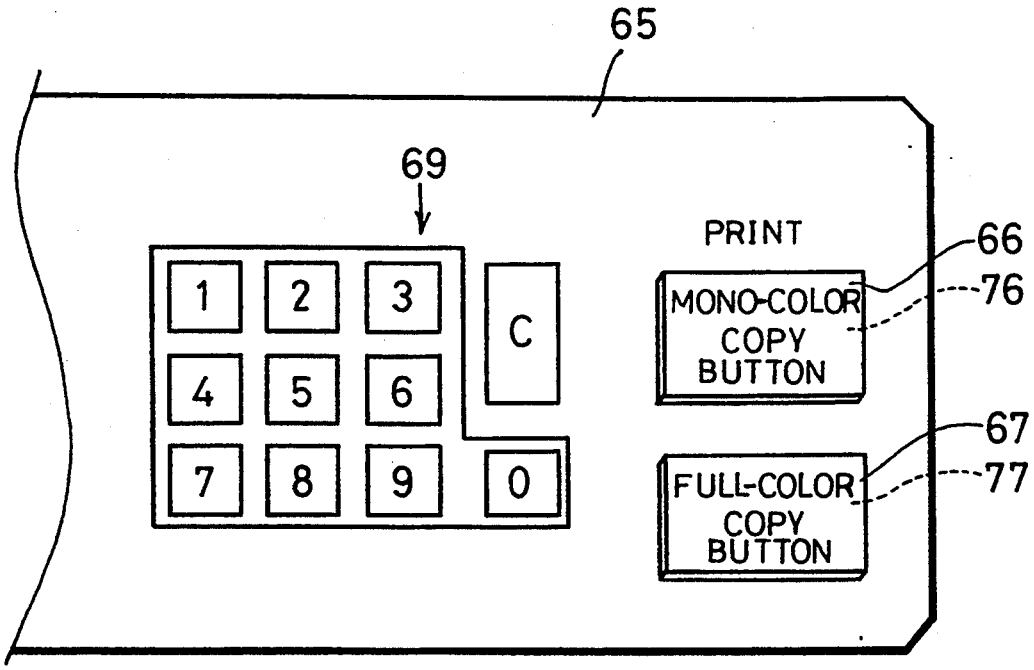

As illustrated in FIG. 23, the mono-color lamp 76 is built in the mono-color copy button 66 and the full-color lamp 77 is built in the full-color copy button 67. The mono-color lamp 76 is arranged to flash while temperature adjustments are being applied to the middle and lower heat rollers 42 and 43—which form the lower fixing section—by the heater-lamp control circuit 70 and other devices, and it turns off after the completion of the temperature adjustments. Likewise, the full-color lamp 77 is arranged to flash while temperature adjustments are being applied to the upper and middle heat rollers 41 and 42—which form the lower fixing section—by the heater-lamp control circuit 70 and other devices, and it turns off after the completion of the temperature adjustments. Further, the mono-color lamp 76 and the full-color lamp 77 are turned off when neither of the fixing sections is subjected to any temperature adjustments.

Upon depressing the mono-color copy button 66 while the mono-color lamp 76 is off, or while it is flashing, the mono-color copying mode is selected. Further, upon depressing the mono-color copy button 66 while the mono-color lamp 76 is on, a mono-color copying operation is started. Likewise, upon depressing the full-color copy button 67 while the full-color lamp 77 is off, or while it is flashing, the full-color copying mode is selected. Further, upon depressing the full-color copy button 67 while the full-color lamp 77 is on, a full-color copying operation is started.

A copying machine in accordance with the present embodiment is provided with a control device 52. As in embodiment 1, the control device 52, whereto the operation panel 65 is connected, functions as the temperature adjusting means and the adjustment order controlling means, and further functions as the fist precedence-setting means for setting the order of priority with respect to temperature adjustments of fixing sections. The function is explained as follows: During warm-up time of the copying machine, which follows the activation of the main power source of the copying machine, when a copying mode is selected by depressing the mono-color copy button 66 or the full-color copy button 67 on the operation panel 65, temperature adjustments are preferentially applied to the fixing section that is associated with the selected copying mode in accordance with the order of priority. The other arrangements of the present embodiment are the same as those of embodiment 1; therefore, the explanation thereof is omitted.

Figure 24:
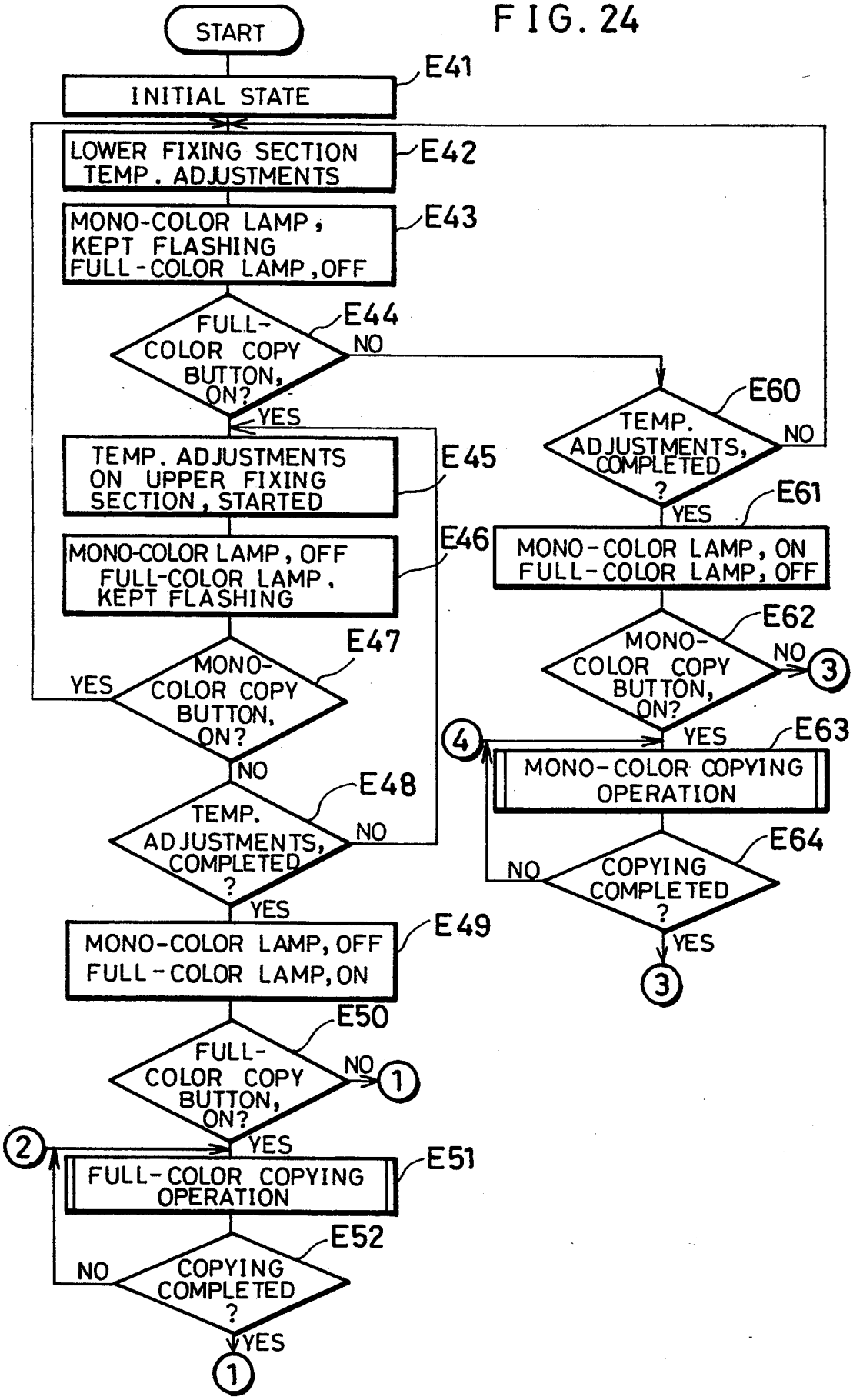
Figure 25:
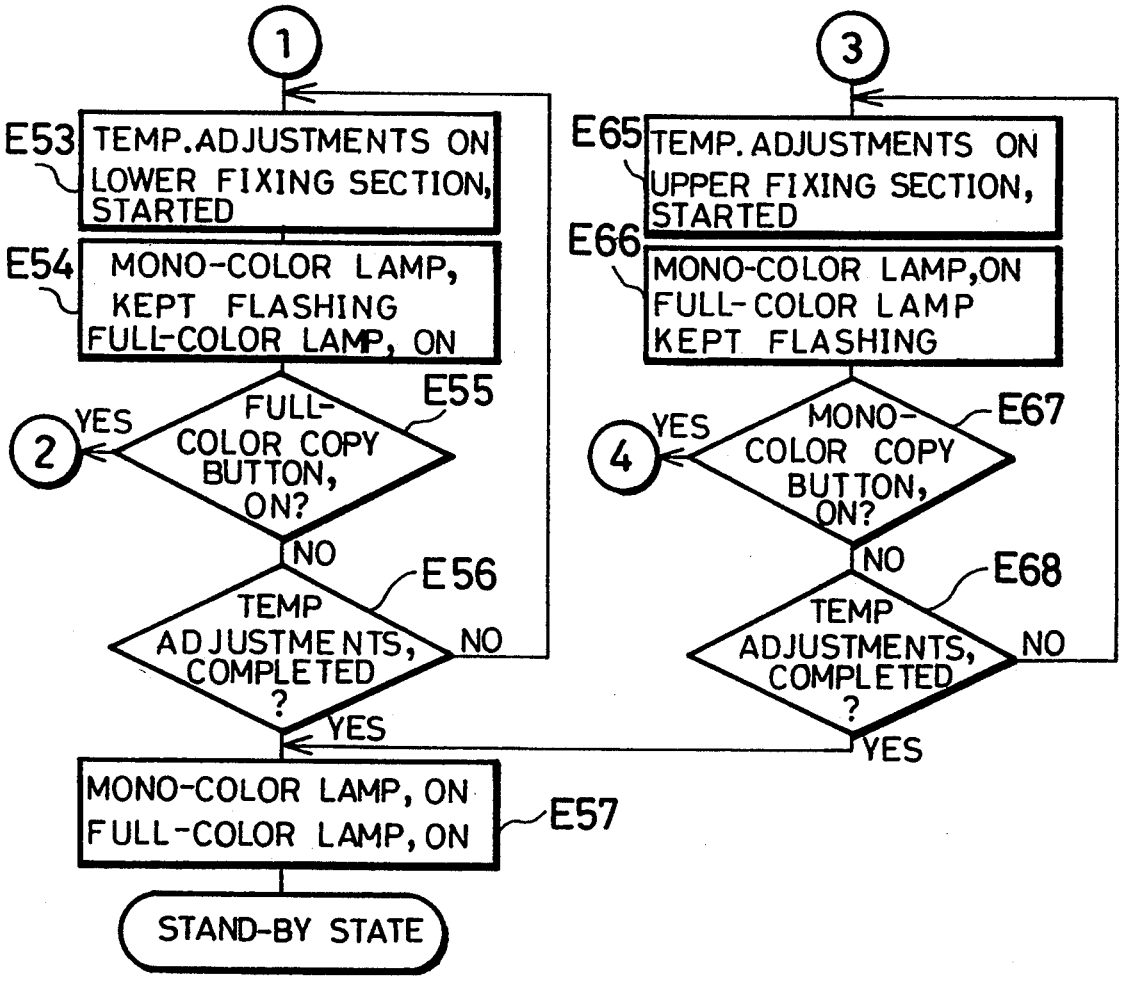

In the above arrangement, an explanation will be given of the temperature adjustments of the upper and lower fixing sections in the fixing device 40 of the copying machine with reference to flow charts in FIGS. 24 and 25. Here, in the copying machine in accordance with the present embodiment, during warm-up time of the copying machine following the activation of the main power source or following the re-activation of the machine after removing a jammed sheet of paper from the machine, temperature adjustments are preferentially applied to the lower fixing section at first, which is associated with the mono-color copying mode.

First, when the main power source of the copying machine is turned on or when a jammed sheet of paper is removed from the machine, the CPU 60 of the control device 52 is initialized by the program that is located in the ROM 61 (E41). Next, the CPU 60 starts applying temperature adjustments to the middle and lower heat rollers 42 and 43—which form the lower heat section—by the use of the heater-lamp control circuit 70 and other devices (E42). During the temperature adjustments of the middle and lower heat rollers 42 and 43, the mono-color lamp 76 is flashing, while the full-color lamp 77 is off (E43). The mono-color lamp 76, which is flashing, indicates the user of the copying machine that temperature adjustments are being carried out on the lower fixing section associated the mono-color copying mode.

In this state, when the full-color copy button 67 on the operation panel 65 is depressed (E44), the heater-lamp control circuit 70 interrupts the temperature adjustments with respect to the lower fixing section in response to a signal released from the CPU 60, and starts applying temperature adjustments to the upper and middle heat rollers 41 and 42, which form the upper fixing section. (E45). During the temperature adjustments of the upper and middle heat rollers 41 and 42, the mono-color lamp 76 is off, while the full-color lamp 77 is flashing (E46). The full-color lamp 77, which is flashing, indicates the user of the copying machine that temperature adjustments are being carried out on the upper fixing section associated the full-color copying mode. In this state, if the mono-color copy button 66 on the operation panel 65 is turned on (E47), the sequence returns to E42. Thus, the heater-lamp control circuit 70 interrupts the temperature adjustments with respect to the upper fixing section, and starts applying temperature adjustments again to lower fixing section. As described above, in the copying machine of the present embodiment, the user of the copying machine can desirably specify the order of priority with respect to temperature adjustments to be applied to the upper or lower fixing section.

If the mono-color copy button 66 is not turned on at E47, the temperature adjustments to the upper fixing section are continued, and when the temperature adjustments has been completed (E48), the full-color lamp 77 is turned on (E49). The full-color lamp 77, which is now turned on, indicates the user of the copying machine that the temperature adjustments of the upper fixing section has been completed. Next, judgement is made as to whether or not the full-color copy button 67 is again turned on (E50), and if the full-color copy button 67 is turned on, a full-color copying operation is carried out (E51). Here, as to the full-color copying operation, it has been described in detail in embodiment 1; therefore, the explanation thereof is omitted. Thereafter, judgement is made as to whether or not the copying operation has been completed (E52), and if it has been completed, temperature adjustments are applied to the middle and lower heat rollers 42 and 43, which form the lower fixing section associated with the mono-color copying mode (E53). Further, if the full-color copy button 67 is not turned on at E50, the sequence directly proceeds to E53, thereby starting to apply temperature adjustments to the middle and lower heat rollers 42 and 43, which form the lower fixing section.

During the temperature adjustments of the middle and lower heat rollers 42 and 43, the mono-color lamp 76 is kept flashing, while the full-color lamp 77 is kept on since the temperature adjustments on the upper fixing section has been completed (E54). These lamps 76 and 77 in these states indicate the user of the copying machine that the temperature adjustments of the upper fixing section has been completed and that temperature adjustments are now being carried out on the lower fixing section. In this state, if the full-color copy button 67 on the operation panel 65 is turned on (E55), the sequence returns to E51, thereby carrying out a full-color copying operation. If the full-color copy button 67 is not turned on at E55, the temperature adjustments of the lower fixing section are continued, and when the temperature adjustments has been completed (E56), the mono-color lamp 76 and the full-color lamp 77 are turned on (E57). These lamps 76 and 77, which are now on, indicate the user of the copying machine that both of the temperature adjustments of the upper and lower fixing sections, respectively associated with the mono-color copying mode and the full-color copying mode, have been completed. When both the mono-color lamp 76 and the full-color lamp 77 are turned on, the copying machine enters the stand-by state.

If the full copy button 67 is not depressed at E44, the temperature adjustments with respect to the lower fixing section are continued, and when the temperature adjustments has been completed (E60), the mono-color lamp 76 is turned on, while the full-color lamp 77 is turned off (E61). The mono-color lamp 76, which is now on, indicates the user of the copying machine that the temperature adjustments of the lower fixing section has been completed. Next, judgement is made as to whether or not the mono-color copy button 66 is again turned on (E62), and if the mono-color copy button 66 is turned on, a mono-color copying operation is carried out (E63). Here, as to the mono-color copying operation, it has been described in detail in embodiment 1; therefore, the explanation thereof is omitted. Thereafter, judgement is made as to whether or not the copying operation has been completed (E64), and if it has been completed, temperature adjustments are applied to the upper and middle heat rollers 41 and 42, which form the upper fixing section (E65). Further, if the mono-color copy button 66 is not turned on at E62, the sequence directly proceeds to E65, thereby starting to apply temperature adjustments to the upper and middle heat rollers 41 and 42, which form the upper fixing section.

During the temperature adjustments of the upper and middle heat rollers 41 and 42, the mono-color lamp 76 is kept on since the temperature adjustments of the lower fixing section have been completed, while the full-color lamp 77 is kept flashing (E66). These lamps 76 and 77 in these states indicate the user of the copying machine that the temperature adjustments of the lower fixing section has been completed and that temperature adjustments are now being applied to the upper fixing section for use in the full-color copying mode. In this state, if the mono-color copy button 66 on the operation panel 65 is turned on (E67), the sequence returns to E63, thereby carrying out a mono-color copying operation. If the mono-color copy button 66 is not turned on at E67, the temperature adjustments of the upper fixing section are continued, and when the temperature adjustments has been completed (E68), the sequence proceeds to E57, and the mono-color lamp 76 and the full-color lamp 77 are turned on. Thus, the copy machine enters the stand-by state.

As described above, the copying machine in accordance with the present embodiment is provided with the following five functions: the fist function—which is furnished by the temperature adjusting means—for applying temperature adjustments to the upper and lower fixing sections; the second function—which is furnished by the adjustment order controlling means—for controlling the temperature adjusting means in such a manner that temperature adjustments are applied to either the first or second fixing section according to an order of priority, and that after the completion of the temperature adjustments, temperature adjustments with respect to the other fixing section is successively carried out; the third function —which is furnished by the display means—for indicating which is undergoing temperature adjustments, the upper fixing section or the lower fixing section; the fourth function—which is furnished by the selection means—for selecting either of the upper and lower fixing sections; and the fifth function—which is furnished by the first precedence-setting means—for setting the order of priority in the adjustment order controlling means in such a manner that, during warm-up time of the copying machine, temperature adjustments are preferentially applied to the fixing section that has been selected through the selection means. Therefore, in the copying machine of the present embodiment, the temperature adjusting means including the heater-lamp control circuit 70 and other devices is switched in such a manner that during warm-up time of the copying machine following the activation of the main power source or following the re-activation of the machine after removing a jammed sheet of paper from the machine, temperature adjustments are preferentially applied to the fixing section associated with the copying mode that has been selected through the mono-color copy button 66 or the full-color copy button 67 on the operation panel 65.

With this arrangement, even in the case where heating to be applied to the three heat rollers 41 through 43 is restricted due to limited power consumption, temperature adjustments are preferentially applied to a desired fixing section during warm-up time of the copying machine. Thus, it is possible to improve the operability of the copying machine as well as to shorten the waiting time required for the temperature adjustments of the fixing section.

Additionally, in the copying machine of the present embodiment, during warm-up time of the copying machine following the activation of the main power source or following the re-activation of the machine after removing a jammed sheet of paper from the machine, temperature adjustments are preferentially applied to the lower fixing section at first, which is associated with the mono-color copying mode; yet, the present invention is not limited to this arrangement, and temperature adjustments may be preferentially applied to the upper fixing section associated with the full-color copying mode.

Moreover, in the copying machine of the present embodiment, the mono-color copy button 66 or the full-color copy button 67 is depressed again upon starting a copying operation; yet, the present invention is not limited to this structure. For example, a copy start button may be installed on the operation panel 65, and after selecting either of the copying modes through the mono-color copy button 66 or the full-color copy button 67, the copy start button may be depressed to start a copying operation.

[EMBODIMENT 9]

Referring to FIGS. 26 through 36, the following description will discuss another embodiment of the present invention. Here, for convenience of explanation, those members that have the same functions and that have been described in embodiment 1 (with reference to FIGS. 2 through 4) are indicated by the same reference numerals and the description thereof is omitted. Further, the explanation of the present embodiment is given with reference to FIGS. 2 through 4 of embodiment 1.

Figure 26:
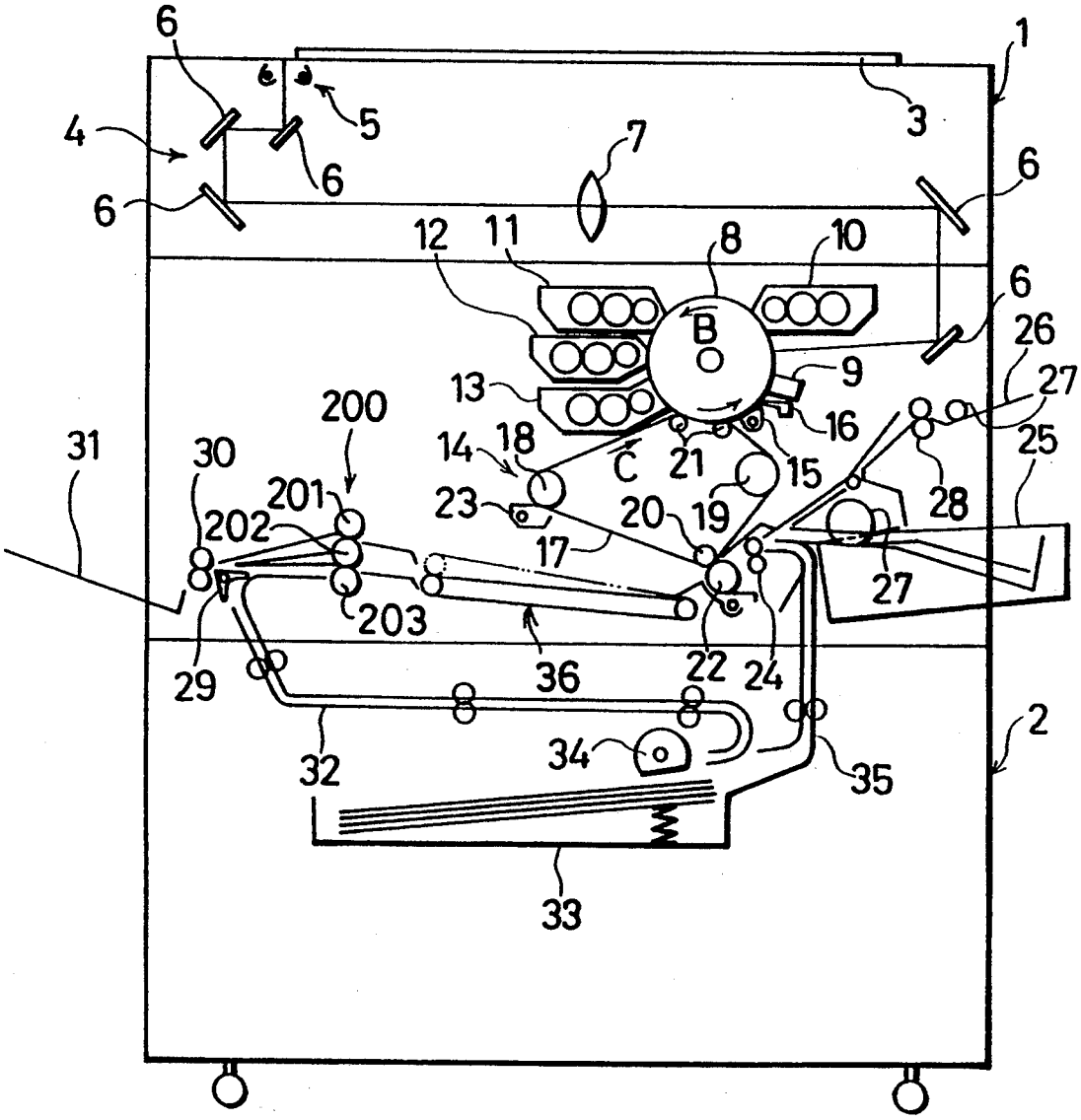
FIGS. 26 through 36 show the ninth embodiment of the present invention.
Figure 27:
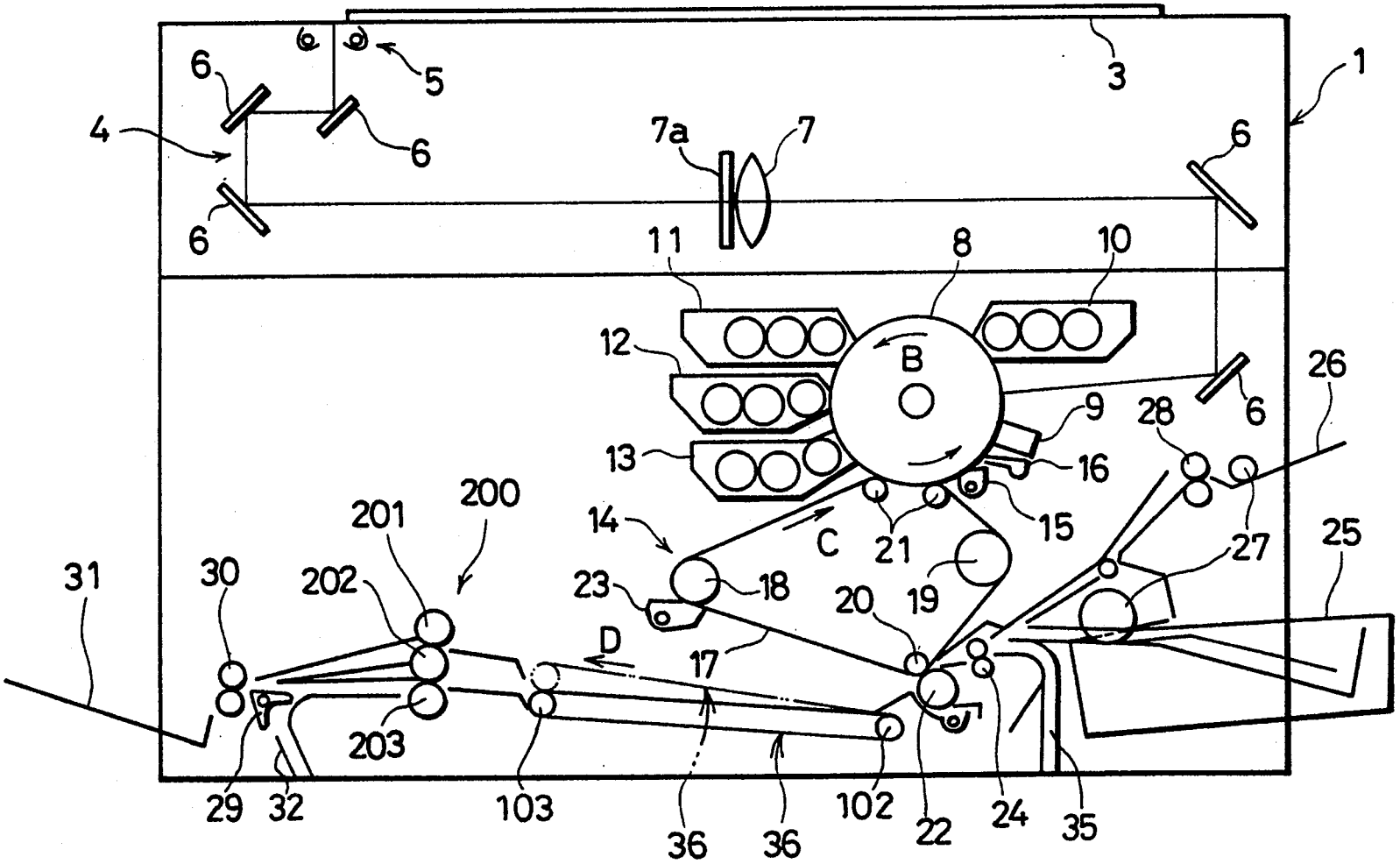

As illustrated in FIGS. 26 through 27, the copying machine of the present embodiment is provided with an intermediate transfer device 14. From the intermediate transfer device 14 toward the paper discharging side, are installed a suction unit 36 for transporting sheets of copy paper, a fixing device 200, a switching gate 29, a discharge roller 30, and a discharge tray 31. The switching gate 29 is designed to switch the transport directions of sheets of copying paper discharged from the fixing device 200 between the directions toward the discharge roller 30 and toward a transport path 32 located below.

Figure 28:
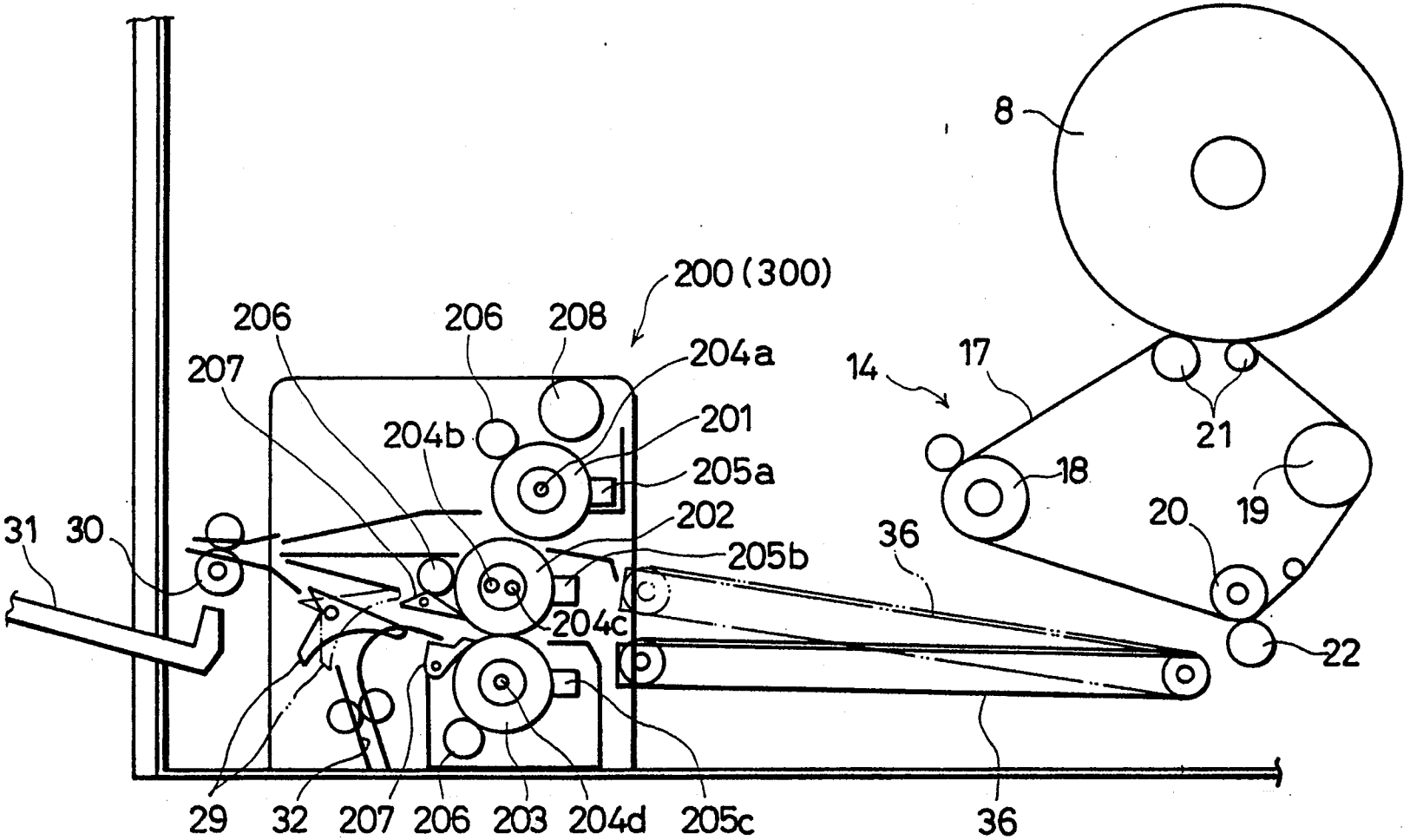

As illustrated in FIG. 28, the fixing device 200 has an upper heat roller 201 as the first fixing roller, a middle heat roller 202 as the second fixing roller, and a lower heat roller 203 as the third fixing roller, which are disposed in parallel with one another in the vertical position. In the present embodiment, a fixing process associated with a full-color copying mode is executed in the upper fixing section (first fixing section) that corresponds to the contact portion between the upper heat roller 201 and the middle heat roller 202, while a fixing process associated with a mono-color copying mode is executed in the lower fixing section (second fixing section) that corresponds to the contact portion between the middle heat roller 202 and the lower heat roller 203.

Accordingly, for example, the upper heat roller 201 has a structure wherein a layer of silicone rubber is formed on the surface of a core cylinder. Here, the silicone rubber has a superior surface-releasing property, and the silicone rubber layer provides a sufficient fixing space, that is, a sufficient nip width, for the fixing operation in a full-color copying mode. The middle heat roller 202 has a structure wherein teflon coating is applied to a core cylinder. The teflon coating has a superior surface-releasing property for black toner and also has an excellent durability. The lower heat roller 203 has a structure wherein a layer of silicone rubber is formed on the surface of a core cylinder. Here, the silicone rubber has a superior surface-releasing property, and the silicone rubber layer provides a sufficient fixing space, that is, a sufficient nip width, for the fixing operation in a mono-color copying mode.

An upper heater lamp **204*a* as a heating means is installed inside the upper heat roller 201. Two heater lamps as a heating means, the first and second heater lamps 204*b* and 204*c*, are installed inside the middle heat roller 202. A lower heater lamp 204*d* as a heating means is installed inside the lower heat roller 203**.

On the periphery of those heat rollers 201 through 203, are installed the following devices: an upper, a middle, and a lower thermistors **205*a* through 205*c* for detecting respective surface temperatures of those heat rollers; and cleaning rollers 206 for cleaning toner and other residues that adhere to the surfaces of the respective heat rollers 201 through 203. Moreover, separation claws 207 are respectively installed on the periphery of the middle and lower heat rollers 202 and 203 so as to separate a sheet of copy paper from the surfaces of the rollers. An oil-coat roller 208, to which silicone oil is impregnated, is disposed on the periphery of the upper heat roller 201**.

In order to provide the above-mentioned upper and lower fixing sections, the copying machine of the present embodiment has a mechanism (fixing-section forming means) which moves the middle heat roller 202 upward and downward so as to allow the middle heat roller 202 to come into contact with and separate from the upper and lower heat rollers 201 and 203. Next, an explanation will be given of this roller-shifting mechanism with reference to FIGS. 29 and 30.

The upper, intermediate and lower heat rollers 201, 202 and 203 are rotatively supported by the upper, middle and lower holders 209,210 and 211—which are respectively installed on both sides of the upper, middle and lower heat rollers 201, 202 and 203—through the respective bearings (not shown). To these upper through lower holders 209 through 211 are respectively fixed the cleaning rollers 206 in such a manner that they are rotatively kept in contact with the corresponding heat rollers 201 through 203. One end portion of each of the holders 209 through 211 on the paper-discharging side is connected to a roller support base 213 by each connecting shaft 212 in such a manner that each of the holders 209 through 211 is permitted to freely pivot on each connecting shaft 212. On the other hand, the other end portions of the upper and lower holders 209 and 211 on the paper-feeding side are urged by tension springs 214 upward and downward respectively. Further, the other end portions of the upper and lower holders 209 and 211 on the paper-feeding side are provided with contacting portions **209*a* and 211*a*. The roller support base 213 is provided with a stopping member 213*a* for regulating the rotation of the upper holder 209 in the downward direction by contacting the contacting portion 209*a* as well as a stopping member 213*b* for regulating the rotation of the lower holder 211 in the upward direction by contacting the contacting portion 211*a***.

The oil-coat roller 208 is rotatively held by one end of a roller holder 215. The roller holder 215 is pivotally connected to the roller support base 213 by a connecting shaft 215*a* at the center thereof. A compression spring 216 and an eccentric cam 217 are installed at the other end of the roller holder 215. The compression spring 216 urges the roller holder 215 so that the roller holder 215 allows the oil-coat roller 208 to rotate in such a direction as to separate from the upper heat roller 201. On the other hand, the eccentric cam 217, which is driven and rotated by an oil-coat roller cam driving mechanism (not shown), permits the roller holder 215 to rotate while resisting the urging force of the compression spring 216 in such a manner that the oil-coat roller 208 is brought into contact with the upper heat roller 201.

The intermediate holder 210 has an opening 210a formed on the paper-feeding side thereof, and an eccentric cam 219 which is integral with a cam shaft 218 is installed inside the opening 210*a*. The cam shaft 218 is supported by a support member (not shown), and rotates at a fixed station. Further, the cam 219 is rotated and stopped by the driving force of a cam driving mechanism (not shown). An intermediate plate 220 is installed between the eccentric cam 219 and the upper edge 210*b* of the opening 210*a*, and the intermediate plate 220 is pivotally connected to the roller support base 213 by a connecting shaft 221 at the paper-discharging side. A screw 222 penetrates through the upper edge 210*b* of the opening 210*a* and holds the intermediate plate 220 at the paper-feeding side thereof. A compression spring 223 is provided between the head of the screw 222 and the upper edge 210*b*. Accordingly, through the rotation of the cam shaft 218, that is, through the rotation of the eccentric cam 219, the intermediate holder 210 is rocked, that is, the middle heat roller 202 is moved upward or downward, thereby coming into contact with or separating from the upper or lower heat roller 201 or 203. Here, the sliding condition between the eccentric cam 219 and the intermediate holder 210 is adjustable by rotating the screw 222.

As to the rotations of the upper through lower heat rollers 201 through 203, the middle heat roller 202 is a driving roller, while the upper and lower heat rollers 201 and 203 are driven rollers, and the middle heat roller 202 is rotated forwardly as well as reversely by a roller driving mechanism (not shown).

Figure 31:
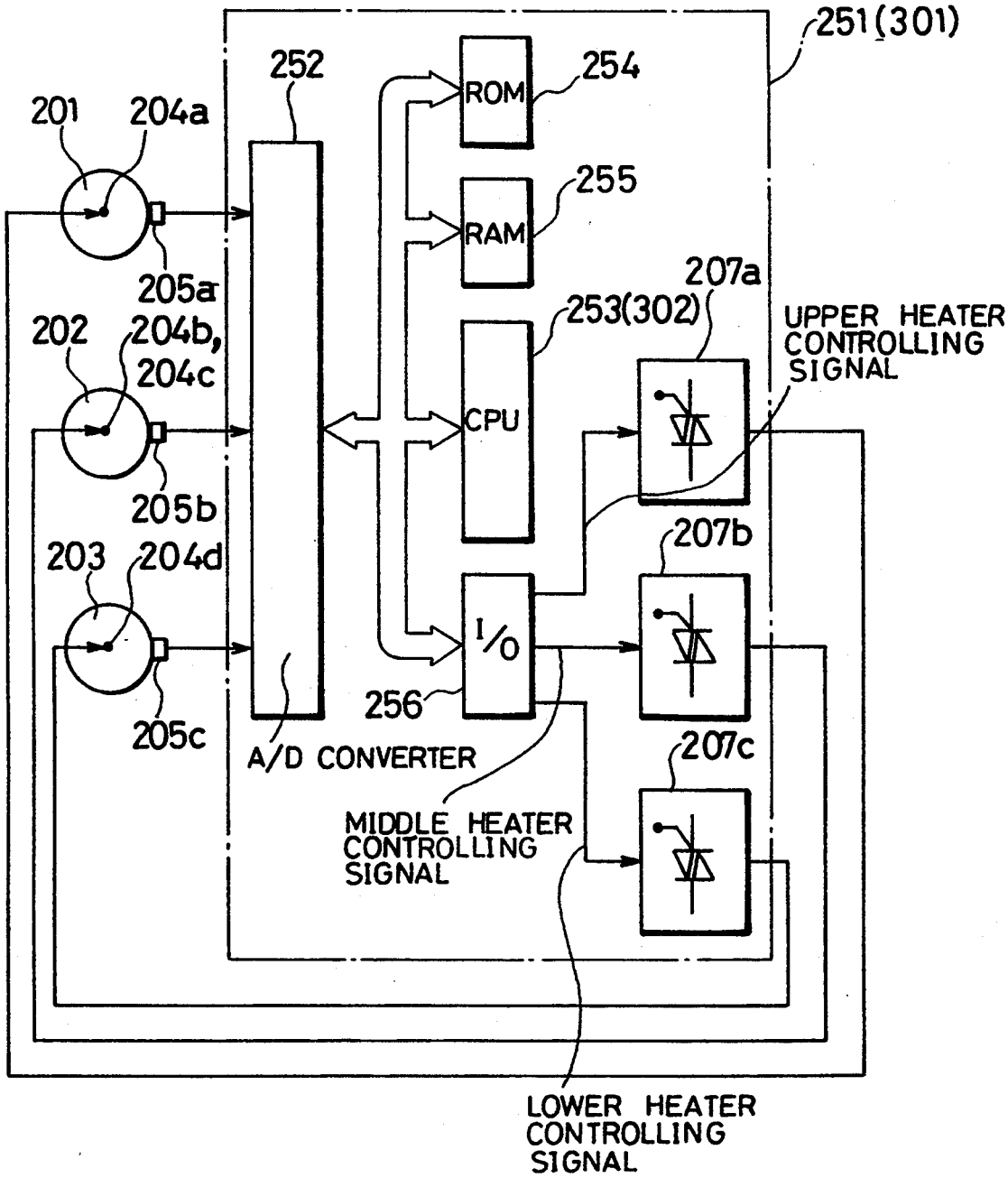

As illustrated in FIG. 31, the copying machine of the present embodiment is provided with a temperature controlling device 251 as a control means for controlling the operations of upper through lower heater lamps 204*a* through 204*d* in response to input signals released from respective thermistors 205*a* through 205*c*. The temperature controlling device 251 is provided with an A/D converter 252 for converting the input signals from the respective thermistors 205*a* through 205*c* into digital signals, a CPU 253, a ROM 254 for storing operation programs of the CPU 253, a RAM 255 for providing memory areas for controlling operations of the CPU 253, an I/O interface 256, and upper through lower heater-lamp control circuits 207*a* through 207*c*—which are installed for use in the respective heater lamps 204*a* through 204*d*—for controlling the upper through lower heater lamps 204*a* through 204*d* in response to controlling signals released from the CPU 253.

Figure 32:
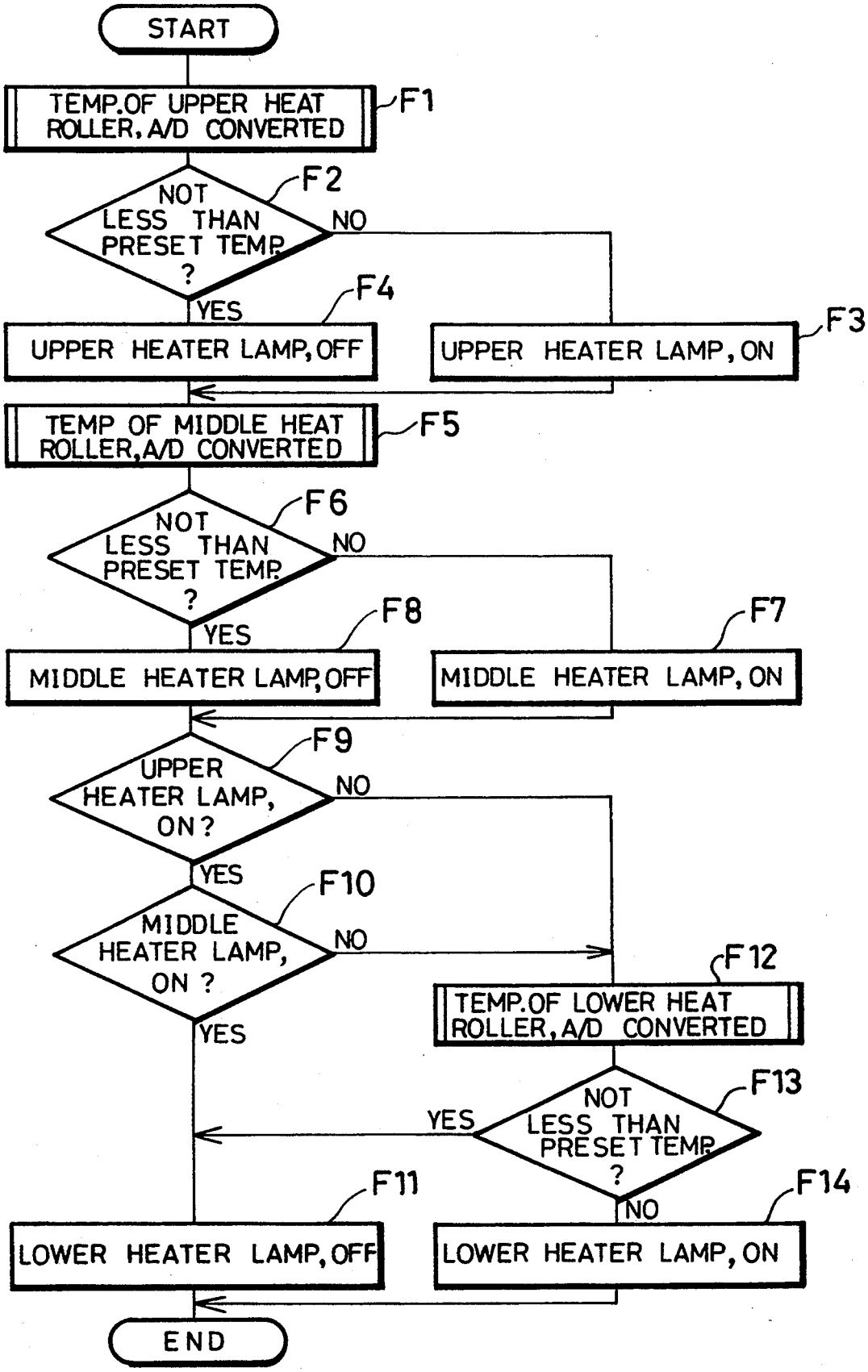
Figure 33:
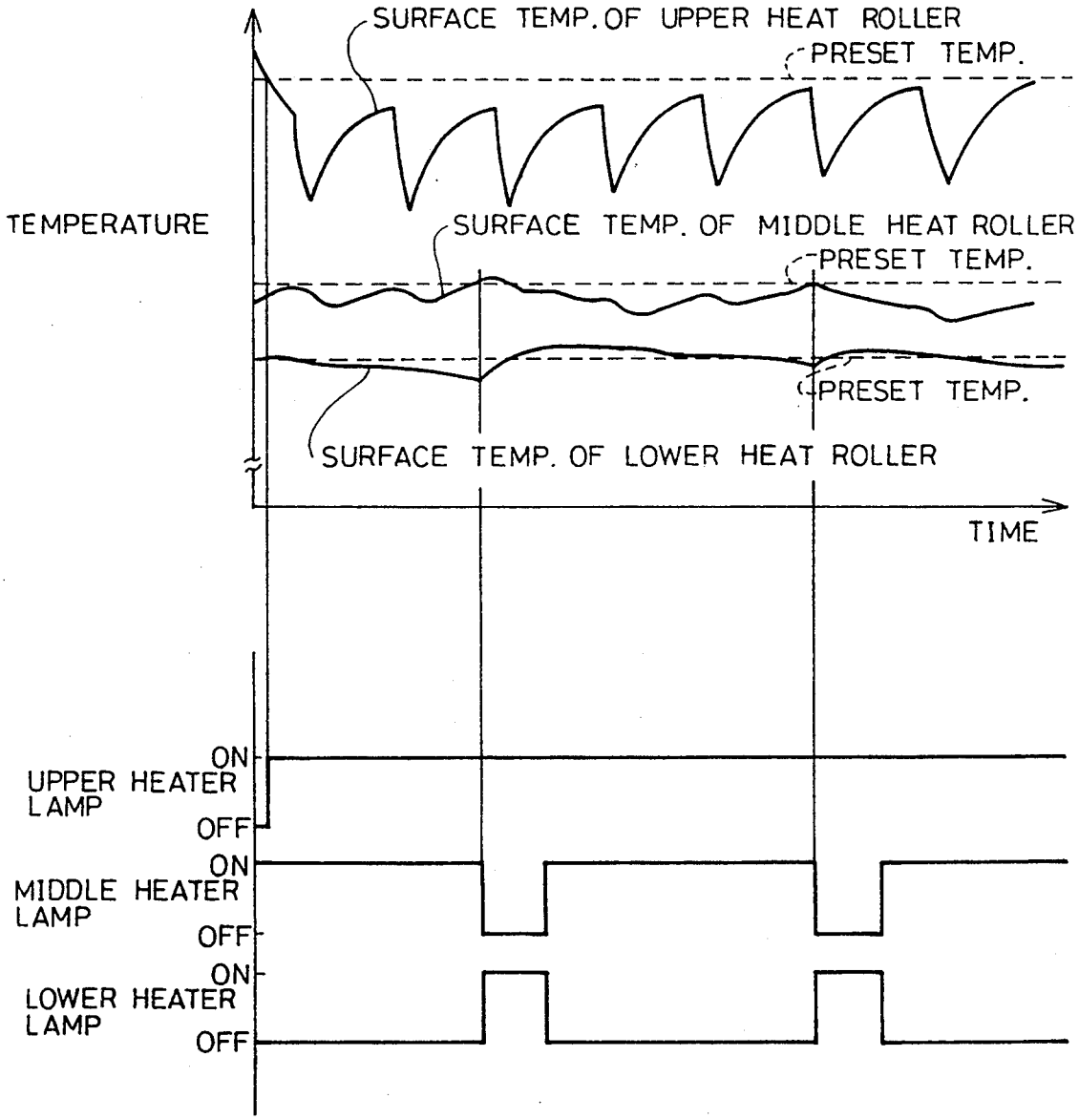

As illustrated in FIGS. 32 and 33, which will be shown later, the temperature controlling device 251 controls the upper through lower heater-lamp control circuits 207*a* through 207*c* in the following manner: During a full-color copying mode, the temperature controlling device 251 turns on the upper heater lamp 204*a* and the first and second middle heater lamps 204*b* and 204*c*, and monitors the surface temperatures of the upper heat roller 201 and the middle heat roller 202 according to inputs from the respective thermistors 205*a* through 205*c*. When the surface temperatures exceed any of the respective preset temperatures, it turns off the corresponding ones of the heater lamps 204*a*, 204*b* and 204*c* for predetermined time intervals. If at least either the upper heater lamp 204*a* or the group of the first and second middle heater lamps 204*b* and 204*c* is turned off, the lower heater lamp 204*d* is turned on for a period of the off-state.

Likewise, the temperature controlling device 251 controls the upper through lower heater-lamp control circuits 207*a* through 207*c* in the following manner: During a mono-color copying mode, the temperature controlling device 251 turns on the first and second middle heater lamps 204*b* and 204*c* as well as the lower heater lamp 204*d*, and monitors the surface temperatures of the middle heat roller 202 and the lower heat roller 203. When the surface temperatures exceed any of the respective preset temperatures, it turns off the corresponding ones of the heater lamps 204*b*, 204*c* and 204*d* for predetermined time intervals. If at least either the group of the first and second middle heater lamps 204*b* and 204*c* or the lower heater lamp 204*d* is turned off, the upper heater lamp 204*a* is turned on for a period of the off-state.

Further, during the stand-by state with the main power source turned on, the temperature controlling device 251 provides the same control as it does when executing the copying mode that is preferentially set between the full-color copying mode and the mono-color copying mode. Additionally, the above-mentioned preset temperatures are respectively set for the heat rollers 201 through 203 in order to control the surface temperatures of the heat rollers 201 through 203 so as to have appropriate temperatures. More specifically, the above-mentioned preferential setting is to specify a type of copying mode in order to make the fixing device ready for starting a copying operation either in the full-color copying mode or in the mono-color copying mode.

In the copying machine having the above-mentioned arrangement, an explanation will be given of a full-color copying operation hereinbelow.

Figure 30:
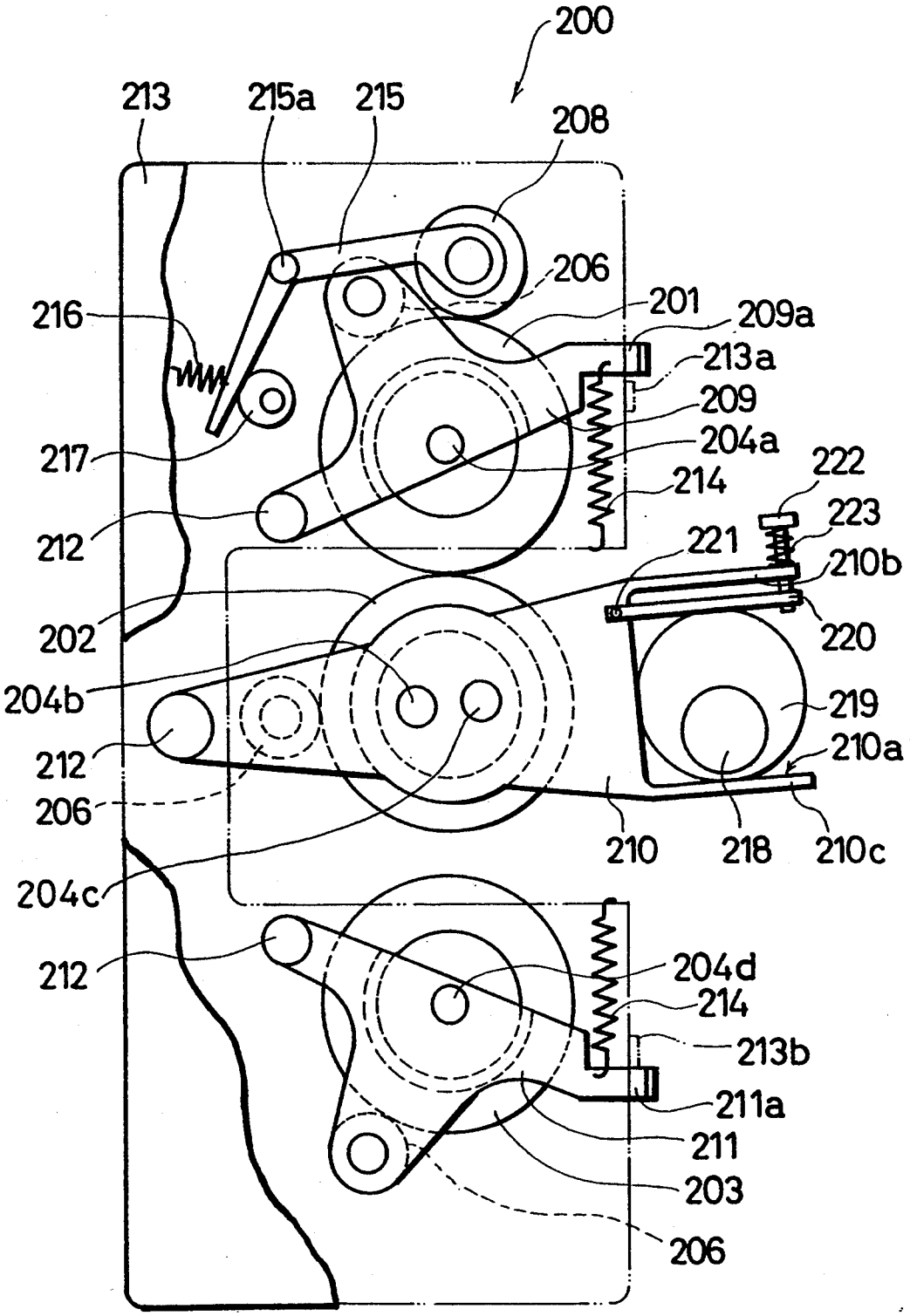

After a full-color copy selection key (not shown) has been depressed, when a copy start button (not shown) is depressed, the intermediate holder 210 is driven upward by the eccentric cam 219 upon contacting its portion having the greatest eccentric distance, and the middle heat roller 202 is thus pressed against the upper heat roller 201, as illustrated in FIG. 30. Further, driven by the eccentric cam 217, the oil-coat roller 208 is pressed against the upper heat roller 201.

In the above-mentioned state, the upper holder 209, which has been pushed by the middle heat roller 202, is slightly rotated counterclockwise; therefore, the upper heat roller 201 is held at a slightly higher position in comparison with the position where it was kept apart from the middle heat roller 202. On the other hand, the lower holder 211 is rotated counterclockwise by the tension spring 214; however, the rotation is regulated by the contact between the contacting portion 211*a* and the stopping member 213*b*, and the lower heat roller 203 is thus held apart from the middle heat roller 202.

Moreover, driven by the roller driving mechanism, the middle heat roller 202 is rotated counterclockwise, and following this movement, the upper heat roller 201 is rotated counterclockwise, while the suction unit 36 is held at the higher station.

As illustrated in FIG. 26, when a yellow toner image, a magenta toner image and a cyan toner image have been transferred on the transferring belt 17 through the processes described in detail in the aforementioned embodiment 2, the second transferring roller 22, which has been kept apart from the transferring belt 17 during the foregoing processes, is pressed against the transferring belt 17. Then, by applying to the second transferring roller 22 a minus voltage that is higher than the surface voltage of the transferring belt 17, a three-layered toner image on the transferring belt 17 is transferred onto a sheet of copy paper that has been transported from the feeding cassette 25 or the feeding tray 26 through the resist roller 24.

The sheet of copy paper bearing the toner image is transported to a fixing device 200 by the suction unit 36. At this time, the suction unit 36 is held at the higher station. Accordingly, the sheet of copy paper is transported to an upper fixing section that is formed at the contact section between the upper heat roller 201 and the middle heat roller 202. At the upper fixing section, the three-layered color toner image on the sheet of copy paper is heated by the upper and intermediate rollers 201 and 202, and melts down by heat, thereby being fixed on the sheet of copy paper. In this case, silicone oil is supplied to the upper heat roller 201 from the oil-coat roller 208; therefore, it is possible to prevent the offset of the toner image onto the heat roller 201 and to impart gloss to the full-color toner image on the sheet of copy paper. The sheet of copy paper, which has been released from the upper fixing device 200, is ejected onto the discharge tray 31 by the discharge roller 30.

Next, in the copying machine of the present embodiment, an explanation will be given of a mono-color copying operation.

Figure 29:
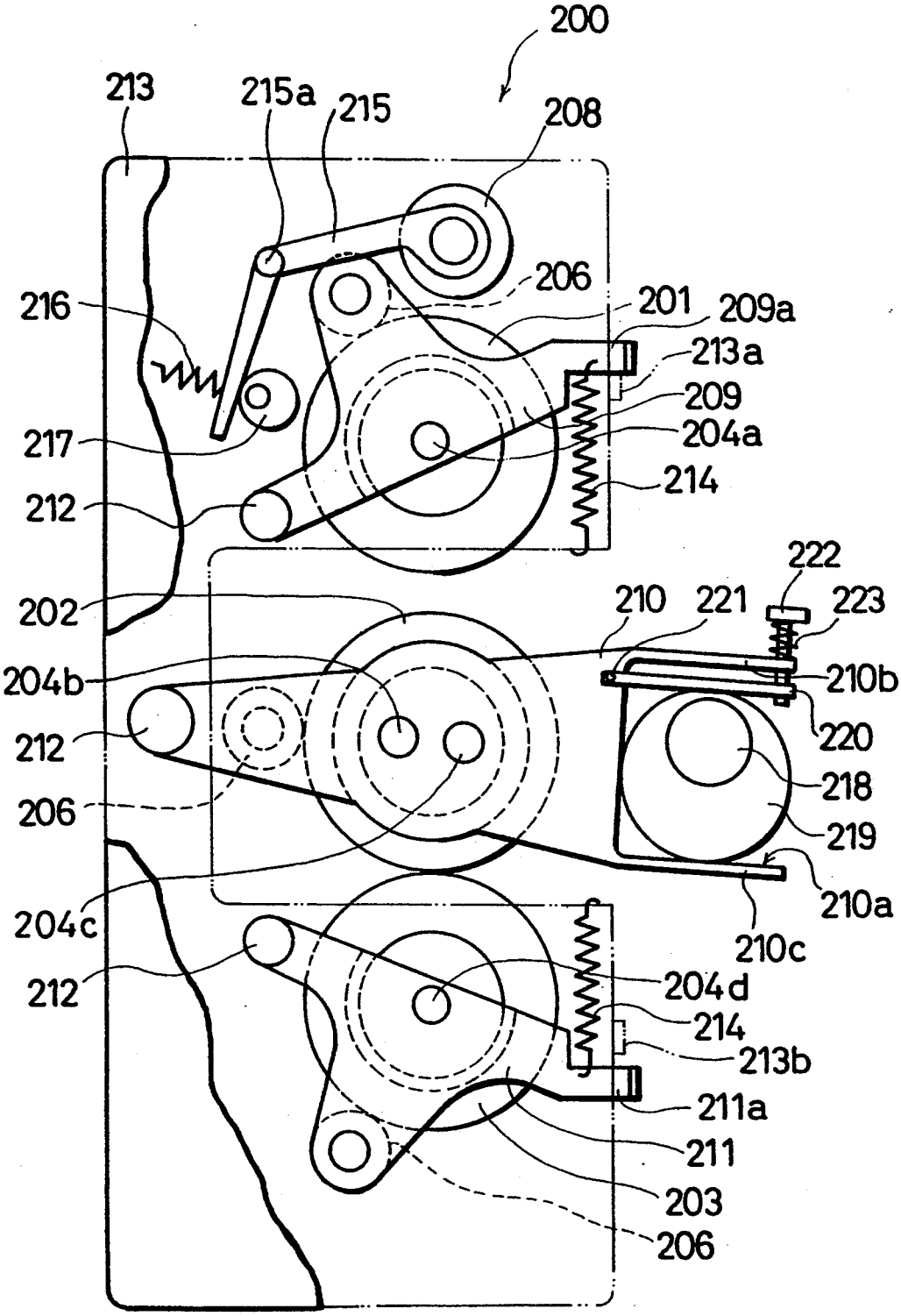

After a mono-color copy selection key (not shown) has been depressed, when a copy start button is depressed, the intermediate holder 210 is driven downward by the eccentric cam 219 upon contacting its portion having the greatest eccentric distance, and the middle heat roller 202 is thus pressed against the lower heat roller 203, as illustrated in FIG. 29, while the upper heat roller 201 is separated from the middle heat roller 202. Further, the eccentric cam 217 is rotated 180° from the state shown in FIG. 30, and the oil-coat roller 208 is pushed by the compression spring 216, and thus permitted to separate from the upper heat roller 201.

Moreover, driven by the roller driving mechanism, the middle heat roller 202 is rotated clockwise, and following this movement, the lower heat roller 203 is rotated counterclockwise, while the suction unit 36 is held at the lower station.

Next, the surface of the photoreceptor 8 is uniformly charged by the main charger 9, and a scanning is executed on an original document placed on the document platen 3 by the exposure-use optical system 4. Without using the color separation filter and the slit, the reflected light from the original document is directed onto the surface of the photoreceptor 8 by the exposure-use optical system 4, and a latent image is thus formed on the photoreceptor 8. Thereafter, the latent image is developed in the black developer tank 10. The black toner image thus formed is transferred onto the transferring belt 17, and then transferred onto a sheet of copy paper.

The sheet of copy paper bearing the toner image is transported by the suction unit 36 to the lower fixing section that is formed at the contact section between the middle heat roller 202 and the lower heat roller 203, where the toner image is fixed onto the sheet of copy paper.

Here, in the case of a one-sided copying operation, the switching gate 29 is actuated so that the sheet of copy paper is carried toward the discharge roller 30; therefore, the sheet of copy paper, which has been discharged from the fixing device 200, is ejected onto the discharge tray 31 by the discharge roller 30.

On the contrary, in the case of a two-sided copying operation, the switching gate 29 is actuated so that the sheet of copy paper is carried toward the transport path 32; therefore, the sheet of copy paper, which has been discharged from the discharge roller 30, is ejected onto the intermediate tray 33 through the transport path 32. Thereafter, the sheet of copy paper placed on the intermediate tray 33 is sent to the transport path 35 by the feeding roller 34, and reversed while travelling along the transport path 35 to reach the resist roller 24.

Successively, the photoreceptor 8 is again charged by the main charger 9, and a scanning is executed on the original document—which is now placed on the document platen 3 with the back side up—by the exposure-use optical system 4. Thereafter, with the same processes as those applied to the front side of the sheet of copy paper, a toner image is transferred and fixed onto the back side of the sheet of copy paper in the lower fixing section. The sheet of copy paper is then directed to the discharge roller 30 by the switching gate 29, and ejected onto the discharge tray 31 by the discharge roller 30.

The following description will discuss the controlling operation of the temperature controlling device 251 that is applied to the upper through lower heat rollers 201 through 203 in the case of the full-color copying mode. In this case, changes in the surface temperatures of the upper through lower heat rollers 201 through 203 and the controlling operation, which is applied to the upper through lower heat rollers 201 through 203 in response to the changes in the surface temperatures thereof, are illustrated by FIG. 33. Further, flow charts for the controlling operation is shown in FIG. 32. Additionally, in the graph for showing the surface temperatures of the upper through lower heat rollers 201 through 203, minute variations are seen in the surface temperatures. These minute variations are caused by respective fixing operations that successively take place in the course of a copying operation.

First, an input released from the upper thermistor **205*a*, which is installed on the upper heat roller 201, is A/D converted (F1), and in response to this signal, the CPU 253 judges whether or not the upper heat roller 201 has a surface temperature of not less than a preset temperature (F2). If the judgement is "NO", the upper heater lamp 204*a* is turned on (F3), and the sequence proceeds to F5; whereas if "YES", the upper heater lamp 204*a*** is turned off (F4) and the sequence proceeds to F5.

Next, at F5 an input released from the middle thermistor **205*b*, which is installed on the middle heat roller 202, is A/D converted, and in response to this signal, the CPU 253 judges whether or not the middle heat roller 202 has a surface temperature of not less than a preset temperature (F6). If the judgement is "NO", the first and second middle heater lamps 204*b* and 204*c* are turned on (F7), the sequence proceeds to F9; whereas if "YES", the first and second middle heater lamps 204b and 204c** are turned off (F8) and the sequence proceeds to F9.

Here, if the upper heater lamp 204a is on (F9) and the first and second middle heater lamps 204b and 204c are on (F10), the lower heater lamp 204d is turned off (F11).

On the other hand, if the upper heater lamp 204a is off at F9, and if the first and second middle heater lamps 204b and 204c are off at F10, an input released from the lower thermistor 205c, which is installed on the lower heat roller 203, is A/D converted (F12), and the CPU 253 judges whether or not the lower heat roller 203 has a surface temperature of not less than a preset temperature (F13). If the judgement is "NO", the lower heater lamp 204d is turned on (F14); whereas if "YES", the sequence proceeds to F11, and the lower heater lamp 204d is turned off. Thereafter, during the full-color copying operation, the above-mentioned sequence is repeated.

Here, as illustrated in FIG. 33, the periods of OFF-time for the upper heater lamp 204a as well as the first and second middle heater lamps 204b and 204c are set to appropriate periods of time respectively.

Figure 34:
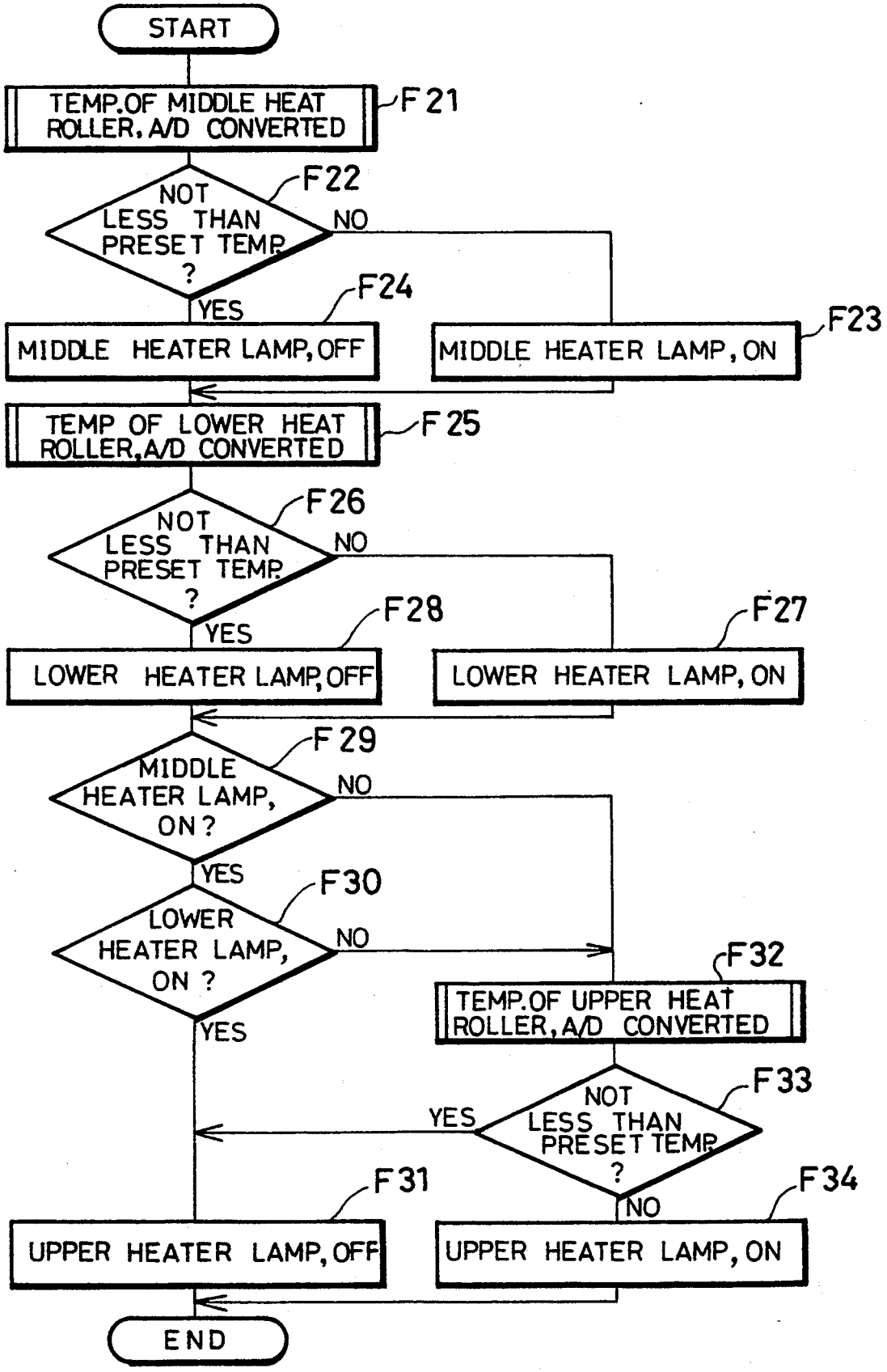

Referring to FIG. 34, the following description will discuss the controlling operation of the temperature controlling device 251 that is applied to the upper through lower heat rollers 201 through 203 in the case of the mono-color copying mode.

First, an input released from the middle thermistor 205b, which is installed on the middle heat roller 202, is converted into a digital signal by the A/D converter 252 (F21), the CPU 253 judges whether or not the middle heat roller 202 has a surface temperature of not less than a preset temperature (F22). If the judgement is "NO", the first and second middle heater lamps 204b and 204c are turned on (F23), and the sequence proceeds to F25, whereas if "YES", the first and second middle heater lamps 204b and 204c are turned off (F24) and the sequence proceeds to F25.

Next, at F25 an input released from the lower thermistor 205c, which is installed on the lower heat roller 203, is A/D converted, and the CPU 253 judges whether or not the lower heat roller 203 has a surface temperature of not less than a preset temperature (F26). If the judgement is "NO", the lower heater lamp 204d is turned on (F27), and the sequence proceeds to F29; whereas if "YES", the lower heater lamps 204d is turned off (F28) and the sequence proceeds to F29.

Here, if the first and second middle heater lamps 204b and 204c are on (F29) and the lower heater lamp 204d is also on (F30), the upper heater lamp 204a is turned off (F31).

On the other hand, if the first and second middle heater lamps 204b and 204c are off at F29, or if the lower heater lamp 204d is off at F30, an input released from the upper thermistor 205a, which is installed on the upper heat roller 201, is A/D converted (F32), and the CPU 253 judges whether or not the upper heat roller 201 has a surface temperature of not less than a preset temperature (F33). If the judgement is "NO", the upper heater lamp 204a is turned on (F34); whereas if "YES", the sequence proceeds to F31, and the upper heater lamp 204a is turned off. Thereafter, during the mono-color copying operation, the above-mentioned sequence is repeated.

Figure 35:
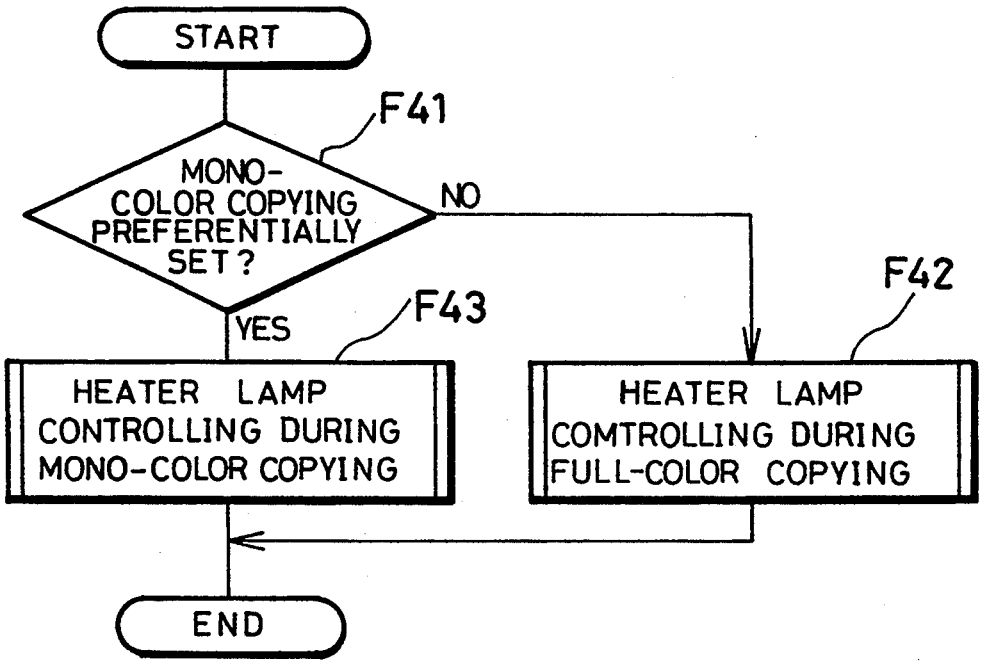

Moreover, for example, after completion of a full-color copying operation or a mono-color copying operation, if the power source switch is still kept on, the temperature controlling device 251 carries out a controlling operation as shown in FIG. 35. In this case, first, judgement is made as to whether or not the mono-color copying mode is preferentially set (F41). If the judgement is "NO", the heater lamp controlling operation in the full-color copying mode is carried out according to F1 through F14 as is shown in FIG. 32 (F42). On the other hand, the judgement is "YES" at F41, the heater lamp controlling operation in the mono-color copying mode is carried out as is shown in FIG. 34 (F43). Further, in the case where the mono-color copying operation is preferentially set, changes in the surface temperatures of the upper through lower heat rollers 201 through 203 and the controlling operation—which is applied to the upper through lower heat rollers 201 through 203 in response to the changes in the surface temperatures thereof—are illustrated, for example, by FIG. 36.

Figure 36:
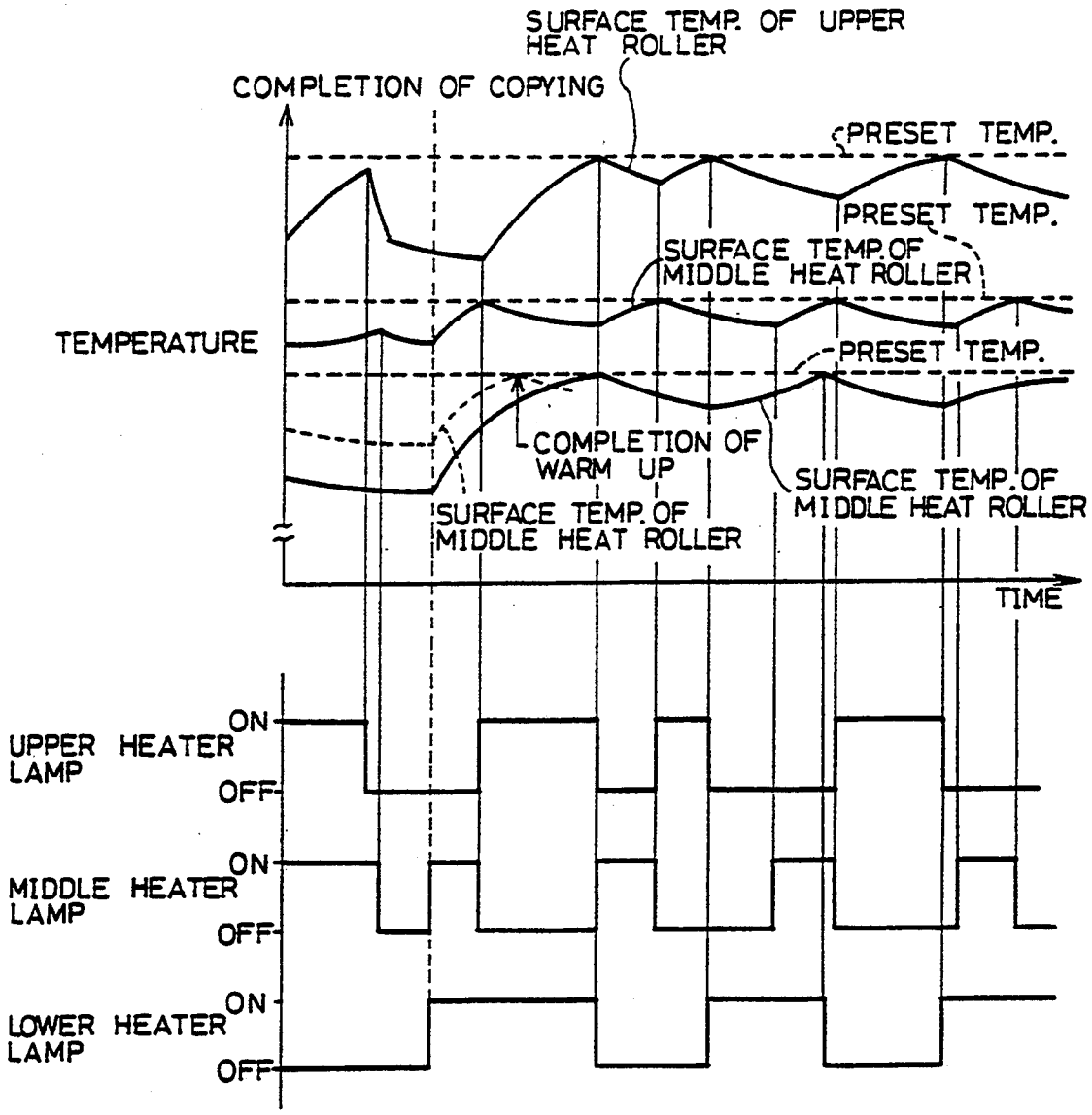

Additionally, the surface temperature of the lower heat roller that is indicated by a broken line in FIG. 36 shows its variation during the stand-by state following the controlling operations shown in FIGS. 32 and 33 which have been carried out until the completion of a copying operation, shown in FIG. 36; this graph indicates that a period of time required for the warm-up of the lower heat roller 203 after the start of a heating operation on the lower heat roller 203 can be shortened.

As described above, the copying machine of the present embodiment has a function—which is furnished by the third control means—for providing temperature adjustments in the following manner: Fixing rollers constituting either of the upper and lower fixing sections are heated, and when the temperatures of the fixing rollers have exceeded respective preset temperatures, the heating operation of the fixing rollers is stopped. During a period of time when the temperatures of the fixing rollers are kept above the preset temperatures, the temperature adjustments are applied to the rest of the fixing rollers. With this arrangement, even if one of the fixing sections is continuously used, temperature adjustments are appropriately applied to fixing rollers constituting the other fixing section which has not been used. Accordingly, even in the case of using the other fixing section after switching the fixing sections to be used, a period of time required for the warm-up of the fixing rollers that have not been used is shortened; this results in shortening of the waiting time required after switching the fixing sections to be used.

[EMBODIMENT 10]

Figure 37:
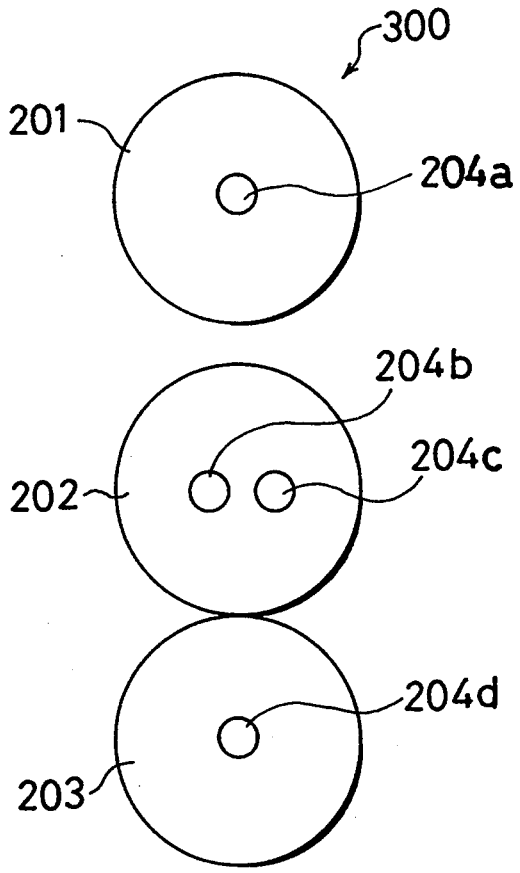
FIGS. 37 through 39 show the tenth embodiment of the present invention.
Figure 38:
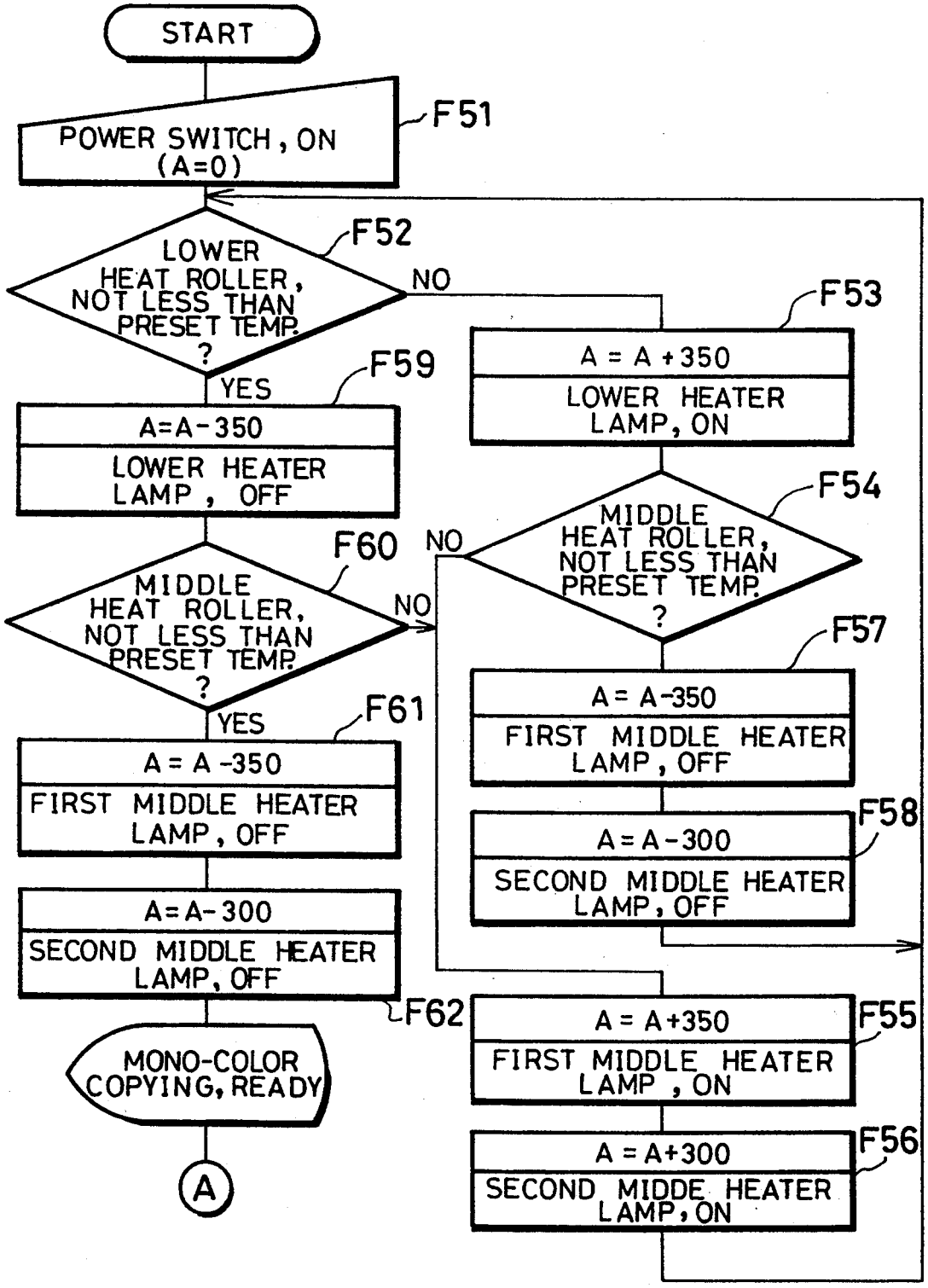
Figure 39:
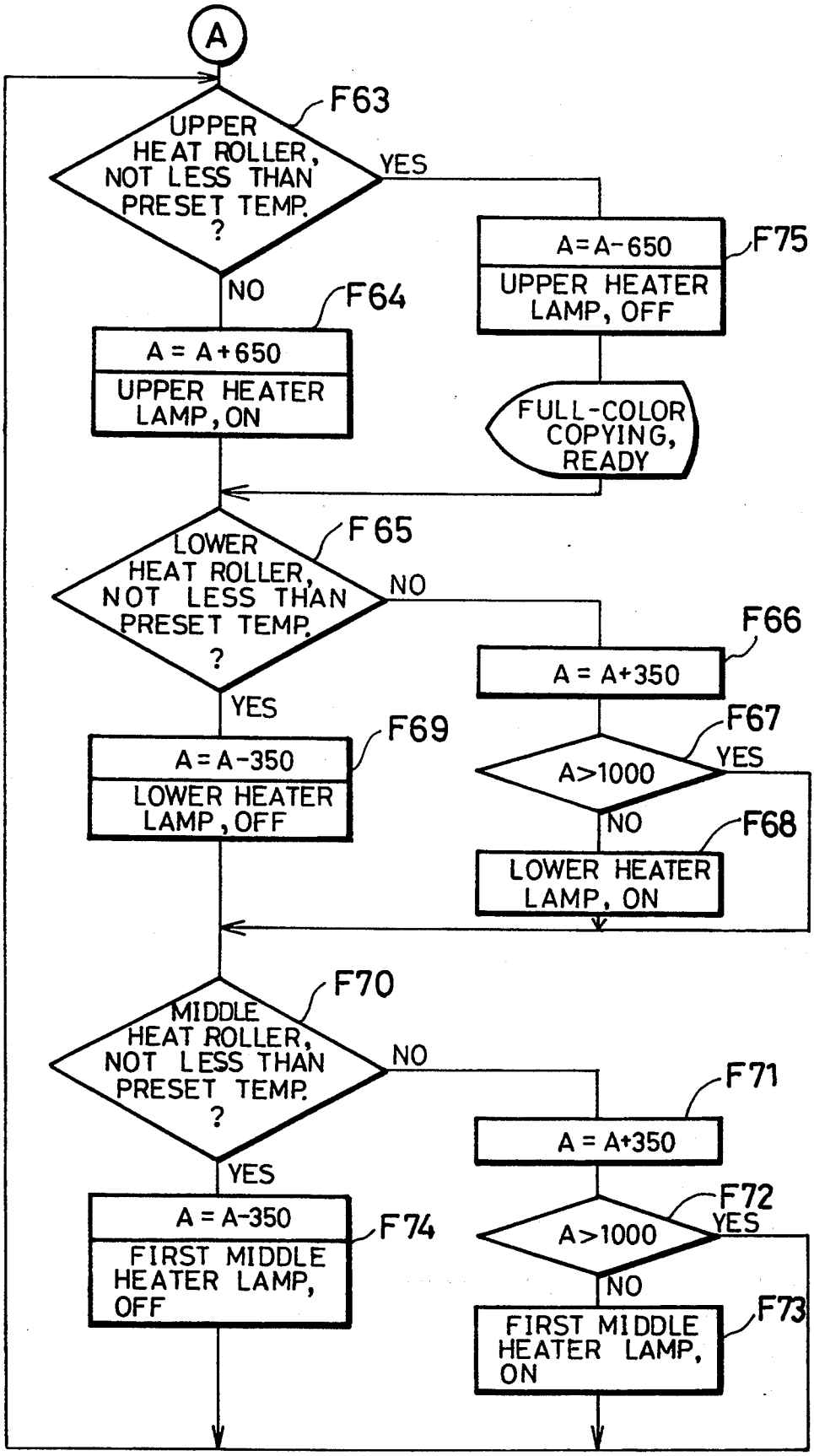

Referring to FIGS. 37 through 39, the following description will discuss another embodiment of the present invention. Here, for convenience of explanation, those members that have the same functions and that has been described in embodiment 9 (with reference to FIGS. 26 through 30) are indicated by the same reference numerals and the description thereof is omitted. Further, the explanation of the present embodiment is given with reference to FIGS. 26 through 30 of embodiment 9.

A copying machine in accordance with the present embodiment is provided with a fixing device 300 that has the same structure as the aforementioned fixing device 200 shown in FIG. 28. The respective power consumptions of the upper, the first intermediate, the second middle and the lower heater lamps 204a through 204d, which function as heating means illustrated in FIG. 37, are shown as follows: the upper heater lamp 204*a* has 650 W; the first middle heater lamp 204*b* has 350 W; the second middle heater lamp 204*c* has 300 W; and the lower heater lamp 204*d* has 350 W. In the copying machine of the present embodiment, the total electric energy, which can be simultaneously supplied to these heater lamps 204*a* through 204*d*, is 1000 W.

Further, the copying machine of the present embodiment is provided with a temperature controlling device 301 which functions as a control means shown in FIG. 31. The temperature controlling device 251 for controlling the upper through lower heater-lamp control circuits 207*a* through 207*c* is designed to preferentially provide warm-up operations to the middle and lower heat rollers 202 and 203, which constitute the lower fixing section for use in the mono-color copying mode that is generally used more frequently.

Therefore, the temperature controlling device 251 controls the upper through lower heater-lamp control circuits 207*a* through 207*c* in the following manner: When the power source switch is turned on, the first and second middle heater lamps 204*b* and 204*c* as well as the lower heater lamp 204*d* are first turned on. The surface temperatures of the middle heat roller 202 and the lower heat roller 203 are monitored, and when the surface temperatures of these heat rollers have exceed preset temperatures, that is, when the warm-up operations of the middle and lower heat rollers 202 and 203 have been completed, the first and second heat rollers 204*b* and 204*c* as well as the lower heat roller 204*d* are turned off.

Further, when the first and second middle heater lamps 204*b* and 204*c* as well as the lower heater lamp 204*d* are turned off, the temperature controlling device 251 controls the temperature of the upper heat roller 201 in such a manner that when the surface temperature of the upper heat roller 201 has reached a preset temperature, the surface temperature of the upper heat roller 201 is maintained at an appropriate temperature by turning off the upper heater lamp 204*a*. Further, in this state, the temperature controlling device 251, which is carrying out the temperature controlling operation with respect to the upper heat roller 201, also applies the same temperature controlling operation with respect to the middle and lower heat rollers 202 and 203 in order to maintain the warm-up states of the heat rollers 202 and 203. This temperature controlling operation is performed within the total electric energy (1000 W) that can be simultaneously supplied to the heater lamps 204*a* through 204*d*.

Additionally, in the case where the warm-up operations of the upper and middle heat rollers 201 and 202, which constitute the upper fixing section for use in the full-color copying mode, are preferentially performed, the temperature controlling device 251 first applies the warm-up operations to the upper and middle heat rollers 201 and 202. Then, while carrying out a temperature controlling operation with respect to the upper heat roller 201, the temperature controlling device 251 also applies the same temperature controlling operation with respect to the upper and middle heat rollers 201 and 202. Similarly, this temperature controlling operation is performed within the total electric energy (1000 W) that can be simultaneously supplied to the heater lamps 204*a* through 204*d*.

In the above-mentioned arrangement, an explanation will be given of the controlling operations of the temperature controlling device 251 to be applied to the upper through lower heat rollers 201 through 203 with reference to flow charts shown in FIGS. 38 and 39. Here, the variable A represents the total watts of the upper through lower heater lamps 204*a* through 204*d* that are on, and addition and subtraction are made with respect to the total watts depending on the turning on and off of the heater lamps 204*a* through 204*b*.

When the power source switch is turned on (F51), judgement is made as to whether the lower heat roller 203 has a surface temperature of not less than a preset temperature (F52). If the judgement is "NO", the lower heater lamp 204*d* is turned on (F53). Then, judgement is made as to whether or not the middle heat roller 202 has a surface temperature of not less than a preset temperature (F54). If the judgement is "NO", the first middle heater lamp 204*b* is turned on (F55) and the second middle heater lamp 204*c* is turned on (F56), and the sequence then returns to F52.

On the other hand, if the surface temperature of the middle heat roller 202 is not less than the preset temperature at F54, the first middle heater lamp 204*b* is turned off (F57) and the second middle heater lamp 204*c* is turned off (F58), and the sequence then returns to F52.

Further, if the surface temperature of the lower heat roller 203 is not less than the preset temperature at F52, the lower heater lamp 204*d* is turned off (F59), and judgement is made as to whether or not the middle heat roller 202 has a surface temperature of not less than a preset temperature (F60). If the judgement is "NO", the sequence returns to F55; whereas if "YES", the first middle heater lamp 204*b* is turned off (F61) and the second middle heater lamps 204*c* is turned off (F62). Thus, the warm-up operation of the fixing section 300 has been completed in the mono-color copying mode, that is, the copying machine is ready for a mono-color copying operation, thereby displaying the ready-state on a display panel, not shown.

Thereafter, in order to warm up the upper heat roller 201 for use in a full-color copying mode, judgement is made as to whether or not the upper heat roller 201 has a surface temperature of not less than a preset temperature at F63, shown in FIG. 39 (F63). If the judgement is "NO", the upper heater lamp 204*a* is turned on (F64).

Next, judgement is made as to whether or not the lower heat roller 203 has a surface temperature of not less than the preset temperature (F65), and if it is less than the preset temperature, the variable A is operated with respect to the case where the upper heater lamp 204*d* is on (F66). If the value is not less than 1000 (F67), the sequence proceeds to F70 without turning on the lower heater lamp 204*d*, while if the value is less than 1000, the lower heater lamp 204*d* is turned on (F68), and the sequence proceeds to F70.

Further, if the surface temperature of the lower heat roller 203 is not less than the preset temperature at F65, the lower heater lamp 204*d* is turned off (F69). Next, judgement is made as to whether or not the middle heat roller 202 has a surface temperature of not less than the preset temperature (F70), and if it is less than the preset temperature, the variable A is operated with respect to the case where the first middle heater lamp 204*b* is on (F71). If the value is not less than 1000 (F72), the sequence proceeds to F63 without turning on the first middle heater lamp 204*b*, while if the value is less than 1000, the first middle heater lamp 204*b* is turned on (F73), and the sequence proceeds to F63.

Thereafter, at F63 judgement is again made as to whether or not the upper heat roller 201 has a surface temperature of not less than the preset temperature, and if the judgement is "YES", the upper heater lamp 204*a* is turned off (F75). Thus, the fixing section 300 is ready for a full-color copying operation, thereby displaying the ready-state on the display panel. Then, the sequence returns to F65. Successively, the processes F63 through F75 are repeated.

As described above, the copying machine of the present embodiment has a first through third heating means for heating the upper through lower fixing rollers by applying electric power, and is provided with a function —which is furnished by the fourth control means—for providing temperature adjustments in the following manner: Electric power is applied to the first and second or the second and third heating means for a pair of fixing rollers constituting either one of the first and second fixing sections, and after the temperatures of the pair of fixing rollers have exceeded respective preset temperatures, electric power is preferentially applied to the first or the third heating means for the rest of the fixing rollers, while maintaining the pair of fixing rollers at the preset temperature by controlling electric power to be applied to the first and second or the second and third heating means for the pair of the fixing rollers constituting the relevant fixing section, within the total electric energy that can be simultaneously supplied to all the heating means. Therefore, the copying machine of the present embodiment first applies warm-up operations to, for example, middle and lower heat rollers 202 and 203 for use in the mono-color copying mode. The copying machine then applies a warm-up operation to the rest of the heat rollers, or the upper heat roller 201 for use in the full-color copying mode, and simultaneously provides temperature controls on the middle and lower heat rollers 202 and 203 in order to maintain them at the preset temperatures, while monitoring the surface temperatures of the middle and lower heat rollers 202 and 203, which have already been subjected to the warm-up operations. Here, the temperature controlling operation is performed within the total electric energy that can be simultaneously supplied to the upper through lower heat rollers 201 through 203 (up to 350 W in the above example).

With this arrangement, whichever copying mode is selected between the mono-color copying mode and the full-color copying mode, a corresponding fixing operation is readily started, and electric power to be supplied to the fixing device 300 can be utilized most effectively.

[EMBODIMENT 11]

Referring to FIGS. 40 through 45, the following description will discuss another embodiment of the present invention. Here, for convenience of explanation, those members that have the same functions and that have been described in embodiment 1 and embodiment 9 (with reference to FIGS. 3 and 28) are indicated by the same reference numerals.

Figure 40:
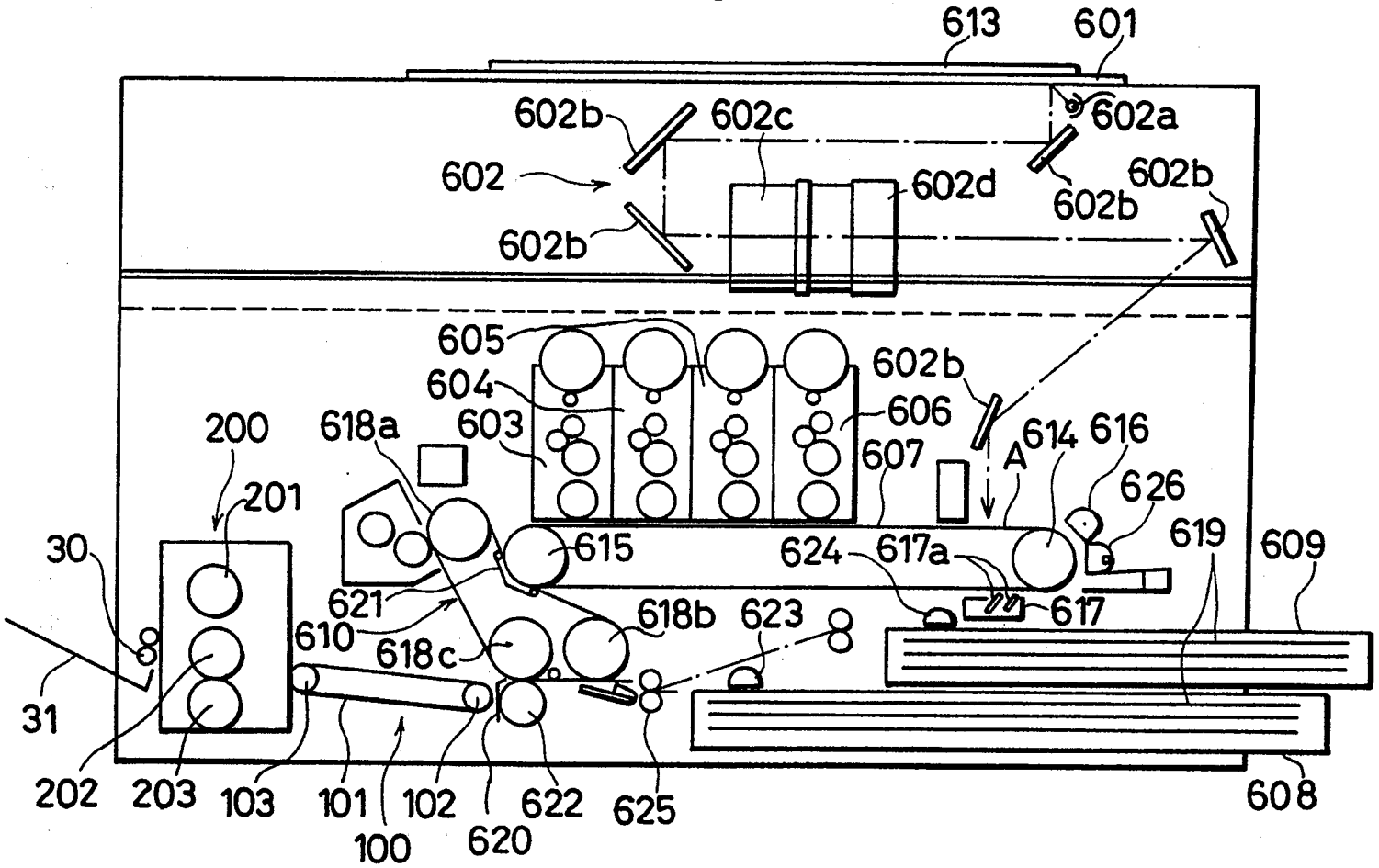
FIGS. 40 through 45 show the eleventh embodiment of the present invention.

As illustrated in FIG. 40, a copying machine in accordance with the present embodiment is provided with a transparent document platen 601 installed on the upper surface of a main body. Below the document platen 601 is disposed an exposure-use optical system 602. The exposure-use optical system 602 is constituted of: a light source lamp 602*a* for projecting light onto an original document 613 that is placed on the document platen 601; a plurality of reflection mirrors 602*b* for directing the light reflected from the original document 613 onto a photoreceptor 607, for example, in such a manner as indicated by the alternate long and short dash line; an image-forming lens 602*c* that is disposed in the light path of the reflected light; and a color-separation filter 602*d* including color filters of the three primary colors, red, green and blue.

A belt-like photoreceptor 607 made of OPC (Organic Photoconductive Conductor), whereon a light image derived from the exposure and scanning is illuminated, is installed in the light axis of the exposure-use optical system 602. On the paper-feeding side of the photoreceptor 607, are disposed feeding cassettes 608 and 609 for housing sheets of copy paper 619. Feeding rollers 623 and 624 are respectively installed on the upper faces of the feeding cassettes 608 and 609, and the feeding rollers 623 and 624 thus draw the sheets of copy paper 619 from the feed cassettes 608 and 609, and send them toward an intermediate transfer member 610.

A pair of timing rollers 625 are installed on the paper-sending side in the path from the feeding rollers 623 and 624 to the intermediate transfer member 610. The pair of timing rollers 625 are rotated in synchronism with the intermediate transfer member 610. Further, the intermediate transfer member 610 is driven and rotated by the first through third rollers 618*a*, 618*b* and 618*c*, and pressed against a driving roller 615—which rotates the photoreceptor 607—between the first roller 618*a* and the second roller 618*b*. On the back-surface side of the intermediate transfer member 610 at the portion whereto the driving roller 615 is pressed, is disposed a transferring charger 621. On the surface side of the intermediate transfer member 610 at the installation portion of the third roller 618*c*, is disposed a transferring roller 622. On the paper-sending side of the transferring roller 622, are disposed a separation plate 620, a suction unit 100 and a fixing device 200 in this order.

The photoreceptor 607, whereonto the reflected light from the exposure-use optical system 602 is illuminated, is supported by a driven roller 614 and a driving roller 615, and driven to rotate by a driving force transmitted from a driving force source (not shown) to the driving roller 615. Further, by the side of the driven roller 614 on the periphery of the photoreceptor 607, are disposed a main charger 616 for charging the photoreceptor 607 and a static eliminating lamp 626 for eliminating static electricity from the photoreceptor 607. Below the photoreceptor 607 in the proximity of the static eliminating lamp 626, is installed a cleaning device 617 for removing residual toner from the photoreceptor 607. Cleaning blades 617*a* made of, for example, urethane rubber are attached to the cleaning device 617, and these cleaning blades 617*a* are pressed onto the photoreceptor 607 so as to scrape residual toner off the photoreceptor 607.

Moreover, above the photoreceptor 607 in the center of the machine main body, are disposed a mono-color-use developing device 603 and color-use developing devices 604 through 606 without contacting the photoreceptor 607. Here, black developer is housed in the mono-color-use developing device 603, and color developers of yellow, magenta, and cyan are respectively housed in the developing devices 604 through 606.

Figure 41:
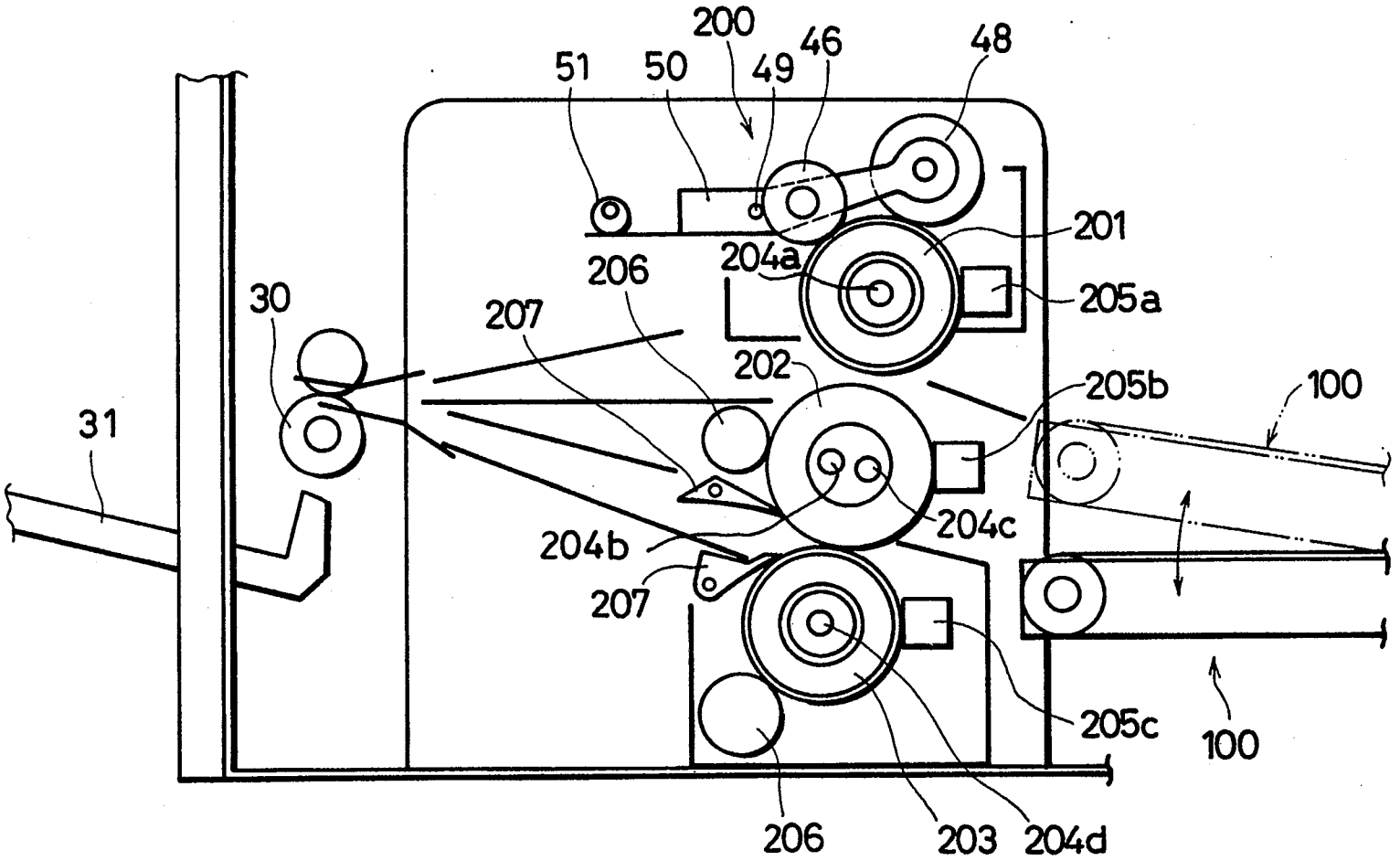

As illustrated in FIG. 41, the fixing device 200 has an upper heat roller 201 as the first fixing roller, a middle heat roller 202 as the second fixing roller, and a lower heat roller 203 as the third fixing roller, which are disposed in parallel with one another in the vertical position and which have been described in embodiment 1 and embodiment 9. As to the rotations of the upper through lower heat rollers 201 through 203, the middle heat roller 202 is a driving roller, while the upper and lower heat rollers 201 and 203 are driven rollers, and the middle heat roller 202 is driven by a heat-roller driving motor 53, which will be described later, and thus rotated forwardly as well as reversely depending on fixing sections to be used.

In order to provide the upper and lower fixing sections, the copying machine of the present embodiment has a mechanism wherein the middle heat roller 202 is installed at a fixed position and the upper heat roller 201 and the lower heat roller 203 are moved upward and downward in such a manner that they are respectively brought in contact with and separated from the middle heat roller 202.

Figure 42:
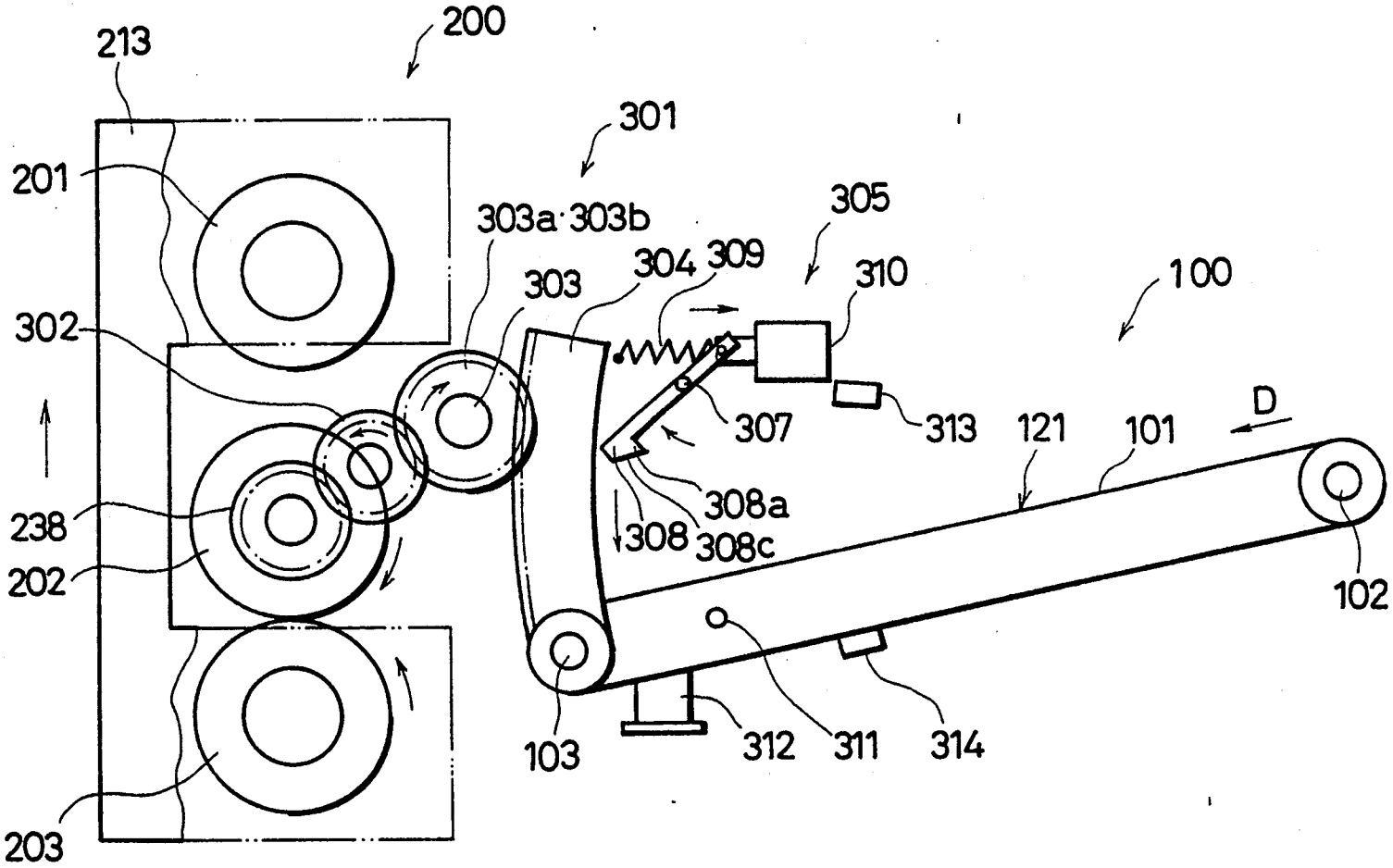
Figure 43:
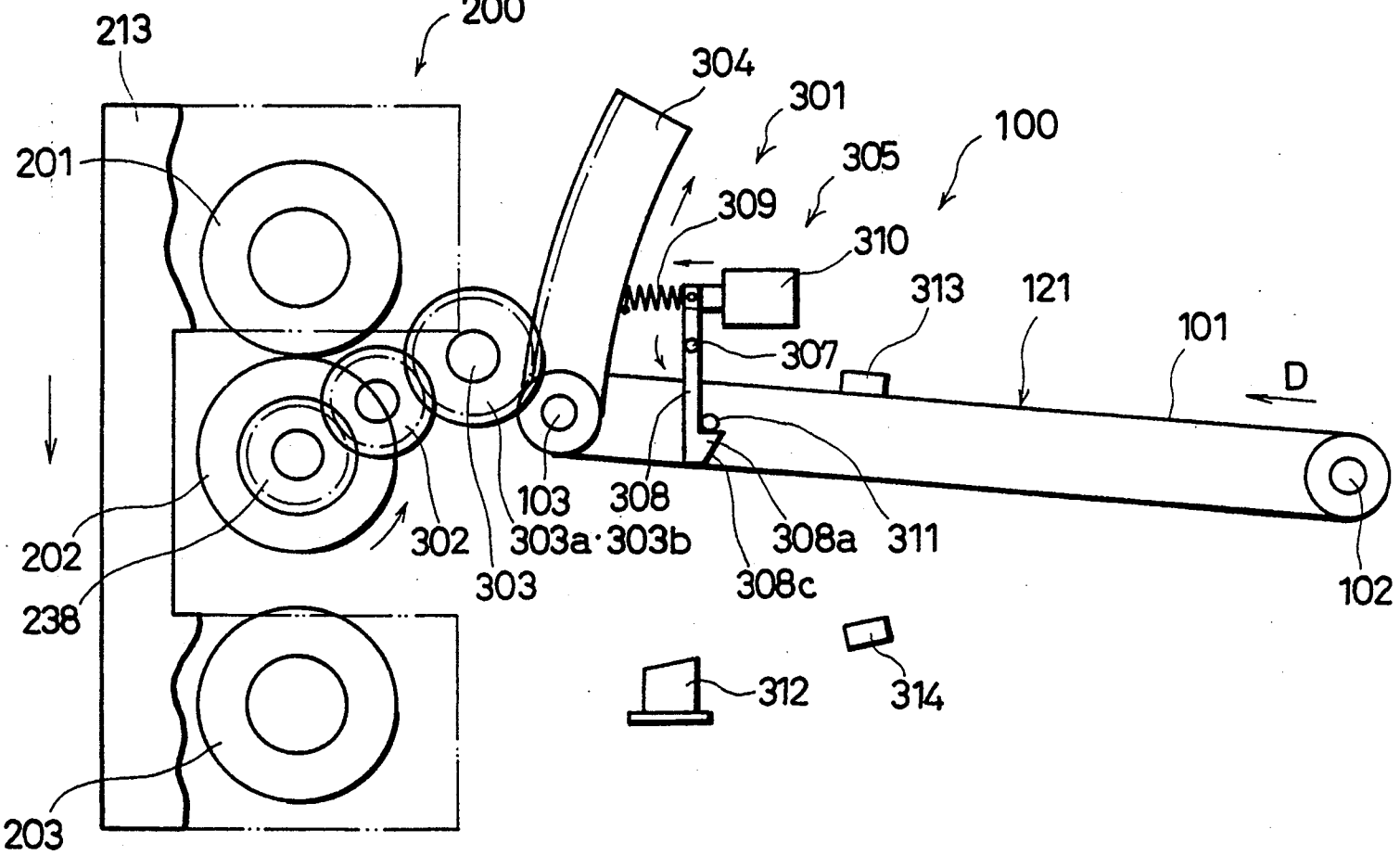
Figure 44:
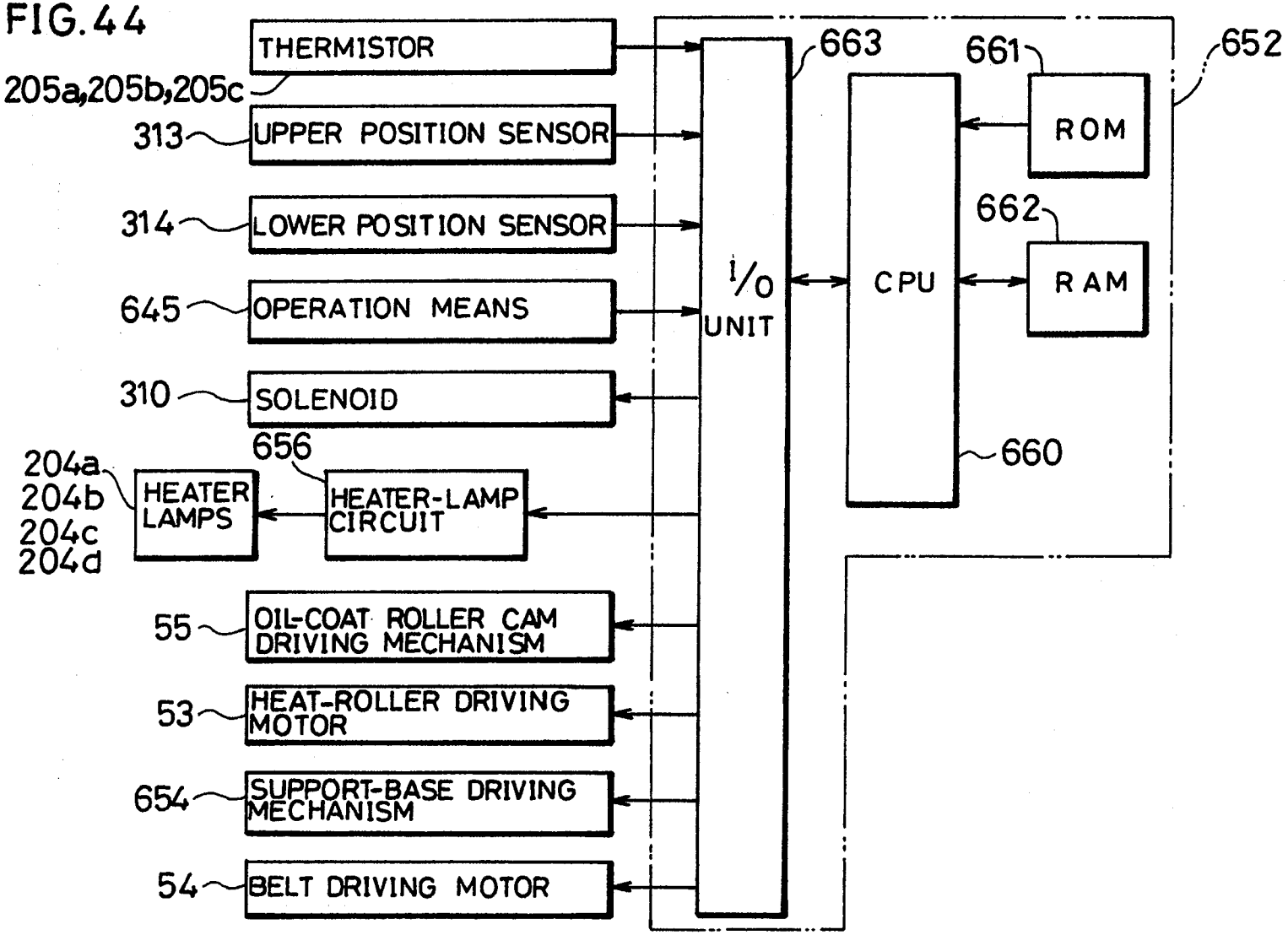

As illustrated in FIGS. 42 and 43, the upper heat roller 201 and the lower heat roller 203 are installed on a roller support base 213. The roller support base 213 is driven by, for example, a support-base driving mechanism 654 (fixing-section forming means), which will be described later, in such a manner that it is moved upward and downward to a lower station for the lower fixing section, where the lower heat roller 203 is pressed against the middle heat roller 202, and to an upper station for the upper fixing section, where the upper heat roller 201 is pressed against the middle heat roller 202. Additionally, the support-base driving mechanism 654 may be constituted of, for example, eccentric cams, tension springs and other members, not shown.

The suction unit 100 has a structure wherein a conveyer belt 101 is supported by a driving shaft 102 located on the paper feeding side and a driven shaft 103 located on the paper discharging side. The conveyer belt 101 is rotatively moved indirection D in FIG. 42 by the driving shaft 102, which is rotated by a driving force transmitted from a belt-driving motor 54 to be described later. Further, the conveyer belt 101, a suction panel (not shown) for supporting the driven shaft 103, and other members constitute a sheet-transport shifting section 121. This sheet-transport shifting section 121 is moved upward and downward around the driving shaft 102 by a shifting-section positioning mechanism 301.

The shifting-section positioning mechanism 301 is constituted of such members and devices as: a gear 238, which is installed in the middle heat roller 202 and whereto a driving force from the heat-roller driving motor 53 is transmitted through a heat-roller driving mechanism, not shown; an idle gear 302; an electromagnetic clutch 303 for connecting and disconnecting the driving force in response to ON and OFF of the input signals; a rack gear 304; a shifting-section holding device 305; an upper position sensor 313; a lower position sensor 314; and a control device 652, which will be described later. The idle gear 302 is meshed with the gear 238 and the input gear 303*a* of the electromagnetic clutch 303, while the output gear 303*b* of the electromagnetic clutch 303 is meshed with the rack gear 304. The rack gear 304, which has a circular arc shape, centered on the driving shaft 102 of the suction unit 100, has its lower portion connected to the end portion of the sheet-transport shifting section 121 on the paper-discharging side of the suction unit 100. Accordingly, as the middle heat roller 202 rotates clockwise, the sheet-transport shifting section 121 is moved downward, and as the middle heat roller 202 rotates counterclockwise, the sheet-transport shifting section 121 is moved upward.

The shifting-section holding device 305 is provided with: a lock arm 308 which is installed so as to freely rotate around a supporting shaft 307; a tension spring 309—which is connected to one end of the lock arm 308—for urging the lock arm 308 so as to rotate it counterclockwise; a solenoid 310 for rotating the lock arm 308 clockwise against the tensile force of the tension spring 309; and a lock pin 311 which is fixed to the sheet-transport shifting section 121 and to which the lock claw 308*a* of the lock arm 308 hooks when the sheet-transport shifting section 121 is moved to the upper station. Further, the shifting-section holding device 305 is provided with: the lower-station stopping member 312 which restricts the downward rotation of the sheet-transport shifting section 121 and holds the sheet-transport shifting section 121 at a lower station; an upper position sensor 313 for detecting the arrival of the sheet-transport shifting section 121 to the upper station; and a lower position sensor 314 for detecting the arrival of the sheet-transport shifting section 121 to the lower station.

Moreover, as described above, the shifting-section positioning mechanism 301 is provided with the gear 238 to which the driving force of the heat-roller driving motor 53 is transmitted; therefore, the sheet-transport shifting section 121 of the suction unit 100, which is moved upward and downward by the shifting-section positioning mechanism 301, is driven by the heat-roller driving motor 53 as its driving source. This arrangement obviates the necessity of installing an independent driving source exclusively used for the sheet-transport shifting section 121; thus, it is possible to make the mechanism compact as well as cost competitive in comparison with a mechanism wherein the sheet-transport shifting section 121 is moved by a device such as a solenoid.

Furthermore, the copying machine of the present embodiment is provided with the control device 652 for controlling the suction unit 100 and the fixing device 200. The control device 652 has a CPU 660 as well as a ROM 661 and a RAM 662, which are connected to the CPU 660. The ROM 661 stores various controlling programs, and the RAM 662 stores controlling data. Further, various controlling data are inputted to the CPU 660 through an I/O unit 663. Those data are released from an operation means 645, which is used for entering data such as set temperatures for the heat rollers 201 through 203; from the upper through lower thermistors 205*a*, 205*b* and 205*c*; and from the upper position sensor 313 as well as the lower position sensor 314. The CPU 660 stores the controlling data in the RAM 662, and executes the controlling programs stored in the ROM 661 according to the controlling data. Through the I/O unit 663, the resulting controlling output signals are released to the solenoid 310, the belt-driving motor 54, the heat-roller driving motor 53, the heater-lamp circuit 656, the oil-coat roller cam driving mechanism 55, the support-base driving mechanism 654, etc., thereby operating the respective devices and mechanisms.

The CPU 660 controls the ON/OFF operations of the upper through lower heater lamps 204*a*, 204*b*, 204*c* and 204*d*, which are installed inside the upper through lower heater lamps 204*a*, 204*b* and 204*c* by sending signals to the heater-lamp circuit 656 according to detection signals from the thermistors 205*a*, 205*b* and 205*c*. Thus, the upper, middle and lower heat rollers 201 through 203 are adjusted to have respective set temperatures that are entered through the operation means 645.

In the above arrangement, when the copy start button is depressed after the selection key for full-color copying mode have been turned on, the roller support base 213 is driven by the support-base driving mechanism 654, and moved to the upper station corresponding to the upper fixing section, through the controlling operation of the control device 652. Thus, as illustrated in FIG. 43, the upper heat roller 201 is pressed against the middle heat roller 202 such that the upper fixing section for use in the full-color copying mode is formed.

As the middle heat roller 202 rotates, the input gear 303*b* of the electromagnetic clutch 303, which is coupled to the heat roller 202, is rotated counterclockwise, thereby making the rack gear 304 move upward in such a manner that the sheet-transport shifting section 121 is shifted upward. When the sheet-transport shifting section 121 has reached the upper station, this state is detected by the upper position sensor 313, thereby disconnecting the electromagnetic clutch 303. Here, while the sheet-transport shifting section 121 is moving to the upper station, the solenoid 310 is kept off, and the lock arm 308 is rotated clockwise since it is pressed by the lock pin 311 at the guide slope 308*c* of its lock claw 308*a*. Upon arrival of the sheet-transport shifting section 121 to the upper station, the lock pin 311 is disconnected from the guide slope 308*c*, and the rock arm 308 is thus rotated counterclockwise, thereby making the lock claw 308*a* engage the lock pin 311. Consequently, the sheet-transport shifting section 121 is held at the upper station.

Further, the middle heat roller 202 rotates counterclockwise, and according to this movement, the upper heat roller 201 is rotated clockwise. Furthermore, the eccentric cam 51 of FIG. 41 is driven by the aforementioned oil-coat roller cam driving mechanism 55 in such a manner that the oil-coat roller 48 is pressed against the upper heat roller 201. Here, the pressing operation of the oil-coat roller 48 onto the upper heat roller 201 may be carried out at an appropriate point of time before a sheet of copy paper 619 is transported to the upper fixing section.

This full-color copying mode includes a plurality of copying cycles wherein yellow, magenta, and cyan toner images are respectively developed, and transferred onto the intermediate transfer member 610 shown in FIG. 40. After completion of the above-mentioned operations concerning the suction unit 100 and the fixing device 200, the yellow copying cycle is first carried out.

More specifically, the light source lamp 602*a* illuminates an original document 613 placed on the document platen 601 with light rays, and the original document 613 is thus scanned and exposed. The light rays reflected from the original document 613 are directed to the color-separation filter 602*d* through the reflection mirrors 602*b* and the image-forming lens 602*c*, and separated into respective color components by the color-separation filter 602*d*.

The light rays, after having passed through color filters in the color-separation filter 602*d*, are projected onto the photoreceptor 607, which has been uniformly charged by the main charger 616, thereby exposing the photoreceptor 607. Thus, a yellow latent image corresponding to the image of the original document 613 is formed on the photoreceptor 607. Then, the latent image is developed by yellow developer that is supplied from a developing magnet roller at a station facing the developing device 604, which contains the yellow developer that is a complementary color to the relevant color separation filter 602*d*. Thus, the latent image is formed into a visible image, that is, a toner image. Successively, the toner image is transferred onto the intermediate transfer member 610 by the transferring charger 621. After the completion of the yellow copying cycle, the photoreceptor 607 is cleaned by the cleaning device 617, while residual electric potential of the photoreceptor 607 is erased by the static eliminating lamp 626.

Successively, magenta and cyan toner images are transferred onto the intermediate transfer member 610 through the same copying cycle as described above. As the respective copying cycles are carried out, the toner images having the respective colors are transferred onto the same position on the intermediate transfer member 610 by the transferring charger 621, and a complete toner image is thus formed by the toners having the respective colors that have been superimposed.

Sheets of copy papers 619, which are housed in the feeding cassettes 608 and 609, are sent to the timing roller 625 sheet by sheet by the feeding rollers 623 and 624. The timing roller 625 transports a sheet of copy paper 619 between the intermediate transfer member 610 and the transferring roller 622 in synchronism with the intermediate transfer member 610. The sheet of copy paper 619, which has been transported thereto and whereonto the toner image on the intermediate transfer member 610 has been transferred by the transferring roller 622, is separated from the intermediate transfer member 610 by the separation plate 620. The sheet of copy paper 619 bearing the toner image is sent to the fixing device 200 by the conveyer belt 101 of the suction unit 100. In this case, since the conveyer belt 101 is held at the upper station, the sheet of copy paper 619 is sent to the upper fixing section that is formed at the contact section between the upper heat roller 201 and the middle heat roller 202.

At the upper fixing section, the three-layered color toner image on the sheet of copy paper 619 is heated by the upper and middle heat rollers 201 and 202, and melts down by heat, thereby being fixed on the sheet of copy paper 619. In this case, silicone oil is supplied to the upper heat roller 201 from the oil-coat roller 48; therefore, it is possible to prevent the offset of the toner image onto the heat roller 201 and to impart gloss to the full-color toner image on the sheet of copy paper 619. The sheet of copy paper 619, which has been discharged from the fixing device 200, is ejected onto the discharge tray 31 by the discharge roller 30.

In a state where the above-mentioned full-color copying operation is available, when the copy start button is turned on after turning on the mono-color copy selection key, the control device 652, shown in FIG. 42, provides control such that the roller support base 213 is driven by the support-base driving mechanism 654 and moved to a lower station associated with the lower fixing section; thus, the lower heat roller 203 is pressed against the middle heat roller 202 to form the lower fixing section for use in the mono-color copying mode. Further, the solenoid 310 is turned on, and the lock arm 308 is driven by the solenoid 310, and rotated clockwise, thereby releasing the engagement between the lock claw 308*a* and the lock pin 311. Moreover, the middle heat roller 202 rotates clockwise, and according to this movement, the lower heat roller 203 rotates counterclockwise.

According to the rotation of the middle heat roller 202, the output gear 303*b* of the electromagnetic clutch 303, which is in a connected state, rotates clockwise, and the rack gear 304 is shifted downward, thereby causing the sheet-transport shifting section 121 to pivot downward. When the sheet-transport shifting section 121 has reached the lower station, this state is detected by the lower position sensor 314, and the electromagnetic clutch 303 is disconnected, thereby turning off the solenoid 310. When the solenoid 310 is turned off, the lock arm 308 returns to the state shown in FIG. 43.

Upon reaching the lower station, the sheet-transport shifting section 121 is held at the station by the lower-station stopping member 312. Then, through the same operations as those of the full-color copying mode except for using only black developer housed in the developing device 603, a toner image is transferred onto a sheet of copy paper 619 by the intermediate transfer member 610. The sheet of copy paper 619 bearing the toner image is sent to the fixing device 200 by the conveyer belt 101 of the suction unit 100. In this case, since the conveyer belt 101 is held at the lower station, the sheet of copy paper 619 is sent to the lower fixing section that is formed at the contact section between the middle heat roller 202 and the lower heat roller 203.

At the lower fixing section, the black toner image on the sheet of copy paper 619 is heated by the middle and lower heat rollers 202 and 203, and melts down by heat, thereby being fixed on the sheet of copy paper 619. The sheet of copy paper 619, which has been discharged from the fixing device 200, is ejected onto the discharge tray 31 by the discharge roller 30.

Figure 45:
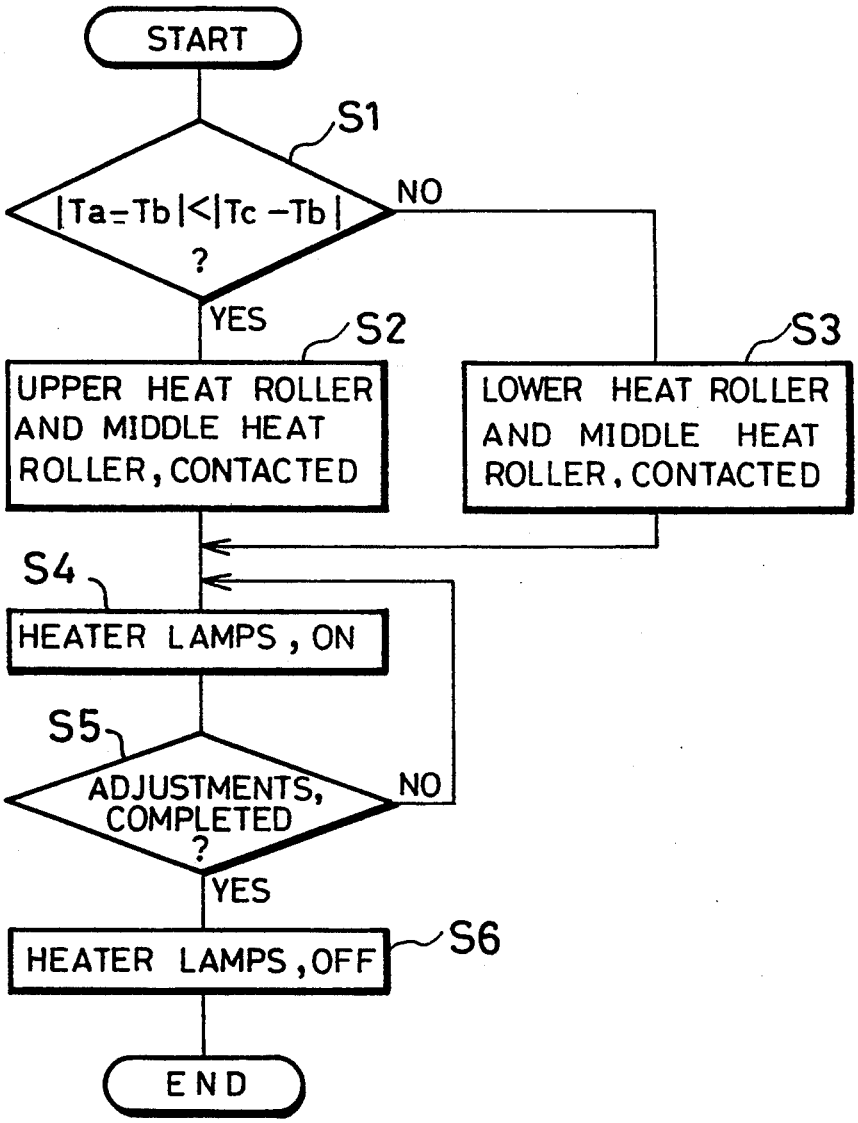

Furthermore, in the copying machine of the present embodiment, during the above-mentioned copying operations in the full-color copying mode and the monocolor copying mode, the control device 652 provides control as shown by a flow chart in FIG. 45 in order to adjust the upper through lower heat rollers 201 through 203, installed in the fixing device 200, to have respective set temperatures that have been predeterminately entered by the operation means 645.

When the respective set temperatures for the heat rollers 201 through 203 are entered through the operation means 645, judgement is made as to which set temperature between those of the heat rollers 201 and 203 has a smaller difference from the set temperature of the middle heat roller 202. More specifically, when the set temperatures of the upper, middle and lower heat rollers 201, 202 and 203 are respectively represented by Ta, Tb and Tc, calculations are first executed with respect to $|Ta-Tb|$ and $|Tc-Tb|$, and the judgement is made as to whether the value of $|Ta-Tb|$ is smaller than that of $|Tc-Tb|$ (S1). Here, if the value of $|Ta-Tb|$ is smaller than that of $|Tc-Tb|$, the roller support base 213 is moved to the upper fixing section by the support-base driving mechanism 654, and the upper fixing section is formed by pressing the upper heat roller 201 onto the middle heat roller 202 (S2).

On the other hand, if the value of $|Ta-Tb|$ is greater than that of $|Tc-Tb|$, or if the value of $|Ta-Tb|$ is equal to that of $|Tc-Tb|$, the roller support base 213 is moved to the lower fixing section by the support-base driving mechanism 654, and the lower fixing section is formed by pressing the lower heat roller 203 onto the middle heat roller 202 (S3). For example, supposing that the values of Ta, Tb and Tc are respectively set to 200° C., 180° C. and 130° C., the roller support base 213 is moved so as to press the upper heat roller 201 onto the intermediate heat roller 202.

Next, the upper through lower heater lamps 204*a*, 204*b*, 204*c* and 204*d*, which are installed in the upper through lower heat rollers 201 through 203, are turned on through the heater-lamp circuits, thereby heating up the respective heat rollers 201 through 203 (S4). Thereafter, the upper through lower heater lamps 204*a*, 204*b*, 204*c* and 204*d* are kept on until detection signals released from the thermistors 205*a*, 205*b* and 205*c* indicate the completion of the respective temperature adjustments at S5. If it is judged that the temperature adjustments have been completed (S5), the upper through lower heater lamps 204*a*, 204*b*, 204*c* and 204*d* are turned off (S6). Thus, the temperature adjustments have been completed, and a desired copying operation is carried out.

As described above, the copying machine in accordance with the present embodiment is provided with a function—which is furnished by the fixing-section forming means—for allowing on demand the contact and the separation between either pair of the two pairs of fixing rollers, which form the upper and lower fixing sections respectively; and another function—which is furnished by the fifth control means—for controlling the fixing-section forming means in such a manner that upon applying temperature adjustments to the upper through lower fixing rollers, either the upper or lower fixing roller, whose set temperature has a smaller difference from the set temperature of the middle fixing roller, is pressed against the middle fixing roller. Therefore, in the copying machine of the present embodiment, upon applying temperature adjustments to the upper through lower heat rollers 201 through 203 installed in the fixing device 200, the roller support base 213, which supports the upper through lower heat rollers 201 through 203, is driven by the support-base driving mechanism 654 in such a manner that either the upper or lower heat roller 201 or 203, whose set temperature is closer to the set temperature of the middle heat roller 202, is pressed against the middle heat roller 202.

With this arrangement, upon conducting the temperature adjustments, every time set temperatures of the respective heat rollers 201 through 203 are entered, either the upper heat roller 201 or the lower heat roller 203 to be pressed against the middle heat roller 202 can be readily specified in accordance with the set temperatures. When either of the heat rollers, whose set temperature has a greater difference from that of the middle heat roller 202, is pressed against the middle heat roller 202, the heat roller having a lower set temperature tends to be overheated, while the other heat roller having a higher set temperature tends to be insufficiently heated; this has arisen a problem in conventional arrangements. However, by adopting the arrangement of the present embodiment wherein either the upper or lower heat roller 201 or 203, whose set temperature is closer to the set temperature of the middle heat roller 202, is pressed against the middle heat roller 202, the efficiency of the temperature adjustments can be improved.

Additionally, in the present embodiment, by shifting either of the upper and lower heat rollers 201 and 202, which are supported by the roller support base 213, either the upper heat roller 201 or the lower heat roller 203 is pressed against the middle heat roller 202 that is fixed at a predetermined position; yet, another arrangement may be adopted. For example, by shifting the middle heat roller 202, the middle heat roller 202 may be pressed against the upper and lower heat rollers 201 and 203 that are fixed at predetermined positions.

[EMBODIMENT 12]

Figure 46:
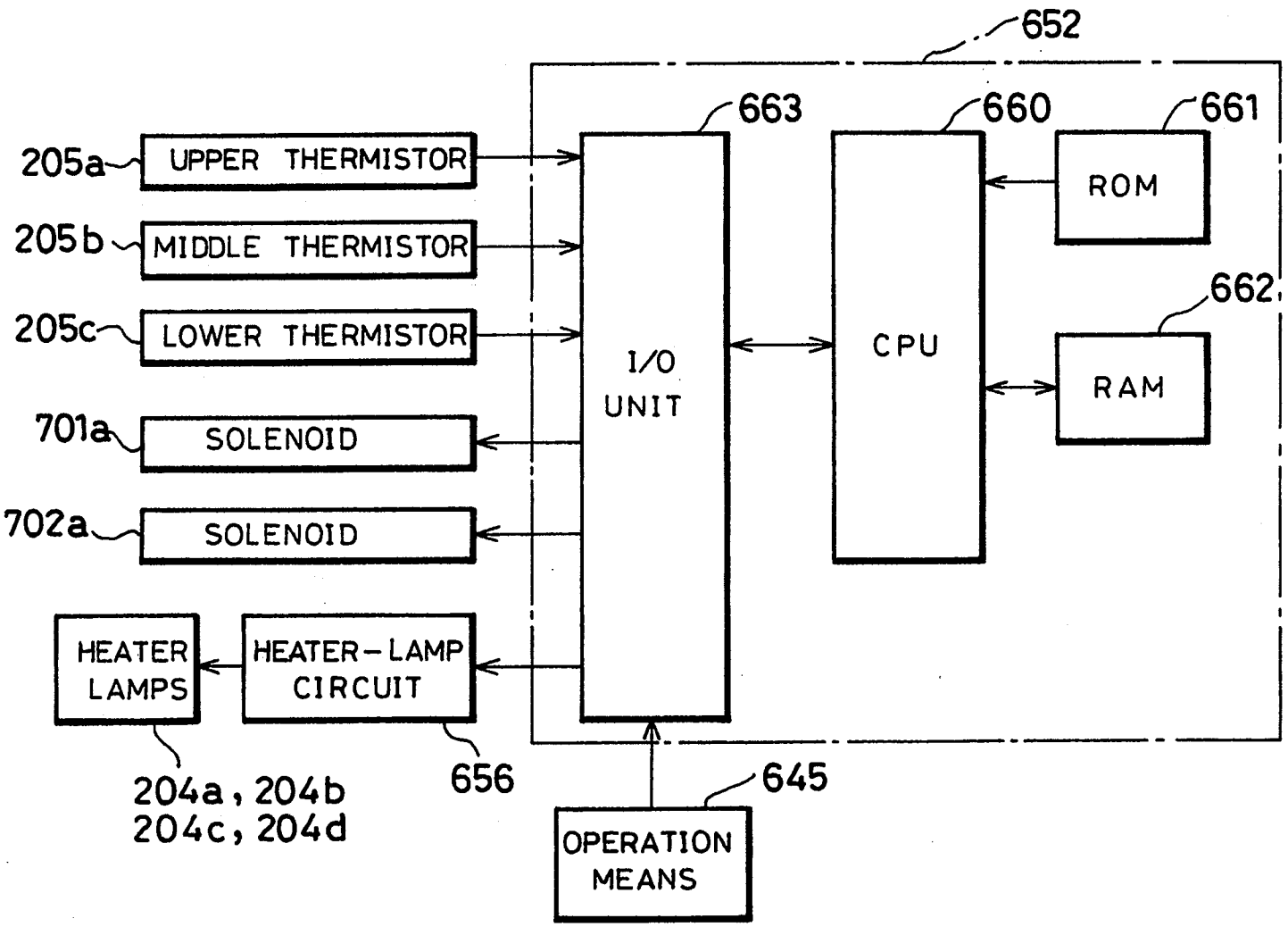
FIGS. 46 and 47 show the twelfth embodiment of the present invention.
Figure 47:
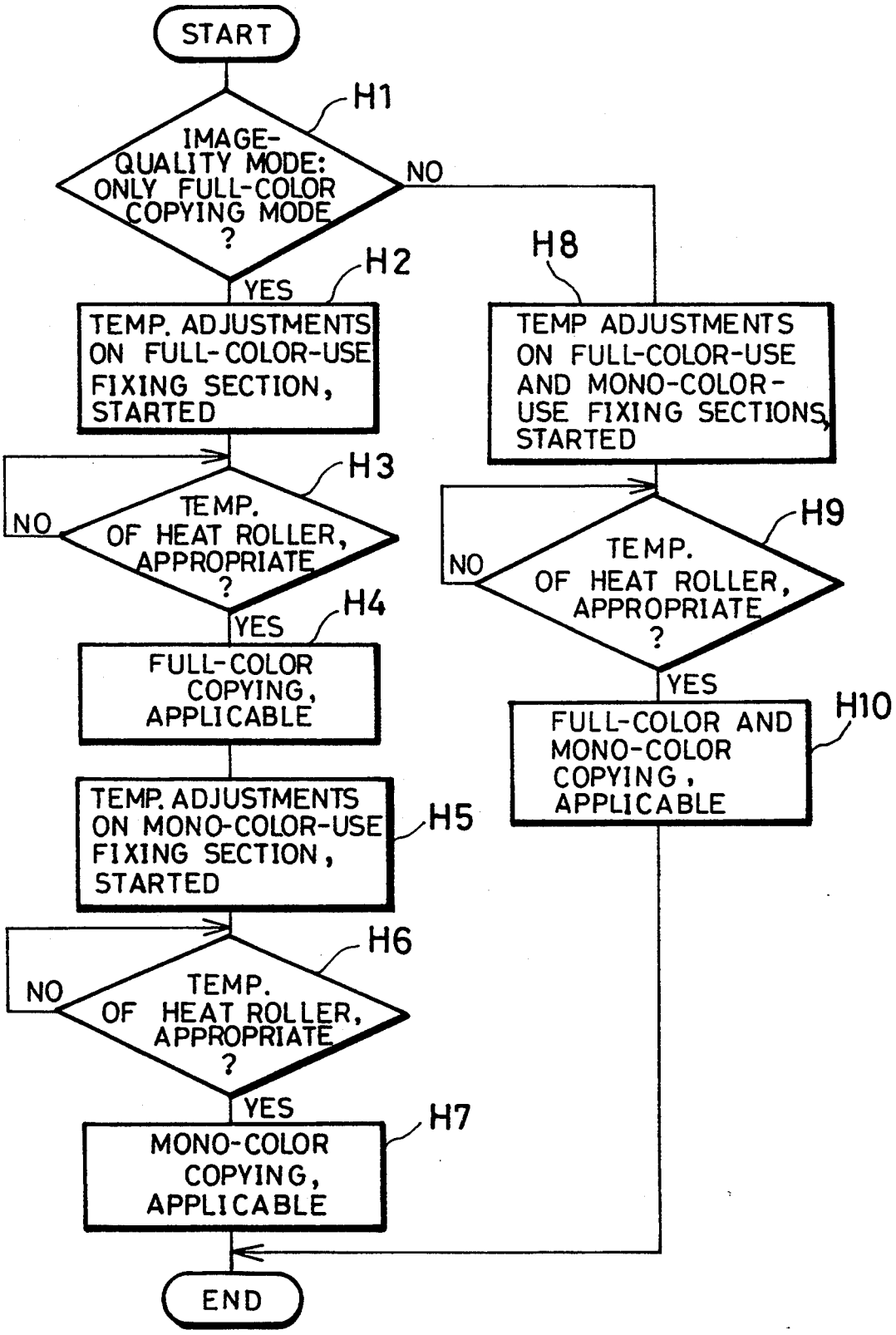

Referring to FIGS. 46 and 47, the following description will discuss another embodiment of the present invention. Here, for convenience of explanation, those members that have the same functions and that have been described in embodiment 11 (with reference to FIGS. 40 and 41) are indicated by the same reference numerals and the description thereof is omitted. Further, the explanation of the present embodiment is given with reference to FIGS. 40 and 41 of embodiment 11.

The copying machine and the fixing device of the present embodiment have the same constructions as those of embodiment 11 shown in FIGS. 40 and 41 except for a mechanism for shifting the suction unit 100 upward and downward as well as a mechanism for forming the upper fixing section and the lower fixing section. More specifically, the suction unit 100 is shifted upward and downward by a mechanism having a solenoid 702*a* shown in FIG. 46. Further, as for the upper and lower fixing sections, the upper heat roller 201 and the lower heat roller 203 are installed at fixed positions, while the middle heat roller 202 is shifted upward and downward by the mechanism having the solenoid 702*a* of FIG. 46. Thus, the upper and lower fixing sections are formed by making the middle heat roller 202 come into contact with or separate from the upper heat roller 201 or the lower heat roller 203.

Moreover, as illustrated in FIG. 46, the control device 652 provides control in such a manner that image-quality modes in addition to set temperatures of the upper through lower heat rollers 201 through 203 are entered through the operation means 645, and these set temperatures and image-quality modes are stored in the RAM 662. The image-quality modes include various modes such as a graphic mode, a map mode, a photograph mode and a character-photograph mode, and depending on the respective image-quality modes, either of the image-qualities of the full-color copying mode and the mono-color copying mode is specified, or both of the image-qualities of those copying modes are specified. For example, for the graphic mode, both of the image-qualities of the full-color copying mode and the mono-color copying mode are specified, while for the map mode, only the image-quality of the mono-color copying mode is specified. Moreover, the ROM 661 in the control device 652 is provided with a controlling program which functions as a first precedence—setting means for determining the order of priority with respect to temperature adjustments of the upper and lower fixing sections in accordance with the required image-quality mode.

In the above arrangement, an explanation will be given of the temperature control of the fixing device, which follows the activation of the main power source of the copying machine, with reference to a flow chart in FIG. 47, which is one example of the controlling programs.

When the main power source of the copying machine is turned on, one of the image-quality modes, which are stored in the RAM 662, is read out through the operation means 645, and judgement is made as to whether this image-quality mode calls for only the image-quality of the full-color copying mode (H1). If it is judged that the image-quality mode calls for only the image-quality of the full-color copying mode, process H2 is executed, that is, temperature adjustments are started with respect to the upper fixing section for use in the full-color copying mode by starting to heat up the upper heat roller 201 and the middle heat roller 202 (H2). Then, judgement is made as to whether or not the temperatures of the upper heat roller 201 and the middle heat roller 202 are appropriate (H3), and if they are inappropriate, process H3 is carried out again. On the contrary, if they are appropriate at H3, process H4 is executed, that is, a display or other indication is provided to indicate that the machine is ready for a full-color copying operation (H4).

Next, temperature adjustments are started with respect to the lower fixing section for use in the mono-color copying mode by starting to heat up the lower heat roller 203 (H5). Then, judgement is made as to whether or not the temperature of the middle heat roller 202 is appropriate (H6), and if it is inappropriate, process H6 is carried out again. On the contrary, if it is appropriate at H6, process H7 is executed, that is, a display or other indication is provided to indicate that the machine is ready for a mono-color copying operation (H7).

On the other hand, if it is judged at H1 that the image-quality mode calls for both of the image-qualities of the full-color copying mode and the mono-color copying mode, process H8 is executed, that is, temperature adjustments are simultaneously carried out with respect to the upper through the lower heat rollers 201 through 203 (H8). Then, judgement is made as to whether or not the temperatures of the upper through lower heat rollers 201 through 203 are appropriate (H9), and if they are inappropriate, process H9 is carried out again. On the contrary, if they are appropriate at H9, process H10 is executed, that is, a display or other indication is provided to indicate that the machine is ready for a full-color copying operation as well as a mono-color copying operation (H10).

As described above, the copying machine in accordance with the present embodiment is provided with the following four functions: the fist function—which is furnished by the temperature adjusting means—for applying temperature adjustments to the upper and lower fixing sections; the second function—which is furnished by the adjustment order controlling means—for controlling the temperature adjusting means in such a manner that temperature adjustments are applied to either the first or second fixing section according to an order of priority, and that after the completion of the temperature adjustments, temperature adjustments with respect to the other fixing section is successively carried out; the third function—which is furnished by the selection means—for selecting either of the upper and lower fixing sections in accordance with respective predetermined image-quality modes; and the fourth function—which is furnished by the first precedence-setting means—for setting the order of priority in the adjustment order controlling means in such a manner that, during warm-up time of the copying machine, temperature adjustments are preferentially applied to the fixing section that has been selected through the selection means. That is, taking account of the fact that either of the copying modes or both of the copying modes is specified depending on the various types of the image-quality modes, the copying machine in accordance with the present embodiment determines the order of priority with respect to temperature adjustments of the upper and lower fixing sections in accordance with the required image-quality mode, during warm-up time of the copying machine, which follows the activation of the main power source of the copying machine.

With this arrangement, when the operator has selected one of the image-quality modes, the copying machine of the present embodiment first becomes ready for a copying mode corresponding to the desired image-quality mode; therefore, it is possible to shorten the waiting time, that is, the warm-up time after activating the copying machine. Further, the copying machine automatically makes a judgement to determine which copying mode is to be used so as to meet the selected image-quality mode; thus, it is possible to lessen the work load of the operator; i.e., that of selecting and entering the copying modes.

[EMBODIMENT 13]

Figure 48:
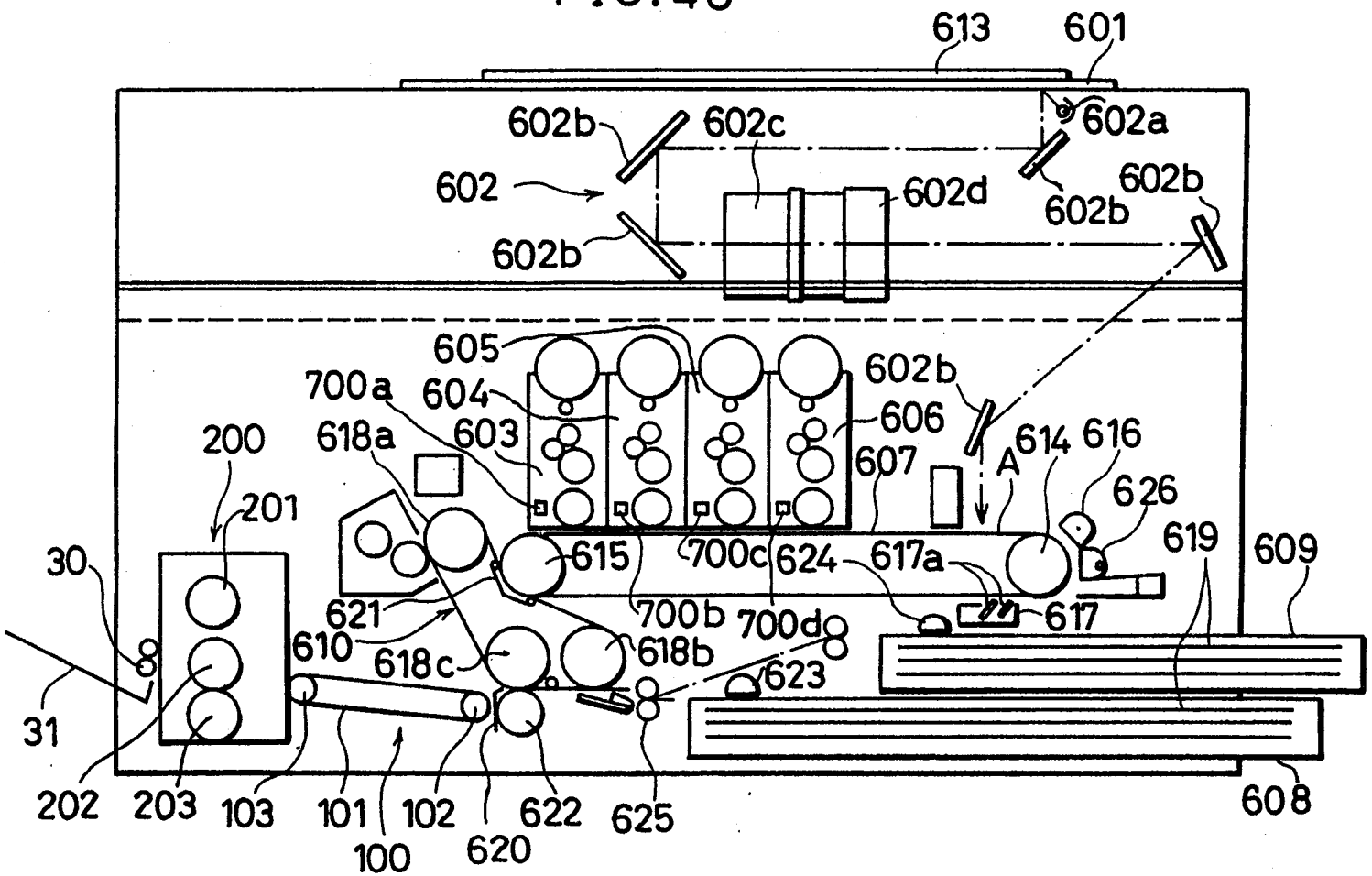
FIGS. 48 through 50 show the thirteenth embodiment of the present invention.
Figure 49:
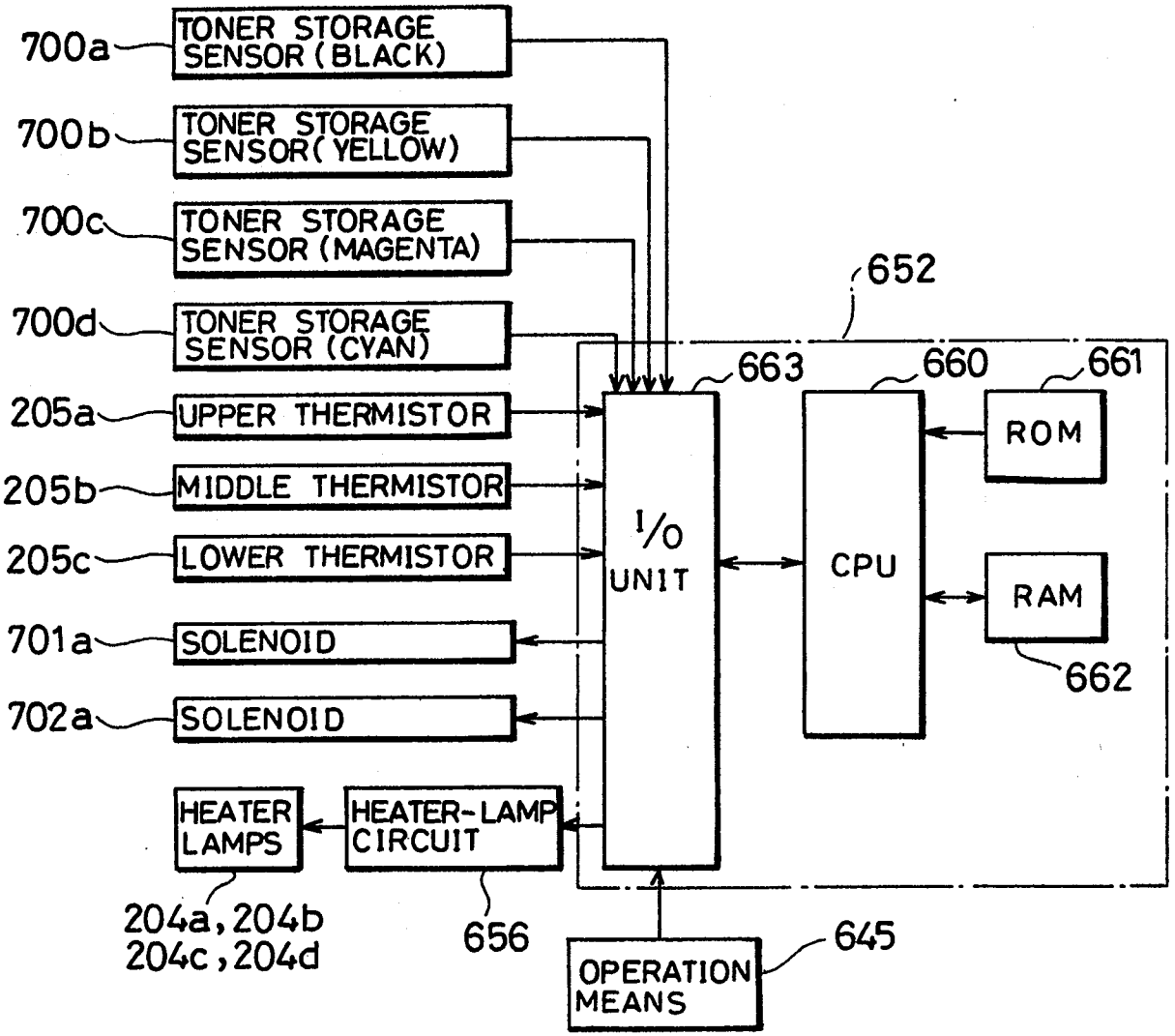
Figure 50:
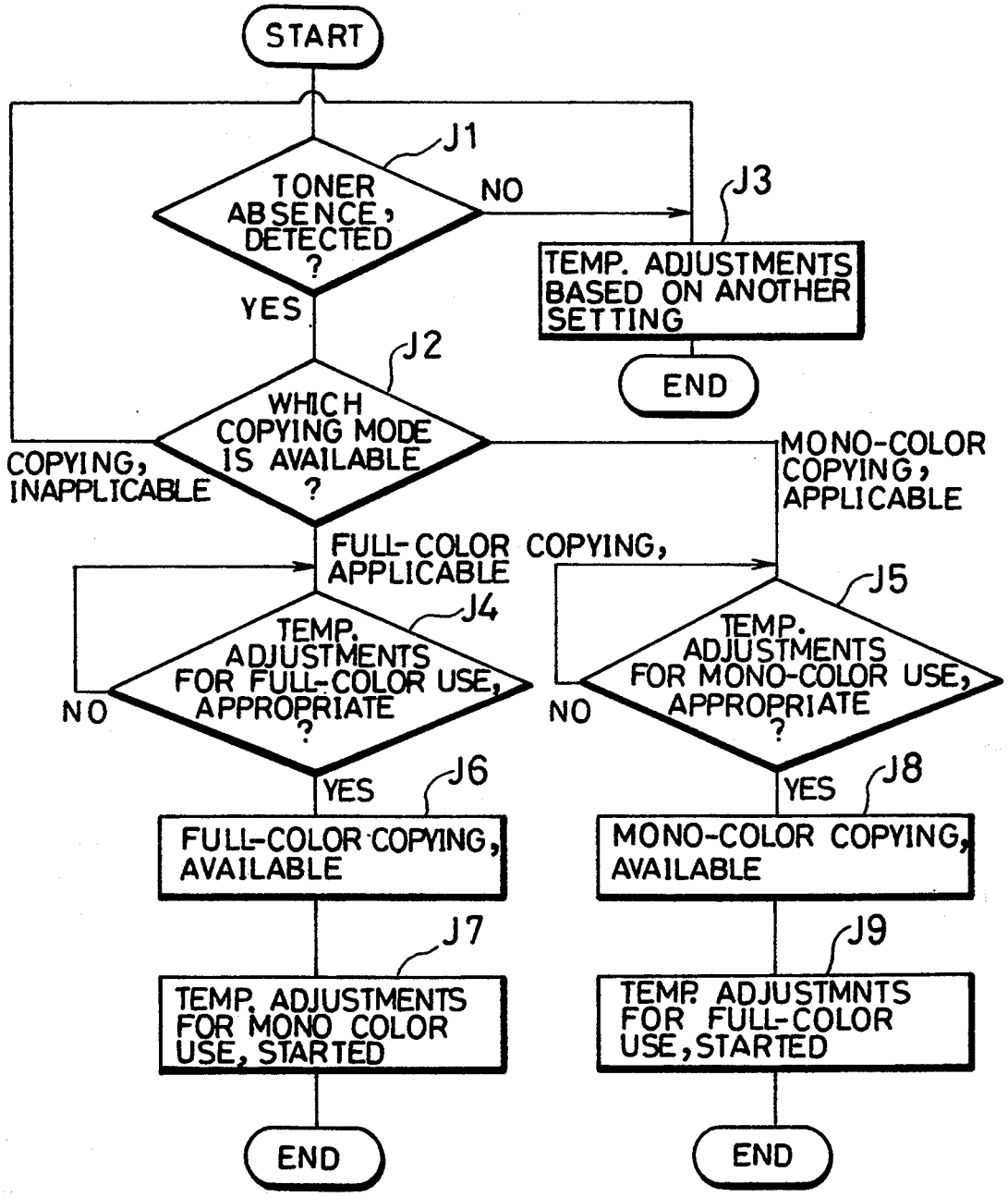
Figure 51:
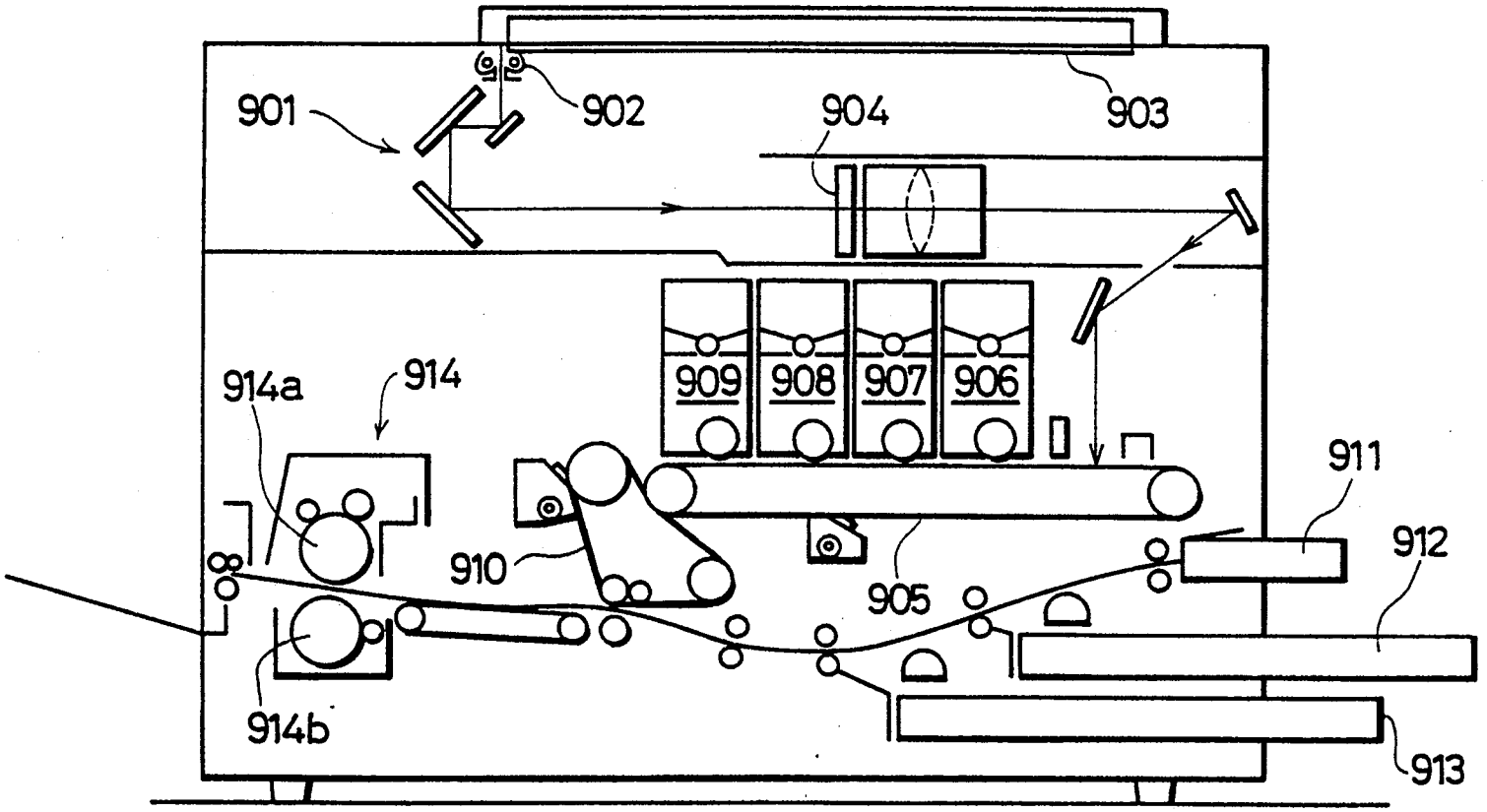
FIG. 51, which shows a prior art, is a vertical sectional view showing the entire structure of a copying machine.

Referring to FIGS. 48 through 50, the following description will discuss another embodiment of the present invention. Here, for convenience of explanation, those members that have the same functions and that have been described in embodiment 11 (with reference to FIGS. 40 and 41) are indicated by the same reference numerals and the description thereof is omitted. Further, the explanation of the present embodiment is given with reference to FIGS. 40 and 41 of embodiment 11.

The copying machine and the fixing device of the present embodiment have the same constructions as those of embodiment 11 shown in FIGS. 40 and 41 except for a mechanism for shifting the suction unit 100 upward and downward as well as a mechanism for forming the upper fixing section and the lower fixing section. More specifically, the suction unit 100 is shifted upward and downward by a mechanism having a solenoid 702*a* shown in FIG. 49. Further, as for the upper and lower fixing sections, the upper heat roller 201 and the lower heat roller 203 are installed at fixed positions, while the middle heat roller 202 is shifted upward and downward by the mechanism having the solenoid 702*a* of FIG. 49. Thus, the upper and lower fixing sections are formed by making the middle heat roller 202 come into contact with and separate from the upper heat roller 201 and the lower heat roller 203.

Moreover, as illustrated in FIG. 48, the mono-color-use developing device 603 and the color-use developing devices 604, 605 and 606 are respectively provided with toner-storage sensors 700*a*, 700*b*, 700*c* and 700*d*, and these sensors 700*a* through 700*d* respectively detect the presence or absence of toner with respect to the developing devices 603 through 606.

As illustrated in FIG. 49, the toner-storage sensors 700*a*, 700*b*, 700*c* and 700*d* are connected to the control device 652, and release respective signals for informing the presence or absence of toner to the control device 652. Further, the control device 652, whereto those signals are inputted, is provided with a controlling program which functions as a first precedence-setting means for changing the order of priority with respect to temperature adjustments of the upper and lower fixing sections and for interrupting the heating operations of the corresponding heat rollers among the upper through lower heat rollers 201 through 203 in accordance with the presence or absence of toner in the developing devices 603 through 606.

In the above arrangement, an explanation will be given of the temperature control of the fixing device, which follows the activation of the main power source of the copying machine, with reference to a flow chart in FIG. 50, which is one example of the controlling programs.

When the main power source of the copying machine is turned on, the CPU 660 receives signals for informing the pretense or absence of toner that are released from the respective toner-storage sensors 700*a*, 700*b*, 700*c* and 700*d* through the I/O unit 663. Thus, judgement is made as to the presence or absence of toner with respect to the developing devices 603 through 606 in accordance with those signals (J1).

If it is judged at J1 that all the developing devices 603 through 606 contain toner, process J3 is carried out, that is, temperature adjustments are carried out with respect to both the upper fixing section for use in the full-color copying mode and the lower fixing section for use in the mono-color copying mode based on another setting. Here, "another setting" is referred to as, for example, a setting wherein temperature adjustments are preferentially applied to the upper fixing section prior to the lower fixing section (J3).

On the other hand, if it is judged at J1 that the absence of toner is found at least in one of the developing devices 603 through 606, process J2 is executed. At J2, first at least one of the developing devices 603 through 606 that do not contain toner are specified according to the signals for informing the presence or absence of toner. Then, for example, if only the mono-color-use developing device 603 is specified as such, decision data showing that only the full-color copying mode is available is set. On the other hand, if all or any of the full-color-use developing devices 604, 605 and 606 except the mono-color-use developing device 603 are specified, decision data showing that only the mono-color copying mode is available is set. Further, if all or any of the full-color-use developing devices 604, 605 and 606 together with the mono-color-use developing device 603 are specified, decision data showing that none of the copying modes is available is set.

When the setting of the decision data has been completed by specifying the developing devices 603 through 606, the contents of the decision data are read out. If the contents of the decision data thus read out show that none of the copying modes is available, the aforementioned process J3 is executed, that is, temperature adjustments are carried out with respect to the upper fixing section for use in the full-color copying mode and the lower fixing section for use in the mono-color copying mode based on another setting. If the contents of the decision data thus read out show that the full-color copying mode is available, process J4 is executed, and if the contents thereof show that the mono-color copying mode is available, process J5 is executed (J2).

When process J4 is executed in response to the judgement at J2, temperature adjustments are started with respect to the upper fixing section for use in the full-color copying mode by starting to heat up the upper heat roller 201 and the middle heat roller 202. Then, judgement is made as to whether or not the temperatures of the upper heat roller 201 and the middle heat roller 202 are appropriate, and if they are inappropriate, process J4 is again carried out (J4). On the contrary, if they are appropriate, process J6 is executed, that is, a display or other indication is provided to indicate that the machine is ready for a full-color copying operation (J6). Thereafter, temperature adjustments are started with respect to the lower fixing section for use in the mono-color copying mode by starting to heat up the lower heat roller 203 (J7).

When process J5 is executed in response to the judgement at J2, temperature adjustments are started with respect to the lower fixing section for use in the mono-color copying mode by starting to heat up the middle heat roller 202 and the lower heat roller 203. Then, judgement is made as to whether or not the temperatures of the middle heat roller 202 and the lower heat roller 203 are appropriate, and if they are inappropriate, process J5 is again carried out (J5). On the contrary, if they are appropriate, process J8 is executed, that is, a display or other indication is provided to indicate that the machine is ready for a mono-color copying operation (J8). Thereafter, temperature adjustments are started with respect to the upper fixing section for use in the full-color copying mode by starting to heat up the upper heat roller 201 (J9).

As described above, the copying machine in accordance with the present embodiment is provided with the following five functions: the first function—which is furnished by a toner detection means—for detecting the presence or absence of toner to be used for the respective full-color copying mode and mono-color copying mode; the second function—which is furnished by the temperature adjusting means—for applying temperature adjustments to the upper and lower fixing sections; the third function—which is furnished by the adjustment order controlling means—for controlling the temperature adjusting means in such a manner that temperature adjustments are applied to either the first or second fixing section according to an order of priority, and that after the completion of the temperature adjustments, temperature adjustments with respect to the other fixing section is successively carried out; the fourth function—which is furnished by the selection means—for selecting either of the upper and lower fixing sections in accordance with the presence or absence of toner that has been detected by the toner detection means; and the fifth function—which is furnished by the first precedence-setting means—for setting the order of priority in the adjustment order controlling means in such a manner that, during warm-up time of the copying machine, temperature adjustments are preferentially applied to the fixing section that has been selected through the selection means. That is, taking account of the fact that the availability of the copying modes is restricted depending on the presence or absence of toner in the developing devices 603 through 606, the copying machine in accordance with the present embodiment detects the presence or absence of toner in the developing devices 603 through 606 during warm-up time of the copying machine, which follows the activation of the copying machine, and determines the order of priority with respect to temperature adjustments of the upper and lower fixing sections.

In the case of the fixed order of priority with respect to temperature adjustments of the upper and lower fixing sections, since temperature adjustments may be preferentially applied to a fixing section which is not available due to the absence of toner, temperature adjustments to be applied to the necessary fixing section might be delayed. However, in the arrangement of the present invention, the order of priority with respect to temperature adjustments of the upper and lower fixing sections is changed in response to the presence or absence of toner; thus, it is possible to shorten the waiting time, that is, the warm-up time after activating the copying machine.

Additionally, in the arrangement of the present embodiment, even in the case where the absence of toner has been detected, after completion of temperature adjustments with respect to one fixing section that is available for a copying operation, temperature adjustments are successively applied to the other fixing section that is not available for a copying operation. However, the present invention is not limited to this arrangement. For example, provisions may be made so that in the case where the absence of toner has been detected, after completion of temperature adjustments with respect to one fixing section that is available for a copying operation, temperature adjustments to be applied to the other fixing section that is not available for a copying operation may be held until the fixing section become ready for a copying operation after supply of toner. This arrangement, which prevents wasteful heating, results in reduction of power consumption, thereby ensuring the long life of devices such as the upper through lower heater lamps 204*a*, 204*b*, 204*c* and 204*d*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic apparatus comprising:

fixing means having a first through third fixing rollers for forming a first fixing section by contacting the first and second fixing rollers as well as forming a second fixing section by contacting the second and third fixing rollers, the first fixing section being temperature-adjusted in relation to a first copying mode, the second fixing section being temperature-adjusted in relation to a second copying mode;

temperature adjusting means for conducting temperature adjustments on the first and second fixing sections; and adjustment order controlling means for controlling the temperature adjusting means in such a manner that temperature adjustments are applied to either the first or second fixing section according to an order of priority, and that after the completion of the temperature adjustments, temperature adjustments with respect to the other fixing section is successively carried out.

2. The electrophotographic apparatus according to claim 1, wherein the order of priority is preliminarily set.

3. The electrophotographic apparatus according to claim 1, wherein the first copying mode is a full-color copying mode and the second copying mode is a mono-color copying mode.

4. The electrophotographic apparatus according to claim 1, wherein the first copying mode is a full-color copying mode and the second copying mode is a mono-color copying mode, and the order of priority is preliminarily set in such a manner that temperature adjustments are preferentially conducted on the mono-color copying mode.

5. The electrophotographic apparatus according to claim 3, wherein: the first fixing roller is made up of silicone rubber; the second fixing roller is made up of teflon rubber; and the third fixing roller is made up of silicone rubber or teflon rubber.

6. The electrophotographic apparatus according to claim 3, further comprising:

oil-coat roller to which silicone oil is impregnated, the oil-coat roller being pressed against the first fixing roller.

7. The electrophotographic apparatus according to claim 1, wherein the temperature adjusting means includes:

first through third heating means for heating the first through third fixing rollers by applying electric power, the first heating means being constituted of an upper heater lamp installed in the first fixing roller, the second heating means being constituted of a first middle heater lamp and a second middle heater lamp installed in the second fixing roller, the third heating means being constituted of a lower heater lamp installed in the third fixing roller.

8. An electrophotographic apparatus comprising:

fixing means having a first through third fixing rollers for forming a first fixing section by contacting the first and second fixing rollers as well as forming a second fixing section by contacting the second and third fixing rollers, the first fixing section being temperature-adjusted in relation to a first copying mode, the second fixing section being temperature-adjusted in relation to a second copying mode;

first through third heating means for heating the first through third fixing rollers by applying electric power; and control means which controls the electric power in such a manner that electric power is applied to the first and second or the second and third heating means for a pair of fixing rollers constituting either one of the first and second fixing sections, and after the temperatures of the pair of the fixing rollers have exceeded respective preset temperatures, electric power is preferentially applied to the first or the third heating means, while maintaining the pair of the fixing rollers at the preset temperature by controlling electric power to be applied to the first and second or the second and third heating means for the pair of the fixing rollers constituting the relevant fixing section.

9. The electrophotographic apparatus according to claim 8, wherein the temperature adjusting means includes:

first through third heating means for heating the first through third fixing rollers by applying electric power, the first heating means being constituted of an upper heater lamp installed in the first fixing roller, the second heating means being constituted of a first middle heater lamp and a second middle heater lamp installed in the second fixing roller, the third heating means being constituted of a lower heater lamp installed in the third fixing roller.

10. The electrophotographic apparatus according to claim 7 or claim 9, wherein the sum of electric consumptions of the upper heater lamp and the first middle heater lamp is set to be equal to a total electric energy that is applicable to the fixing means, and the sum of electric consumptions of the lower heater lamp, the first middle heater lamp and the second middle heater lamp is set to be equal to a total electric energy that is applicable to the fixing means.

11. The electrophotographic apparatus according to claim 10, wherein the total electric energy is 1000 W, and the electric consumptions of the upper heater lamp, the first middle heater lamp, the second middle heater lamp and the lower heater lamp are 650 W, 350 W, 300 W and 350 W respectively.

12. The electrophotographic apparatus according to claim 1, further comprising:

selection means for selecting either of the first and second fixing sections; and first precedence-setting means for setting the order of priority in the adjustment order controlling means in such a manner that, during warm-up time of the apparatus, temperature adjustments are preferentially applied to the fixing section that has been selected through the selection means.

13. The electrophotographic apparatus according to claim 1, further comprising:

selection means for selecting either of the first and second fixing sections;

storage data indicating the identity of means for storing the fixing section that has been selected by the selection means; and first precedence-setting means for setting the order of priority in the adjustment order controlling means in such a manner that, during warm-up time of the apparatus, temperature adjustments are preferentially applied to a fixing section that has been selected through the selection means.

14. The electrophotographic apparatus according to claim 13, wherein the storage means further stores data indicating the identity of a fixing section that had been used immediately before a shut down of the apparatus.

15. The electrophotographic apparatus according to claim 14, wherein the shut down of the apparatus is caused by a paper jam.

16. The electrophotographic apparatus according to claim 12 or claim 13, wherein one of image-quality modes of various types, which respectively call for either of the first and second copying modes or both of the copying modes, is specified, and the selection means selects either of the first and second fixing sections according to the selected one of the image-quality modes of various types.

17. The electrophotographic apparatus according to claim 12 or claim 13, further comprising:

toner detection means for detecting the presence or absence of toner to be used for the respective first copying mode and second copying mode, wherein the selection means selects either of the first and second fixing sections in accordance with the presence or absence of toner that has been detected by the toner detection means.

18. The electrophotographic apparatus according to claim 12 or claim 13, wherein the selection means includes a copying mode selection key through which an operator desirably specifies either the first copying mode or the second copying mode, the selection means thus being capable of selecting either of the first fixing section and the second fixing section in accordance with the copying mode that has been specified through the copying mode selection key.

19. The electrophotographic apparatus according to claim 12 or claim 13, further comprising:

display means for indicating which fixing section is being temperature-adjusted: the first fixing section or the second fixing section.

20. The electrophotographic apparatus according to claim 19, wherein the display means and the selection means constitute a copy button means, the copy button means being constituted of a first copy button corresponding to the first copying mode and a second copy button corresponding to the second copying mode, wherein the first copy button is kept flashing during temperature adjustments on the first fixing section corresponding to the first copying mode, and turned on when the temperature adjustments have been completed, thereby permitting the selection of the temperature adjustments on the first fixing section by being depressed during the flashing state or the off state, while the second copy button is kept flashing during temperature adjustments on the second fixing section corresponding to the second copying mode, and turned on when the temperature adjustments have been completed, thereby permitting the selection of the temperature adjustments on the second fixing section by being depressed during the flashing state or the off state.

21. The electrophotographic apparatus according to claim 20, wherein the first copy button initiates a copying operation in the first copying mode by being depressed during the on state, and the second copy button initiates a copying operation in the second copying mode by being depressed during the on state.

22. The electrophotographic apparatus according to claim 1, further comprising:

fixing-section forming means for allowing on demand the contact and the separation between either pair of the fixing rollers, which form the first and second fixing sections respectively; and fixing roller control means for controlling the fixing-section forming means in such a manner that after completion of temperature adjustments on either the first or second fixing section, upon conducting temperature adjustments on the rest of the fixing sections, the contact between fixing rollers forming the former fixing section is maintained, and these fixing rollers are rotated.

23. An electrophotographic apparatus comprising:

fixing means having a first through third fixing rollers for forming a first fixing section by contacting the first and second fixing rollers as well as forming a second fixing section by contacting the second and third fixing rollers, the first fixing section being temperature-adjusted in relation to a first copying mode, the second fixing section being temperature-adjusted in relation to a second copying mode;

fixing-section forming means for allowing on demand the contact and the separation between either pair of the fixing rollers, which form the first and second fixing sections respectively; and control means for controlling the fixing-section forming means in such a manner that upon applying temperature adjustments to the first through third fixing rollers, either the first or third fixing roller, whose set temperature has a smaller difference from the set temperature of the second fixing roller, is pressed against the second fixing roller.

24. The electrophotographic apparatus according to claim 22 or claim 23, wherein the fixing-section forming means is constituted of: a roller support base for supporting the first fixing roller and the third fixing rollers at fixed stations; an intermediate holder for supporting the second fixing roller between the first roller and the third roller, the intermediate roller having a first and second end portions, the first end portion being connected to the roller support base so as to pivot freely; and an eccentric cam for shifting the second end portion of the intermediate holder toward the first and third fixing rollers.

25. The electrophotographic apparatus according to claim 22 or claim 23, wherein the fixing-section forming means is constituted of: a roller support base for supporting the first fixing roller and the third fixing rollers at fixed stations; an intermediate holder for supporting the second fixing roller between the first roller and the third roller; and a support-base driving mechanism for shifting the support-base in such a manner that the first fixing roller or the third fixing roller is pressed against the second fixing roller.

26. An electrophotographic apparatus comprising: fixing means having a first through third fixing rollers for forming a first fixing section by contacting the first and second fixing rollers as well as forming a second fixing section by contacting the second and third fixing rollers, the first fixing section being temperature-adjusted in relation to a first copying mode, the second fixing section being temperature-adjusted in relation to a second copying mode;

temperature adjusting means for applying temperature adjustments to the first and second fixing sections; and control means for controlling the temperature adjusting means in such a manner that after completion of an image forming operation by the use of either of the first and second fixing sections, the temperature adjusting means continues to conduct temperature adjustments on the same fixing section during a stand-by state until the next image forming operation is called for.

27. An electrophotographic apparatus comprising:

fixing means having a first through third fixing rollers for forming a first fixing section by contacting the first and second fixing rollers as well as forming a second fixing section by contacting the second and third fixing rollers, the first fixing section being temperature-adjusted in relation to a first copying mode, the second fixing section being temperature-adjusted in relation to a second copying mode;

temperature adjusting means for applying temperature adjustments to the first and second fixing sections; and control means for controlling the temperature adjusting means in such a manner that, after completion of a copying operation using either of the first and second fixing sections, during a stand-by state before having a demand for the next image forming operation, the temperature adjusting means preferentially conducts temperature adjustments with respect to one of the fixing sections that has been used more times than the other fixing section in the number of image forming operations that have been executed up to the preceding operation.

28. An electrophotographic apparatus comprising:

fixing means having a first through third fixing rollers for forming a first fixing section by contacting the first and second fixing rollers as well as forming a second fixing section by contacting the second and third fixing rollers, the first fixing section being temperature-adjusted in relation to a first copying mode, the second fixing section being temperature-adjusted in relation to a second copying mode;

control means for providing temperature adjustments in such a manner that fixing rollers constituting either of the upper and lower fixing sections are heated; when the temperatures of the fixing rollers have exceeded respective predetermined temperatures, the heating operation of the fixing rollers are stopped; and during a period of time when the temperatures of the fixing rollers are kept above the predetermined temperatures, temperature adjustments are applied to the rest of the first through third fixing rollers.

* * * * *